US007229749B2

(12) United States Patent
Miyamoto

(10) Patent No.: US 7,229,749 B2
(45) Date of Patent: Jun. 12, 2007

(54) SILVER HALIDE PHOTOGRAPHIC EMULSION AND SILVER HALIDE PHOTOSENSITIVE MATERIAL USING THEREOF

(75) Inventor: Yasushi Miyamoto, Minamiashigara (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 11/371,884

(22) Filed: Mar. 10, 2006

(65) Prior Publication Data

US 2006/0204906 A1 Sep. 14, 2006

(30) Foreign Application Priority Data

Mar. 10, 2005 (JP) ..... 2005-067305

(51) Int. Cl.
*G03C 1/005* (2006.01)
*G03C 1/494* (2006.01)
*G03C 1/46* (2006.01)
*G03C 1/06* (2006.01)

(52) U.S. Cl. ..... 430/567; 430/502; 430/605; 430/600; 430/603; 430/608

(58) Field of Classification Search ..... 430/502, 430/567, 605, 600, 603, 608
See application file for complete search history.

(56) References Cited

U.S. PATENT DOCUMENTS 5,494,789 A 2/1996 Daubendiek et al.
6,607,874 B2 8/2003 Ihama et al.
6,720,134 B2 4/2004 Miyamoto et al.
6,994,953 B2 * 2/2006 Matsuda et al. ..... 430/631
2005/0214698 A1 * 9/2005 Haraguchi et al. ..... 430/502

FOREIGN PATENT DOCUMENTS

JP 8-69069 A 3/1996
JP 2002-278007 A 9/2002
JP 2003-15245 A 1/2003

* cited by examiner

*Primary Examiner*—Geraldina Visconti
(74) *Attorney, Agent, or Firm*—Sughrue Mion, PLLC

(57) ABSTRACT

A silver halide photographic emulsion, wherein 70% or more of the total projected area of silver halide grains is occupied by silver halide grains satisfying the following requirements (a) to (d).

(a) It is composed of a tabular silver halide host grain with an aspect ratio of 12 or more having two mutually parallel principal planes and a silver halide protrusion portion bonded by epitaxial junction on the surface of the host grain.

(b) The silver bromide content rates of the host grain and the protrusion portion both are 70 mol % or more.

(c) When the average silver iodide content rate of all grains is I mol %, the average silver iodide content rate of the region of 8%, based on the silver amount of the host grain, of the outer shell of the host grain is (I+12) mol % or less.

7 Claims, No Drawings

SILVER HALIDE PHOTOGRAPHIC EMULSION AND SILVER HALIDE PHOTOSENSITIVE MATERIAL USING THEREOF

CROSS-REFERENCE TO RELATED APPLICATIONS

This application is based upon and claims the benefit of priority from prior Japanese Patent Application No. 2005-067305, filed Mar. 10, 2005, the entire contents of which are incorporated herein by reference.

BACKGROUND OF THE INVENTION

1. Field of the Invention

The present invention relates to a silver halide photographic emulsion having high sensitivity and excellent latent image keeping characteristics and a silver halide photosensitive material using thereof.

2. Description of the Related Art

It is well known generally to use tabular silver halide grains (hereinafter, called as "tabular grains") for obtaining a silver halide photosensitive material having high sensitivity. As the sensitization process of these tabular grains, a sensitization process using epitaxial splice is disclosed (for example, Jpn. Pat. Appln. KOKAI Publication No. (hereinafter referred to as JP-A-)8-69069 and JP-A-2002-278007).

The epitaxial sensitization process disclosed in these patents is a process by which silver halide having comparatively high silver halide content rate is epitaxially spliced with host tabular grains mainly having silver iodobromide.

However, although high sensitivity can be obtained by the epitaxial flat plate, performance is not always stable and it cannot be said that it is suitable for stably obtain performance as a photosensitive material. It is caused by that since the solubility product of silver chloride is larger than the solubility product of silver iodide, halogen conversion between the epitaxial protrusion portions of host grains occurs easily. Consequently, a photosensitive material using the epitaxial flat plate has a problem that the lowering of sensitivity and fog increase at storage occur easily.

In order to improve the stability of the epitaxial flat plate, there is disclosed an epitaxial flat plate having silver halide in which the main compositional component of host grains and the epitaxial flat plate is silver bromide (JP-A-2003-15245).

BRIEF SUMMARY OF THE INVENTION

However, although the epitaxial flat plate disclosed in JP-A-2003-15245 is superior in pressure resistance and storability during a term from production of a photosensitive material to exposure by a user, it has been cleared that there is a problem in stability (latent image keeping characteristics) during interval from exposure to development. Since preservation environment and time from exposure to development in the market are not constant condition, the latent image keeping characteristics are also one of very important performances in a silver halide photosensitive material and its improvement is desired.

The problem to be solved by the present invention is to provide a silver halide photographic emulsion having high sensitivity and excellent latent image keeping characteristics and a silver halide photosensitive material using the same.

The present inventors have conducted diligent research to overcome the above problems. As a result, they have found that the problems can be solved by the following means (1) to (11).

(1) A silver halide photographic emulsion, wherein 70% or more of the total projected area of silver halide grains is occupied by silver halide grains satisfying the following requirements (a) to (d).

(a) It is composed of a tabular silver halide host grain with an aspect ratio of 12 or more having two mutually parallel principal planes and a silver halide protrusion portion bonded by epitaxial junction on the surface of the host grain.

(b) The silver bromide content rates of the host grain and the protrusion portion both are 70 mol % or more.

(c) When the average silver iodide content rate of all grains is I mol %, the average silver iodide content rate of the region of 8%, based on the silver amount of the host grains, of the outer shell of the host grain is (I+12) mol % or less.

(d) The protrusion portion contains pseudo-halides.

(2) The silver halide photographic emulsion recited in item (1) above, wherein 70% or more of the total projected area of silver halide grains is occupied by silver halide grains satisfying the following requirement (e) in addition to the above requirements (a) to (d).

(e) The silver chloride content rates of the host grain and the protrusion portion both are 1 mol % or less.

(3) The silver halide photographic emulsion recited in item (1) above, wherein 70% or more of the total projected area of silver halide grains is occupied by silver halide grains satisfying the following requirement (f) in addition to the above requirements (a) to (d).

(f) When the average silver iodide content rate of all grains is I mol %, the silver iodide content rate of the protrusion portion is I mol % or less.

(4) The silver halide photographic emulsion recited in item (1) above, wherein 70% or more of the total projected area of silver halide grains is occupied by silver halide grains satisfying the following requirement (g) in addition to the above requirements (a) to (d).

(g) The protrusion portion contains an iridium compound.

(5) The silver halide photographic emulsion recited in item (2) above, wherein 70% or more of the total projected area of silver halide grains is occupied by silver halide grains satisfying the following requirement (f) in addition to the above requirements (a) to (e).

(f) When the average silver iodide content rate of all grains is I mol %, the silver iodide content rate of the protrusion portion is I mol % or less.

(6) The silver halide photographic emulsion recited in item (2) above, wherein 70% or more of the total projected area of silver halide grains is occupied by silver halide grains satisfying the following requirement (g) in addition to the above requirements (a) to (e).

(g) The protrusion portion contains an iridium compound.

(7) The silver halide photographic emulsion recited in item (3) above, wherein 70% or more of the total projected area of silver halide grains is occupied by silver halide grains satisfying the following requirement (g) in addition to the above requirements (a) to (d) and (f).

(g) The protrusion portion contains an iridium compound.

(8) The silver halide photographic emulsion recited in item (5) above, wherein 70% or more of the total projected area of silver halide grains is occupied by silver halide grains satisfying the following requirement (g) in addition to the above requirements (a) to (f).

(g) The protrusion portion contains an iridium compound.

(9) The silver halide photographic emulsion recited in any one of items (1) to (8) above, containing calcium.

(10) The silver halide photographic emulsion recited in any one of items (1) to (9) above, chemically sensitized using a compound releasing $AuCh^-$ ion (wherein Ch represents S, Se or Te).

(11) A silver halide photosensitive material comprising a photosensitive layer containing a silver halide photographic emulsion recited in any one of items (1) to (10).

According to the present invention, a silver halide photographic emulsion having high sensitivity and excellent latent image keeping characteristics and a silver halide photosensitive material using thereof are obtained.

DETAILED DESCRIPTION OF THE INVENTION

The present invention will be specifically illustrated. A silver halide emulsion of the present invention is characterized in that the silver halide emulsion (hereinafter, called as "silver halide grains of the present invention") composed of tabular silver halide host grains with an aspect ratio of 12 or more having two mutually parallel principal planes (hereinafter, called as "host tabular grains" or "host grains") and silver halide protrusion portions epitaxially spliced on the surface of the host grains (hereinafter, called as "silver halide protrusion portions" or "protrusion portions") occupies 70% or more of the total projected area. More preferably, the silver halide grains occupy 80% or more of the total projected area, and most preferably 90% or more of the total projected area. Hereat, the protrusion portions are portions lifted up against the host grains and can be confirmed by an electron microscope.

The host tabular grains in the present invention are composed of two mutually parallel principal planes and side planes linking the principal planes. The shape of the principal planes may be either of arbitrary polygon surrounded by straight lines, or a shape surrounded by a circle or an ellipsoid or infinite curves, or a shape surrounded by a combination of a straight line with a curve, but has preferably at least one apex. The shape may be a triangle having 3 apexes, or a quadrangle having 4 apexes, a pentagon having 5 apexes, or hexagon having 6 apexes, or preferably a combination thereof. Wherein, the apex means angle not taking on rounding which adjacent two sides form. When angle takes on rounding, it means a point bisecting the length of a curve portion taking on rounding.

The principal planes of the host tabular grains in the present invention may be any kind of crystal structure. Namely, the crystal structure of the principal planes may be a (111) plane, a (100) plane and a (110) plane, and may be further a high order plane, but preferably a (111) plane or a (100) plane, and more preferably a (111) plane.

The host tabular grains in the present invention are characterized in that an aspect ratio which is obtained by dividing the equivalent-circular diameter with grain thickness is 12 or more. The aspect ratio is preferably 12 or more and 200 or less, more preferably 12 or more and 100 or less, and most preferably 12 or more and 50 or less. Hereat, the equivalent-circular diameter is the diameter of a circle which has an area equal to the protrusion area of principal planes.

The equivalent-circular diameter of the host tabular grains can be determined, for example, by photographing the photo of a transmission electron microscope by a replica method, determining the protrusion area of respective grains by correcting a photographing magnification and converting it to the equivalent-circular diameter. Although the thickness of grains cannot be occasionally calculated simply from the shadow length of replica because of epitaxial deposition, it can be calculated by measuring the shadow length of replica before epitaxial deposition. Alternatively, even if it is after epitaxial deposition, it can be easily determined by cutting a sample coating emulsion and photographing the photo of a transmission electron microscope of its section.

The equivalent-circular diameter of the host tabular grains in the present invention is preferably 0.5 to 10.0 μm, and more preferably 0.7 to 10.0 μm. Further, the thickness of grains is preferably 0.02 to 0.5 μm, more preferably 0.02 to 0.2 μm, and most preferably 0.02 to 0.1 μm.

For the host tabular grains in the present invention, the inter-grain variation coefficient of the equivalent-circular diameter is preferably 40% or less, more preferably 30% or less, and preferably 25% or less in particular. Hereat, the inter-grain variation coefficient of the equivalent-circular diameter is a value obtained by dividing the standard deviation of distribution of the equivalent-circular diameter of respective grains by the average equivalent-circular diameter and multiplying it with 100.

In the present invention, silver halide protrusion portions are formed by epitaxial splicing at arbitrary sites on the surface of host tabular grains. The formation position is preferably on the principal plane of the host tabular grains, or apex portions, or on sides other than the apex portions, and the most preferable formation position is the apex portions. Hereat, the apex portions mean portions in a circle in which ⅓ of the length of a shorter side among 2 sides adjacent to apexes is a radius when tabular grains are viewed from the principal plane to a vertical direction. The proportion of grains in which the silver halide protrusion portions are not deposited on the host tabular grains at all is preferably 20% or less, more preferably 10% or less, and further preferably 5% or less.

The silver amount of the silver halide protrusion portions of the present invention is preferably 1% or more and 25% or less based on the silver amount of the host tabular grains, more preferably 1% or more and 20% or less, and further preferably 2% or more and 18% or less. When the proportion of the silver amount is too little, the repeating reproducibility of epitaxial formation is deteriorated, and when it is too much, problems of lowering sensitivity and deteriorating graininess are provoked. Further, the proportion of an area which the silver halide protrusion portions occupy grain surface is preferably 50% or less of the surface of the host tabular grains, and more preferably 20% or less.

The silver halide grains of the present invention are characterized in that the silver halide protrusion portions contain pseudo-halides. As described in JP-A-7-72569, the term "pseudo-halides" means a group of compounds which are nearly the property of halides (namely, those which can provide, for example, $CN^-$, $OCN^-$, $SCN^-$, $SeCN^-$, $TeCN^-$, $N_3^-$, $C(CN)_3^-$, and $CH^-$, which are a monovalent anionic group being adequately electrically negative and represent at least the same positive Hammett-Sigma value as halides, for example). As the pseudo-halides which the silver halide protrusion portions in the present invention contain, a compound which can provide $SCN^-$ or $SeCN^-$ or $TeCN^-$ is preferable, a compound which can provide $SCN^-$ or $SeCN^-$ is more preferable, and a compound which can provide $SCN^-$ is most preferable. The preferable content of the pseudo-halides at the protrusion portions is 0.01 to 10 mol % based on the silver amount of the protrusion portion, and further preferably 0.1 to 5 mol %.

The silver halide grains of the present invention are silver iodobromide, silver chlorobromide or silver chloroiodobromide in which the halogen compositions of the host grains and the protrusion portions are a content rate of pure silver bromide or silver bromide of 70 mol % or more. When it is less than 70 mol %, drawback that fog increase after preservation is enlarged occurs. The content rate of silver bromide is preferably 80 mol %, and more preferably 90 mol % or more. Further, the content rate of silver halide at the host grains and the protrusion portions is preferably 1 mol % or less. The lower the content rate of silver chloride is, the better the storability from production of the photosensitive material to exposure by user is. In addition, even if long time has passed until it is coated from dissolution of the emulsion, there is also a merit that performance change is little. In the silver halide grains of the present invention, it is most preferable that the content rates of silver chloride of the host grains and protrusion portions are 90 mol % or more together and the content rate of silver chloride is 1 mol % or less.

In the silver halide photosensitive material of the present invention, the average silver iodide content rate of all grains is preferably 20 mol % or less, more preferably 15 mol % or less, and most preferably 10 mol % or less. When the average silver iodide content rate exceeds 20 mol % or less, adequately high sensitivity cannot be obtained. When the average silver iodide content rate of all grains is I mol %, it is preferable that the silver iodide content rate at the protrusion portions is I mol % or less.

The silver halide grains of the present invention is characterized in that when the average silver iodide content rate of all grains is I mol %, the average silver iodide content rate of the region of 8%, based on the silver amount of the host grains, of the outer shell of the host grains is (I+12) mol % or less. Hereat, 8% of the outer shell of the host grain means a region in which the silver amount of laminar region from the surface of the host grain to a grain central direction occupies 8% based on the total silver amount of the host grain. Further, "the average silver iodide content rate of the region of 8%, based on the silver amount of the host grain, of the outer shell of the host grain" mentioned here means an average value of (i) the average silver iodide content rate over a region of 8% of the outer shell of the host grain (namely, a value obtained by dividing the molar number of iodine atom contained in the region of 8% of the outer shell of the host grains by the molar number of silver contained in the region) concerning an arbitrary silver halide grain of the present invention and (ii) over all grains of the silver halide grains of the present invention. In the present invention, the average silver iodide content rate of the region of 8% of the outer shell of the host grains is more preferably (I+10) mol % or less, and further preferably (I+8) mol % or less.

In the silver halide grains of the present invention, silver chloride, silver salts other than silver bromide and silver iodide, for example, rhodan silver, silver selenocyanate, silver tellurocyanate, silver sulfide, silver selenide, silver telluride, silver carbonate, silver phosphate, the silver salt of organic acid and the like may be contained in the host grains or the protrusion portions or both of the host grains and protrusion portions. Alternatively, silver salts other than silver halide may be contained in the emulsion of the present invention as separate grains.

In the host grains for use in the present invention, the intragranular halogen composition may have a multiple structure. For example, it may have a quintuple structure. Herein, the terminology "structure" refers to a structure of silver iodide distribution, and means that between structures, there is a silver iodide content difference of 1 mol % or more. The structures concerning the distribution of silver iodide can be basically determined by calculation from the prescription value of preparation process of grains. There can be a case of abrupt variation and a case of mild variation in the variation of the silver iodide content in the interface between the respective structures. It is required to consider the measurement accuracy on analysis in order to confirm these, but the EPMA method (Electron Probe Micro Analyzer method) is usually effective. The elemental analysis of a very fine region to which electron beam was irradiated can be carried out by preparing a sample in which emulsion grains are dispersed so as not to be mutually brought in contact and analyzing X-ray irradiated when electron beam was irradiated thereto. It is preferable to carry out the measurement at this time by cooling at a low temperature in order to prevent the damage of a sample caused by electron beam. The distribution of silver iodide in grains when the tabular grains are viewed from a direction perpendicular to the principal surfaces can be analyzed by the same procedure, but the distribution of silver iodide in grains at the section of the tabular grains can be also analyzed by solidifying the same sample and using samples cut into ultra thin fragments by a microtome.

In the silver halide grains of the present invention, an aspect in which silver halide grains in which dislocation lines do not exist other than epitaxial splicing portions occupy 70% or more of all protrusion area is preferable, and an aspect in which it occupies 80% or more of all protrusion area is more preferable. Further, an aspect in which silver halide grains in which dislocation lines do not exist not only other than epitaxial splicing portions but also the epitaxial splicing portions occupy 70% or more of all protrusion area is more preferable, and an aspect in which it occupies 80% or more of all protrusion area is most preferable.

Dislocation lines in tabular grains can be observed by a direct method performed using a transmission electron microscope at a low temperature, as described in, e.g., J. F. Hamilton, Phot. Sci. Tech. Eng., 11, 57, (1967) or T. Shiozawa, J. Soc. Phot. Sci. Japan, 3, 5, 213, (1972). That is, silver halide grains, carefully extracted from an emulsion so as not to apply any pressure by which dislocations are produced in the grains, are placed on a mesh for electron microscopic observation. Observation is performed by a transmission method while the sample is cooled to prevent damage (e.g., print out) due to electron rays. In this observation, as the thickness of a grain is increased, it becomes more difficult to transmit electron rays through it. Therefore, grains can be observed more clearly by using an electron microscope of a high voltage type (200 kV or more for a grain having a thickness of 0.25 μm).

Then, there is illustrated the production process of tabular grains in which a (111) plane is a principal plane (hereinafter, called as "(111) tabular grains") which is the preferable aspect of the host tabular grains in the present invention.

For example, (111) tabular grains used in the present invention can be prepared by methods described in Cleave, "Photography Theory and Practice (1930), p. 13"; Gutoff, "Photographic Science and Engineering, Vol. 14, pp. 248–257 (1970)"; U.S. Pat. Nos. 4,434,226, 4,414,310, 4,433,048 and 4,439,520 and GB No. 2,112,157 and the like.

The formation method of the tabular grains usually comprises three steps, namely, nuclei formation step, ripening step and the growth step. In the nuclei formation step, it is remarkably effective for the nucleation step of the core of the tabular grains used in the present invention, to use gelatin having small methionine content described in U.S. Pat. Nos. 4,713,320 and 4,942,120, to carry out the nucleation at high pBr described in U.S. Pat. No. 4,914,014, and to carry out the nucleation for a short time described in JP-A-2-222940. It is preferable in particular in the present invention that a silver nitrate aqueous solution, a halogen aqueous solution and low molecular weight oxidation treated gelatin are added within one minute, under stirring in the presence of the low molecular weight oxidation treated gelatin at temperature of 20° C. to 40° C. At this time, the pBr of the system is preferably 2 or more and pH is preferably 7 or less. The concentration of the silver nitrate aqueous solution is preferably a concentration of 0.6 mol/l or less.

In the ripening process, performance in the presence of a base with low concentration described in U.S. Pat. No. 5,254,453 and performance at high pH described in U.S. Pat. No. 5,013,641 can be used in the ripening process of the tabular grain emulsion of the present invention. Polyalkylene oxide compounds described in U.S. Pat. Nos. 5,147,771, 5,147,772, 5,147,773, 5,171,659, 5,210,013 and 5,252,453 can be also added in a ripening step or a later growth step. In the present invention, the ripening process is preferably carried out at a temperature of 50° C. or more and 80° C. or less. It is preferable to lower pBr to 2 or less just after nuclei formation or during ripening. Further, additional gelatin is preferably added from just after nuclei formation to at completion of ripening. In particular, preferable gelatin is gelatin in which an amino group is 95% or more of succinic or trimellitic modification.

The growth step can be also carried out by a known process by which a silver nitrate aqueous solution and a halide aqueous solution are simultaneously added, and a process of simultaneously adding a silver nitrate aqueous solution, a halide aqueous solution containing bromide and emulsion containing silver iodide fine grains which is described in U.S. Pat. Nos. 4,672,027 and 4,693,964 can be also used, but it is preferable in the present invention to use an external stirring device described in JP-A-10-043570. Namely, it is a process by which emulsion containing the fine grains of silver bromide, or silver iodobromide or silver iodochlorobromide which was prepared just before addition by the stirring device (hereinafter, called as "ultra fine grain emulsion") is continuously added at growth of tabular grains and the ultra fine grain emulsion is dissolved to grow the tabular grain. The external mixer for preparing the ultra fine grain emulsion has powerful stirring ability and a silver nitrate aqueous solution, a halogen solution and gelatin are added to the mixer. Gelatin can be also added by being mixed with the silver nitrate aqueous solution and/or halide aqueous solution preliminarily or just before mixing, and gelatin alone can be also added. Gelatin is preferably those in which average molecular weight is smaller than usual gelatin and 10000 to 50000 is preferable in particular. Gelatin in which 90% or more of an amino group is subject to phthalic or succinic or trimellitic modification and/or oxidation treated gelatin in which methionine content is lowered is preferably used in particular.

The silver halide emulsion of the present invention contains preferably a compound indicated by the following general formula (I).

General formula (I)

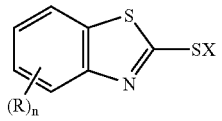

In the above formula, X represents a hydrogen atom, or an alkali metal atom (for example, lithium, sodium and potassium). A hydrogen atom sodium and potassium are preferable and a hydrogen atom and sodium are preferable in particular. R is a halogen atom (for example, fluorine, chlorine and bromine), or an alkyl group having 1 to 5 carbon atoms. The number (n of the general formula (A)) of a substituent represented by R is an integer of 0 to 4 and 0, 1 or 2 is preferable. When n is 2 or more, a plural number of R's may be the same or different.

The preferable specific example in particular is illustrated among the compounds represented by general formula (I).

I-1

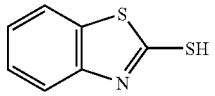

I-2

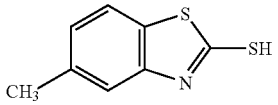

I-3

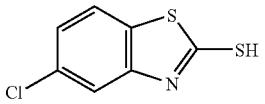

I-4

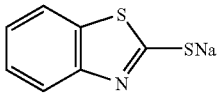

I-5

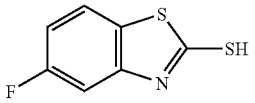

I-6

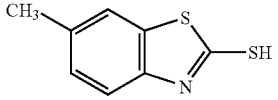

I-7

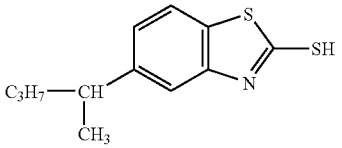

I-8

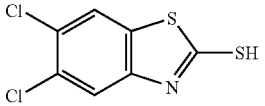

The compound represented by the fore-mentioned general formula (I) which is used for the silver halide emulsion of the present invention may be added at any position of the preparation step of the tabular silver halide emulsion, but it is preferably added before a step of splicing epitaxial with the host tabular grains. The addition amount is not specifically limited, but it is preferably 5 g to 50 g per 1 mol of silver halide and 10 to 30 g is more preferable. The addition temperature is not specifically limited and it is preferably added at a range of 20° C. to 75° C.

Then, in the present invention, the formation process of the protrusion portions of silver halide which is epitaxially spliced on the grain surface of the host tabular grains is illustrated. The formation of the protrusion portions may be carried out just after formation of the host tabular grains and may be carried out after usual desalting is carried out after formation of the host tabular grains, but the aspect in which it is carried out after formation of the host tabular grains and before starting the desalting step is preferable.

When the protrusion portions in the present invention are formed, a site indicating agent is preferably used. Various kinds of site indicating agents can be used, but a spectrally sensitized dye is preferably used. The position of the protrusion portions can be controlled by selecting the amount and kind of the spectrally sensitized dye used. The amount of the spectrally sensitized dye is preferably a range of 50% to 99% of the saturated coating amount of the host tabular grains. Usable dyes involve a cyanine dye, merocyanine dye, composite cyanine dye, composite merocyanine dye, holopolar cyanine dye, hemicyanine dye, styryl dye, and hemioxonole dye. Most useful dyes are those belonging to a cyanine dye. These dyes can contain any nucleus commonly used as a basic heterocyclic nucleus in cyanine dyes. Examples are a pyrroline nucleus, oxazoline nucleus, thiazoline nucleus, pyrrole nucleus, oxazole nucleus, thiazole nucleus, selenazole nucleus, imidazole nucleus, tetrazole nucleus, and pyridine nucleus; a nucleus in which an aliphatic hydrocarbon ring is fused to any of the above nuclei; and a nucleus in which an aromatic hydrocarbon ring is fused to any of the above nuclei, e.g., an indolenine nucleus, benzindolenine nucleus, indole nucleus, benzoxadole nucleus, naphthoxazole nucleus, benzthiazole nucleus, naphthothiazole nucleus, benzoselenazole nucleus, benzimidazole nucleus, and quinoline nucleus. These nuclei can be substituted on a carbon atom.

Only one kind of the spectrally sensitized dye as the site indicating agent may be used but the aspect in which a combination of a plural number of kinds is used is more preferable. Examples of using a plural number of kinds of the spectrally sensitized dyes in combination are described in, for example, U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, BP Nos. 1344281 and 1507803, Jpn. Pat. Appln. KOKOKU Publication No. (hereinafter referred to as JP-B-)43-4936, JP-B-53-12375, JP-A-52-110618 and JP-A-52-109925.

A dye itself having no spectrally sensitizing action or a substance not substantially absorbing visible light and indicating intense color sensitization may be simultaneously or separately added together with the spectrally sensitized dye as the site indicating agent.

The silver halide protrusion portions in the silver halide emulsion of the present invention can be formed by addition of a solution containing silver nitrate. At this time, a process of simultaneously adding the silver nitrate aqueous solution and halide aqueous solution can be used and the silver nitrate aqueous solution can be added separately, but a process of simultaneous addition is a preferable aspect. The protrusion portions may be formed by addition of silver bromide fine grains, silver iodide fine grains and silver chloride fine grains whose particle diameter is smaller than the thickness of the host tabular grains, or by addition of fine particles consisting of mix crystal thereof. In case of the process of simultaneously adding the silver nitrate aqueous solution and halide aqueous solution, a process of addition while keeping the pBr of the system at constant is preferable. The addition time of the silver nitrate aqueous solution is preferably 1 min or more and 120 min or less, and in particular, preferably 2 min or more and 90 min or less. Further, the concentration of the silver nitrate aqueous solution is preferably a concentration of 1.5 mol/L or less and 1.0 mol/L or less is preferable in particular (hereinafter, litter is described as "L"). pBr at forming the silver halide protrusion portions is preferably 3.5 or more, and preferably 4.0 or more in particular. Temperature of 25° C. or more and 50° C. or less is preferably carried out. pH is preferably 3 or more and 8 or less.

In order to contain the pseudo-halide in the epitaxial protrusion portions in the present invention, the pseudo-halide salt is added before or during formation of the protrusion portions, or it can be contained in a halide aqueous solution which is simultaneously added together with silver nitrate. For example, KCN, KSCN, KSeCN and the like can be used.

In the present invention, the content of the pseudo-halide at the protrusion portions can be measured by a method below. The silver halide tabular grains in the silver halide photosensitive material is taken out by treating a photosensitive material with protein decomposing enzyme and separating by centrifugation. The grains are dispersed again and mounted on copper mesh expanding a supporting film. The content of the pseudo-halide is measured by carrying out spot analysis focusing on a spot diameter of 2 nm or less using an analysis electron microscope for the protrusion portions of the grain. The content rate of the pseudo-halide can be determined by similarly treating silver halide grains which have known content rate as a calibration line and preliminarily determining a ratio of Ag intensity and the pseudo-halide intensity. For example, the case of $SCN^-$ can be determined from the ratio of Ag intensity and S intensity. As the analysis beam source of an analysis electron microscope, a field emission type electric gun having higher electron density than those using thermal electron is suitable, and the content rate of the pseudo-halide at the protrusion portions can be easily analyzed by narrowing a spot diameter to 1 nm or less. When the inter-grain variation coefficient of the content rate of the pseudo-halide at the protrusion portions is 30% or less, 20 grains are usually measured and averaged to determine the average content rate of the pseudo-halide. When the inter-grain variation coefficient of the content rate of the pseudo-halide at the protrusion portions is 20% or less, 10 grains are usually measured and averaged to determine the average content rate of the pseudo-halide. The inter-grain variation coefficient of the content rate of the pseudo-halide at the protrusion portions is preferably 20% or less.

The silver halide grains of the present invention contain preferably a metal complex in which a metal from Group III to Group X of the Periodic Table is a central metal. As the metal from Group III to Group X of the Periodic Table, Cr, Re, Fe, Ru, Os, Co, Rh, Ir, Ni, Pd, Pt, Cu, Au, Zn, Cd, Hg and the like can be used. Fe, Ru, Os, Co, Rh, Ir, Pt, Cu, and Zn are more preferable, Fe, Ru, Os, Co, Rh and Ir are further preferable, and Ir (iridium) is most preferable. As the metal complex in which these metals are a central metal, only one kind can be used but 2 or 3 or more of metals can be used in combination.

The metal complex in which iridium is a central metal is a trivalent or quadrivalent iridium complex and examples include a hexachloroiridium (III) complex salt, a hexachloroiridium (IV) complex salt, a hexabromoiridium (III) complex salt, a hexabromoiridium (IV) complex salt, a hexaiodoiridium (III) complex salt, a hexaiodoiridium (IV) complex salt, an aquapentachloroiridium (III) complex salt, an aquapentachloroiridium (IV) complex salt, an aquapentabromoiridium (III) complex salt, an aquapentabromoiridium (IV) complex salt, an aquapentaiodoiridium (III) complex salt, an aquapentaiodoiridium (IV) complex salt, a diaquatetrachloroiridium (III) complex salt, a diaquatetrachloroiridium (IV) complex salt, a diaquatetrabromoiridium (III) complex salt, a diaquatetrabromoiridium (IV) complex salt, a diaquatetraiodoiridium (III) complex salt, a diaquatetraiodoiridium (IV) complex salt, a triaquatrichloroiridium (III) complex salt, a triaquatrichloroiridium (IV) complex salt, a triaquatribromoiridium (III) complex salt, a triaquatribromoiridium (IV) complex salt, a triaquatriiodoiridium (III) complex salt, a triaquatriiodoiridium (IV) complex salt, a hexaanmineiridium (III) complex salt and a hexaanmineiridium (IV) complex salt. However, it is not limited to these. Only one kind of these metal complexes can be used but a combination of 2 or 3 or more of metal complexes can be also used.

The metal complex in which a metal from Group III to Group X of the Periodic Table is a central metal can be contained in various positions in the silver halide grains of the present invention. Namely, it may be contained in the host tabular grains, may be contained in the protrusion portions epitaxially spliced, or may be contained in both of these. When it is contained in the host tabular grains, it may be uniformly contained in the grains and it may locally exist on the surface and inside of the grains. Further, it can be also contained in the extremely shallow subsurface nearby grain surface. Among these, a position in which the metal complex is contained is preferably in the inside of the silver halide protrusion portions epitaxially spliced. The most preferable one is the aspect in which an iridium complex is contained in the protrusion portions.

The metal complex in which a metal from Group III to Group X of the Periodic Table is a central metal is preferably added by being dissolved in water or appropriate organic solvents such as methanol and acetone. A method of adding a hydrogen halide aqueous solution (for example, HCl and HBr) or halogenated alkali (for example, KCl, NaCl, KBr and NaBr) can be also used for stabilizing a solution. Further, acid and alkali may be added if necessary.

The metal complex in which a metal from Group III to Group X of the Periodic Table is a central metal can be also added in a reaction vessel before formation of grains, can be also added on way to formation of grains, and can be also added after completion of the formation of grains, but it is preferable to be added on way to the formation of grains, more preferable to be added after the formation of host grains, and further preferable to be added before the formation of the silver halide protrusion portions, or on way to the formation.

Various processes can be used for containing the metal complex in which a metal from Group III to Group X of the Periodic Table is a central metal, in the silver halide grains. For example, there can be suitably selected to be used a process of containing the metal complex in a halide solution which is used for the grain growth of host grains and formation of the protrusion portions; a process of adding a solution containing the metal complex in a reaction vessel in which the grain growth of host grains and formation of the protrusion portions are carried out, while controlling flow rate or without control; a process of preliminarily containing the metal complex in the silver halide grains, site indication agent and the like which are added in a reaction vessel in which the grain growth of host grains and formation of the protrusion portions are carried out; etc.

The preferable content of the metal complex in which a metal from Group III to Group X of the Periodic Table is a central metal is preferably a range of $10^{-9}$ to $10^{-2}$ mol per 1 mole of the silver halide. It is more preferably a range of $10^{-8}$ to $10^{-3}$ mol per 1 mole of the silver halide.

In case of the silver halide grains of the present invention, at least one of chalcogen sensitizations such as sulfur sensitization, selenium sensitization and the like; noble metal sensitizations such as gold sensitization, palladium sensitization, and the like; and the reduction sensitization can be carried out in an arbitrary step of the production steps of the silver halide photographic emulsion. It is preferable to combine two or more of sensitization methods. Various type emulsions can be prepared depending on decision at what steps chemical sensitization is carried out. There is a type of burying chemical sensitization nuclei in the inside of grains, a type of burying them at a shallow position from the grain surface, or a type of making the chemical sensitization nuclei on surface. The position of the chemical sensitization nuclei can be selected in accordance with purposes for the emulsion of the present invention. The shallow position from the grain surface is generally preferred.

One of the chemical sensitizations which can be preferably carried out in the present invention is single or a combination of chalcogen sensitization and noble metal sensitization, and can be carried out using active gelatin as described in T. H. James, "The Theory of the Photographic Process, $4^{th}$ edition, (1977), pp. 67–76", published by Macmillan. Further, as described in "Research Disclosure Vol. 120 (April 1974), p. 12008"; "Research Disclosure Vol. 34 (June 1975), p. 13452", U.S. Pat. Nos. 2,642,361, 3,297,446, 3,772,031, 3,857,711, 3,901,714, 4,266,018, 3,904,415, and BG Patent No. 1,315,755, the chemical sensitization can be carried out using sulfur, selenium, tellurium, gold, platinum, palladium, iridium or the combination of a plural number of these sensitizers at a pAg of 5 to 10, a pH of 5 to 8 and a temperature of 30 to 80° C.

Noble metal salts such as gold, platinum, palladium, iridium and the like can be used in the noble metal sensitization, and among these, particularly, gold sensitization, palladium sensitization and a combination of both are preferable. In case of the gold sensitization, known compounds such as chloroauric acid, potassium chloroaurate, potassium chloroauric thiocyanate, gold sulfide, gold selenide and the like; mesoionic gold compound described in U.S. Pat. No. 5,220,030; and azole gold compound described in U.S. Pat. No. 5,049,484, the disclosures of which are incorporated by reference, can be used. The palladium compound means divalent salt of palladium or tetra-valent salt of palladium. The preferable palladium compound is represented by $R_2PdX_6$, and $R_2PdX_4$. Wherein R represents a hydrogen atom, an alkali atom, or an ammonium group. X represents a halogen atom, and represents a chlorine atom, a bromine atom or an iodine atom. Specifically, $K_2PdCl_4$, $(NH_4)_2PdCl_6$, $Na_2PdCl_4$, $(NH_4)_2PdCl_4$, $Li_2PdCl_4$, $Na_2PdCl_6$ or $K_2PdBr_4$ is preferable. The gold compound and the palladium compound are preferably used in combination with a thiocyanate or a selenocyanate.

In case of the emulsion of the present invention, it is preferable to be carried out in combination with a gold sensitization. The preferable amount of the gold sensitizer used in the present invention is $1\times10^{-3}$ to $1\times10^{-7}$ mol per mol of silver halide, and more preferably $1\times10^{-4}$ to $5\times10^{-7}$ mol. The preferable range of the palladium compound is $1\times10^{-3}$ to $5\times10^{-7}$ mol. The preferable range of the thiocyan compound or a selenocyan compound is $5\times10^{-2}$ to $1\times10^{-6}$ mol.

As sulfur sensitizers, hypo, a thiourea-based compound, a rhodanine-based compound, and a sulfur-containing compound described in U.S. Pat. Nos. 3,857,711, 4,266,018, and 4,054,457 can be used. Chemical sensitization can be also carried out in the presence of a so-called chemical sensitization aid. As the chemical sensitization aid, compounds such as azaindene, azapyridazine, azapyrimidine and the like which are known as those suppressing the fogging in the process of the chemical sensitization and increasing sensitivity, are used. Examples of the chemical sensitization aid modifier are described in U.S. Pat. Nos. 2,131,038, 3,411,914 and 3,554,757, JP-A-58-126526, and Daffine, "Photographic Emulsion Chemistry pp. 138–143".

The preferable amount of the sulfur sensitizer used in the present invention is $1\times10^{-4}$ to $1\times10^{-7}$ mol per mol of silver halide, and more preferably $1\times10^{-5}$ to $5\times10^{-7}$ mol.

There is the selenium sensitization as the preferable method for the emulsion of the present invention. Selenium compounds disclosed in known conventional patents can be used as the selenium sensitizer used in the present invention. In general, an unstable selenium compound and/or non-unstable selenium compound is used by adding this, and stirring the emulsion at a high temperature (preferably 40° C. or more) for a fixed time. As the unstable selenium compound, compounds described in JP-B's-44-15748 and 43-13489, JP-A's-4-25832 and 4-109240 and the like are preferably used.

As the unstable selenium sensitizer, for example, isoselenocyanates (e.g., aliphatic isoselenocyanates such as allylisoselenocyanate), selenoureas, selenoamides, selenocarboxylic acids (e.g., 2-selenopropionic acid, and 2-selenobutylic acid), selenoesters, diacylselenides (e.g., bis(3-chloro-2,6-dimethoxybenzoyl)selenide), selenophosphates, phosphineselenides, and colloid type metallic selenium are mentioned.

The preferable analogous type of the unstable selenium compounds were described above, but these are not limiting compounds. With respect to the unstable selenium compounds as the sensitizer of the photographic emulsion, it is generally understood by those skilled in the art that the structure of said compounds is not so important as far as selenium is unstable, and the organic portion of the selenium sensitizer molecule supports selenium and has no allotment except for letting it exist in the emulsion in an unstable form. The unstable selenium compound having such wide concept is advantageously used in the present invention.

As the non-unstable selenium compounds used in the present invention, compounds described in JP-B's-46-4553, 52-34492 and 52-34491 are used. As the non-unstable selenium compounds, for example, selenous acid, potassium selenocyanate, selenazoles, quatery salt of selenazoles, diarylselenide, diaryldiselenide, dialkylselenide, dialkyldiselenide, 2-selenazolidinedione, 2-selenooxalidinethione, and derivatives thereof are mentioned.

These selenium sensitizers are added at chemical sensitization by being dissolved in water or organic solvents such as methanol, ethanol and the like alone or in a mix solvent. They are preferably added before starting the chemical sensitization. The selenium sensitizer used is not limited to one, and a combination of 2 or more of the above-mentioned selenium sensitizers can be used. It is preferable to use the unstable selenium sensitizer and the non-unstable selenium sensitizer in combination.

The addition amount of the selenium sensitizer used in the present invention differs depending on the activity of the selenium sensitizer used, the type and size of silver halide, the temperature and time of ripening, and the like, and preferably $1\times10^{-8}$ mol or more per mol of silver halide and more preferably $1\times10^{-7}$ mol or more and $5\times10^{-5}$ mol or less. The temperature of chemical ripening when the selenium sensitizer is used is preferably 40° C. or more and 80° C. or less. pAg and pH are arbitrary. For example, the effect of the present invention is obtained within a wide pH range of 4 to 9.

The selenium sensitization is preferably used in combination of the sulfur sensitization or the noble metal sensitization or both of them. Further, in the present invention, thiocyanate is preferably added to the silver halide emulsion at chemical sensitization. As thiocyanate, potassium thiocyanate, sodium thiocyanate, ammonium thiocyanate and the like are used. It is usually added by being dissolved in an aqueous solution or a water-soluble solvent. The addition amount is $1\times10^{-5}$ to $1\times10^{-2}$ mol per mol of silver halide, and more preferably $5\times10^{-5}$ to $5\times10^{-3}$ mol.

The silver halide emulsion of the present invention is preferably sensitized chemically using a compound releasing $AuCh^-$ ion (wherein Ch represents S, Se or Te). The compound releasing $AuCh^-$ ion may be any structure so far as it is a compound releasing $AuCh^-$ ion, but can be preferably selected from a compound represented by either of the following general formula (AUS1), general formula (AUS2), general formula (AUS3) or general formula (AUS4), or inorganic salts such as gold thiosulfate salt ($Na_3Au(S_2O_3)_2$).

General Formula (AUS1)

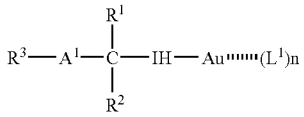

General Formula (AUS2)

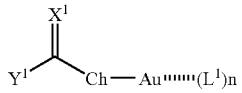

General Formula (AUS3)

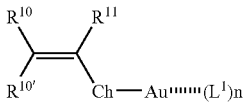

General Formula (AUS4)

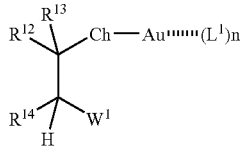

In the above formula, Ch represents an S atom, a Se atom or a Te atom and $L^1$ represents a compound which can be coordinated with gold through an N atom, an S atom, a Se atom, a Te atom or a P atom. n Represents 0 or 1. $A^1$ represents O, S or $NR^4$ and each of $R^1$ to $R^4$ represents independently a hydrogen atom or a substituent. R3 may form a 5- to 7-membered ring together with $R^1$ or $R^2$. $X^1$ represents O, S or $NR^5$. $Y^1$ represents an alkyl group, an alkenyl group, an alkynyl group, an aryl group or a hetero cyclic group, O, $R^6$, $SR^7$, $N(R^8)R^9$. $R^5$ and $R^9$ represent independently a hydrogen atom, an alkyl group, an alkenyl group, an alkynyl group, an aryl group or a hetero cyclic group. $X^1$ and $Y^1$ are mutually bonded to form a ring. Each of $R^{10}$, $R^{10'}$ and $R^{11}$ represents independently a hydrogen atom or a substituent but at least one of $R^{10}$ and $R^{10'}$ represents an electron attractive group. $R^{10}$, $R^{10'}$ and $R^{11}$ are mutually bonded to form a ring. $W^1$ represents an electron attractive group and each of $R^{12}$ to $R^{14}$ represents independently a hydrogen atom or a substituent. $W^1$ and $R^{12}$ are mutually bonded to form a ring structure.

In the illustration of respective groups of the general formulae (AUS1) to (AUS4), the example of the substituent includes a halogen atom (a fluorine atom, a chlorine atom, a bromine atom and an iodine atom), an alkyl group (which is linear chain, branched, cyclic substituted or unsubstituted alkyl group and includes also a bicycloalkyl group, or a structure of tricyclo, an active methylene group and the like), an alkenyl group, an alkynyl group, an aryl group, a heterocyclic group (which is a 5- to 7-membered, substituted or unsubstituted and saturated or unsaturated hetero ring having at least any one of a N atom, a O atom, and a S atom, may be a single ring and further, may form a condensed ring together with other aryl ring or hetero ring. Examples include a pyrrolyl group, a pyrrolidinyl group, a pyridyl group, a piperidyl group, a piperazinyl group, an imidazolyl group, a pyrazolyl group, a pyrazinyl group, a pyrimidinyl group, a triazinyl group, a triazolyl group, a tetrazolyl group, a quinolyl group, an isoquinolyl group, an indolyl group, an indazolyl group, a benzimidazolyl group, a pyranyl group, a chromenyl group, a thienyl group, an oxazolyl group, an oxadiazolyl group, a thiazolyl group, a thiadiazolyl group, a benzooxazolyl group, a benzthiazolyl group, a morpholino group, a morpholinyl group and the like. The position substituted can be ignored), an acyl group, an alkoxycarbonyl group, an aryloxycarbonyl group, a heterocyclic oxycarbonyl group, a carbamoyl group, an N-hydroxycarbamoyl group, an N-acylcarbamoyl group, an N-sulfonylcarbamoyl group, an N-carbamoylcarbamoyl group, a thiocarbamoyl group, an N-sulfamoylcarbamoyl group, a carbazoyl group, a carboxyl group (including its salt), an oxalyl group, an oxamoyl group, a cyano group, a formyl group, a hydroxyl group, an alkoxy group (including a group repeatedly including an ethyleneoxy group or a propyleneoxy group unit), an aryloxy group, a heterocyclic oxy group, an acyloxy group, an alkoxycarbonyloxy group, an aryloxycarbonyloxy group, a carbamoyloxy group, a sulfonyloxy group, a silyloxy group, a nitro group, an amino group, a (alkyl, aryl or heterocyclic)amino group, an acylamino group, a sulfonamide group, an ureido group, a thioureido group, an N-hydroxyureido group, an imido group, an alkoxycarbonylamino group, an aryloxycarbonylamino group, a sulfamoylamino group, a semicarbazido group, a thiosemicarbazido group, a hydrazino group, an ammonio group, an oxamoylamino group, an N-(alkyl or aryl)sulfonylureido group, an N-acylureido group, an N-acylsulfamoylamino group, a hydroxyamino group, a heterocyclic group containing a quaternary nitrogen atom (for example, a pyridinio group, an imidazolio group, a quinolinio group and an isoquinolinio group), an isocyano group, an imino group, a mercapto group (and including its salt), an alkylthio group, an arylthio group, a heterocyclic thio group, an (alkyl, aryl or heterocyclic)dithio group, an (alkyl or aryl)sulfonyl group, an (alkyl or aryl)sulfinyl group, a sulfo group (and including its salt), a sulfamoyl group, an N-acylsulfamoyl group, an N-sulfonylsulfamoyl (and including its salt) group, a phosphino group, a phosphinyl group, a phosphinyloxy group, a phosphinylamino group, a silyl group and the like. Further, the salt means a salt of cation such as an alkali metal, an alkali earth metal and heavy metal, and a salt of organic cation such as ammonium ion and phosphonium ion. These substituents may be further substituted with the above-mentioned substituents.

In the general formulae (AUS1) to (AUS4), Ch represents an S atom, an Se atom or a Te atom, but an S atom or an Se atom is preferable in the present invention and an S atom is more preferable.

Among the compounds represented by either of the general formulae (AUS1) to (AUS4), a compound represented by the general formula (AUS1), (AUS2) or (AUS3) is preferable, a compound represented by the general formula (AUS1) or (AUS3) is more preferable and a compound represented by the general formula (AUS1) is most preferable.

The specific example of the compound represented by either of the general formulae (AUS1) to (AUS4) is shown below, but is not limited to these. Further, a steric configuration is not limited with respect to a compound whose stereoisomers exist in plurality.

AUS-1

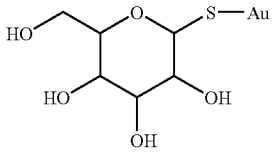

AUS1-2

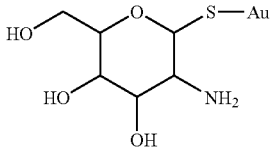

AUS1-3

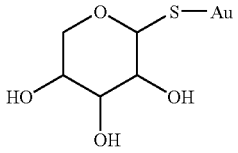

AUS1-4

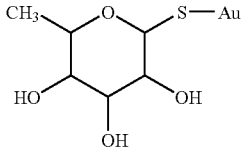

AUS1-5

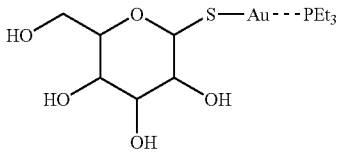

AUS1-6

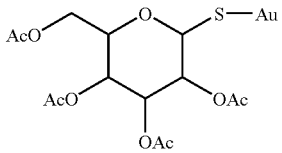

-continued
AUS1-7
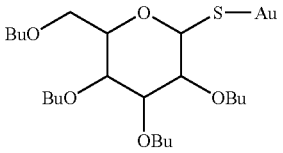
AUS1-8
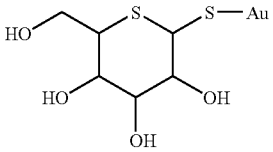
AUS1-9
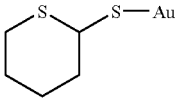
AUS1-10
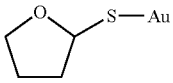
AUS1-11
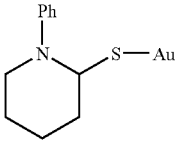
AUS1-12
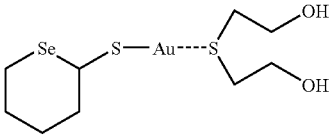
AUS1-13
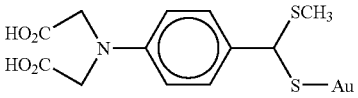
AUS1-14
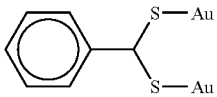
AUS1-15
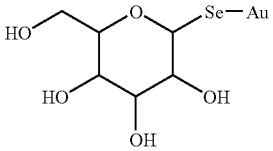
AUS1-16
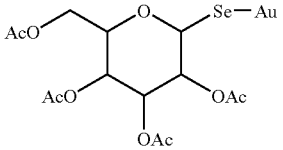
AUS1-17
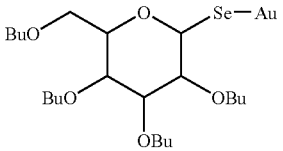
-continued
AUS1-18
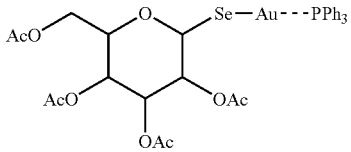
AUS1-19
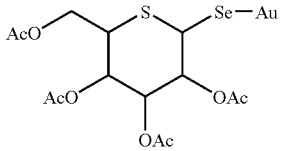
AUS1-20
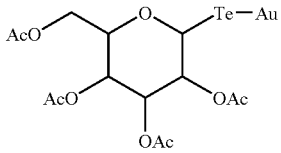
AUS2-1
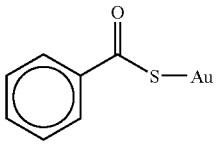
AUS2-2
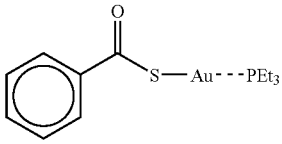
AUS2-3
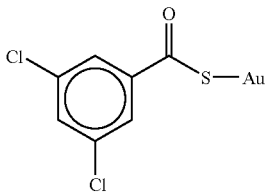
AUS2-4
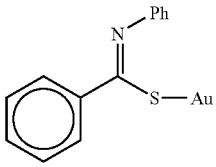
AUS2-5
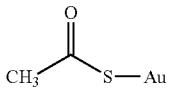
AUS2-6
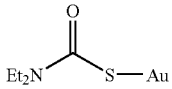
AUS2-7
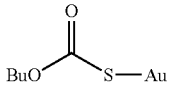

-continued
AUS2-8
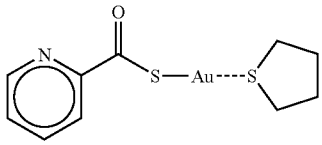
AUS2-9
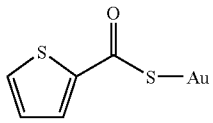
AUS2-10
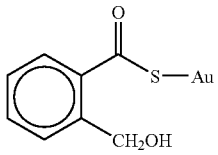
AUS2-11
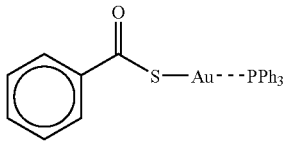
AUS2-12
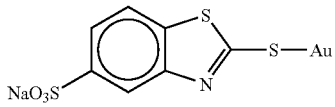
AUS2-13
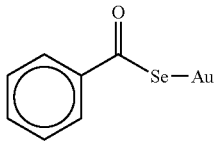
AUS2-14
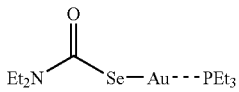
AUS2-15
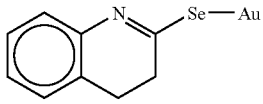
AUS2-16
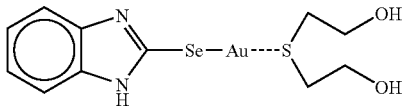
AUS2-17
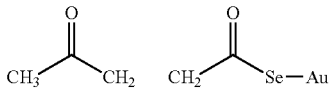
AUS2-18
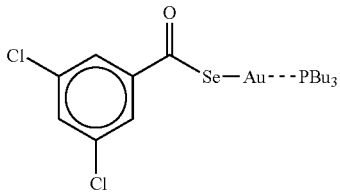
-continued
AUS2-19
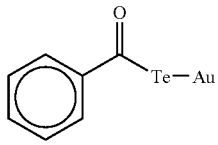
AUS2-20
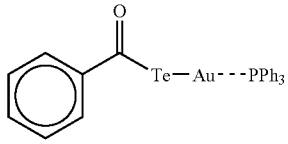
AUS3-1
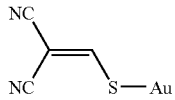
AUS3-2
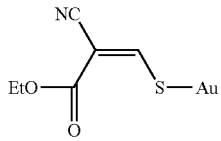
AUS3-3
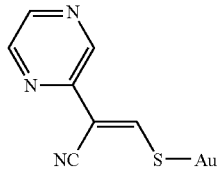
AUS3-4
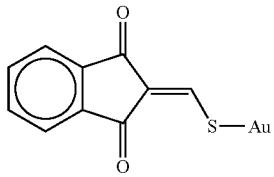
AUS3-5
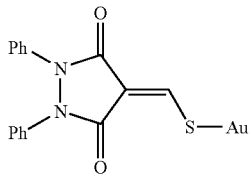
AUS3-6
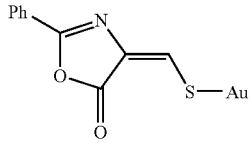
AUS3-7
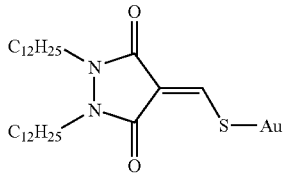

-continued
AUS3-8
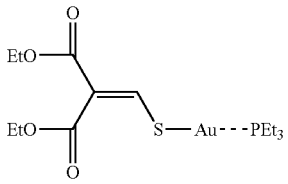
AUS3-9
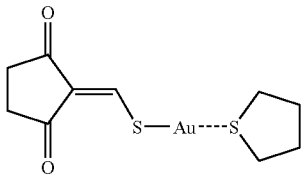
AUS3-10
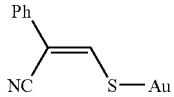
AUS3-11
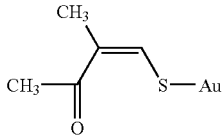
AUS3-12
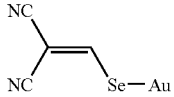
AUS3-13
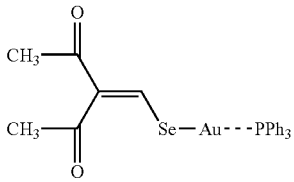
AUS3-14
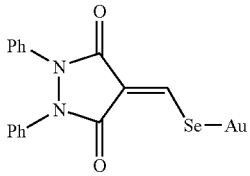
AUS3-15
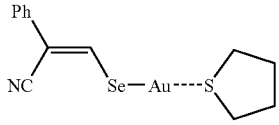
AUS3-16
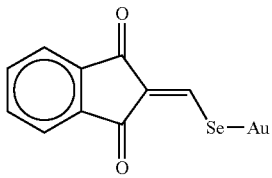
AUS3-17
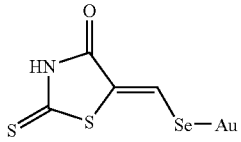
-continued
AUS3-18
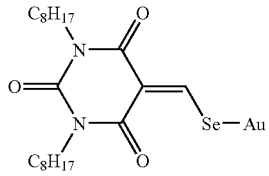
AUS3-19
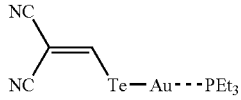
AUS3-20
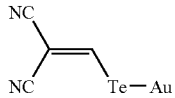
AUS4-1
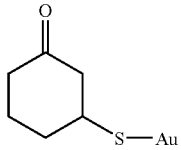
AUS4-2
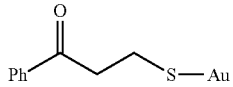
AUS4-3
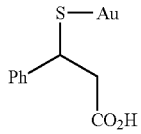
AUS4-4
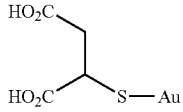
AUS4-5
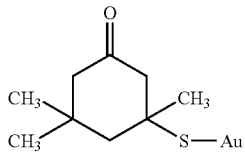
AUS4-6
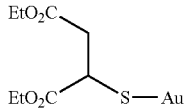
AUS4-7
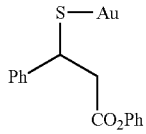

-continued

AUS4-8

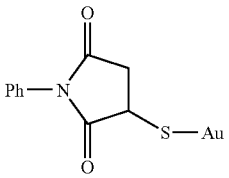

AUS4-9

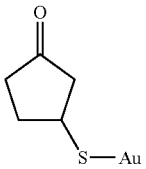

AUS4-10

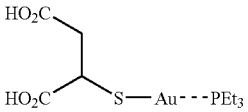

AUS4-11

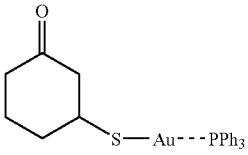

AUS4-12

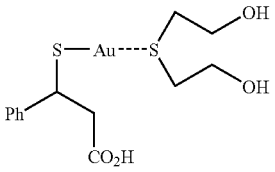

AUS4-13

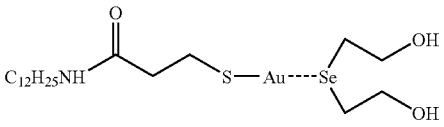

AUS4-14

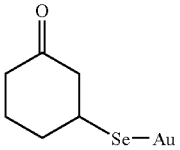

AUS4-15

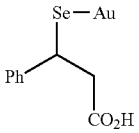

AUS4-16

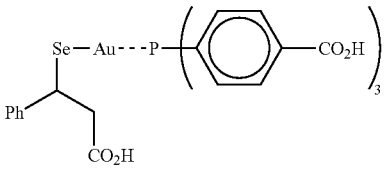

AUS4-17

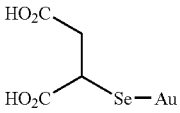

-continued

AUS4-18

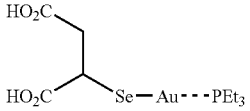

AUS4-19

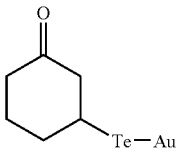

AUS4-20

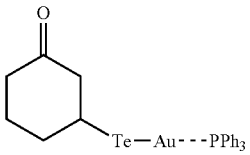

The addition amount of the compound releasing $AuCh^-$ ion (wherein Ch represents S, Se or Te) which is used for chemically sensitizing the silver halide emulsion of the present invention can be changed at a wide range if necessary, but is usually $1\times10^{-7}$ to $1\times10^{-3}$ mol per 1 mole of silver halide and preferably $1\times10^{-7}$ to $5\times10^{-4}$ mol, and $5\times10^{-7}$ to $1\times10^{-4}$ mol is more preferable.

The compound represented by either of the general formulae (AUS1) to (AUS4) may be added by being dissolved in water, alcohols (methanol, ethanol and the like), ketones (acetone and the like), amides (dimethylformamide and the like), glycols (methylpropylene glycol and the like) and esters (ethyl acetate and the like), and may be added as solid dispersion (fine crystal dispersion) by a known dispersion process.

The addition of the compound represented by the general formulae (AUS1) to (AUS4) or inorganic salts such as gold thiosulfate salt ($Na_3Au(S_2O_3)_2$) can be carried out at any step at production of emulsion, but is preferably added at interval from the formation of silver halide emulsion to the completion of chemical sensitization.

The compound releasing $AuCh^-$ ion means a compound releasing $AuCh^-$ ion when the present compound is heated at 70° C. for 2 hours in an appropriate solvent. A method of determining whether a compound is the compound releasing $AuCh^-$ ion or not is more specifically described below.

(A) A Method of Determining Whether a Compound is the Compound Releasing $AuS^-$ Ion or Not After a compound sample is dissolved in an appropriate solvent and greatly excessive silver nitrate solution is then added for a compound to be judged, it is added at 70° C. and reacted for 2 hours. Since a compound releasing $AuS^-$ ion generates often precipitate, the precipitate generated is taken out by filtration. It is confirmed that it is AuAgS by analysis of the precipitate with powder X-ray diffraction, or it is confirmed that it is AuAgS by analysis of the precipitate using procedures such as fluorescence X-ray and ICP.

Then, the yield amount and yield of the precipitate obtained are determined and a compound in which AuAgS was provided at 0.5 mol or more (namely, a yield of 50% or more) per 1 mol of the sample compound is judged as "a compound releasing $AuS^-$ ion". Hereat, the appropriate solvent is a solvent which can dissolve both of the sample compound and silver nitrate and does not produce decomposition reaction when the sample compound or silver nitrate is dissolved alone. Specific example includes water, acetonitrile, methanol, ethanol, 1,4-dioxane and a mix solvent thereof.

Further, AuAgS is not precipitated at a yield of 50% or more and the silver complex of the compound sample is occasionally precipitated. In such case, it is not the compound releasing $AuS^-$ ion which used in the present invention. AuAgS is not precipitated at a yield of 50% or more and further another compound is also occasionally precipitated. In such case, it is the compound releasing $AuS^-$ ion which used in the present invention.

In the present determining method, general gelatin which is used for preparation of emulsion may be added in reaction system. Further, pH of the present reaction system is 12 or less, preferably 10 or less, further preferably 8 or less, and most preferably 3 to 7.

(B) Determining Method of Compound Releasing $AuSe^-$ Ion and Compound Releasing $AuTe^-$ Ion It is basically carried out in like manner as the above-mentioned (A).

The surface or the arbitrary portion from surface of the emulsion used in the present invention may be chemically sensitized. When the inside is chemically sensitized, a method described in JP-A-63-264740 can be referred. Further, when the content of chloride ion is less in the silver halide protrusion portions epitaxially spliced, chemical sensitization tends to be internally carried out and when the protrusion portions are formed in the presence of thiocyanic ion, chemical sensitization tends to be internally carried out.

Silver halide emulsions of the present invention can also be subjected to reduction sensitization during grain formation, after grain formation and before or during chemical sensitization, or after chemical sensitization. Reduction sensitization can be selected from a method of adding reduction sensitizers to a silver halide emulsion, a method called silver ripening in which grains are grown or ripened in a low-pAg ambient at pAg 1 to 7, and a method called high-pH ripening in which grains are grown or ripened in a high-pH ambient at pH 8 to 11. Two or more of these methods can also be used together. The method of adding reduction sensitizers is preferred in that the level of reduction sensitization can be finely adjusted.

Known examples of reduction sensitizers are stannous salt, ascorbic acid and its derivative, amines and polyamines, a hydrazine derivative, formamidinesulfinic acid, a silane compound, and a borane compound. In reduction sensitization of the present invention, it is possible to selectively use these known reduction sensitizers or to use two or more types of compounds together. Preferred compounds as reduction sensitizers are stannous chloride, thiourea dioxide, dimethylamineborane, and ascorbic acid and its derivative. Although the addition amount of reduction sensitizers must be so selected as to meet the emulsion producing conditions, a preferable amount is $10^{-7}$ to $10^{-3}$ mol per mol of a silver halide.

Reduction sensitizers are dissolved in, for example, water or an organic solvent such as alcohols, glycols, ketones, esters, or amides, and the resultant solution is added during grain growth. Although adding to a reactor vessel in advance is also preferred, adding at a given timing during grain growth is more preferred. It is also possible to add reduction sensitizers to an aqueous solution of a water-soluble silver salt or of a water-soluble alkali halide to precipitate silver halide grains by using this aqueous solution. Alternatively, a solution of reduction sensitizers can be added separately several times or continuously over a long time period with grain growth.

It is preferable to use an oxidizer for silver during the process of producing emulsions of the present invention. An oxidizer for silver is a compound having an effect of converting metal silver into silver ion. A particularly effective compound is the one that converts very fine silver grains, formed as a by-product in the process of formation and chemical sensitization of silver halide grains, into silver ion. The silver ion produced can form a silver salt hard to dissolve in water, such as a silver halide, silver sulfide, or silver selenide, or a silver salt easy to dissolve in water, such as silver nitrate. An oxidizer for silver can be either an inorganic or organic substance. Examples of an inorganic oxidizer are ozone, hydrogen peroxide and its adduct (e.g., $NaBO_2.H_2O_2.3H_2O$, $2NaCO_3.3H_2O_2$, $Na_4P_2O_7.2H_2O_2$, and $2Na_2SO_4.H_2O_2.2H_2O$), peroxy acid salt (e.g., $K_2S_2O_8$, $K_2C_2O_6$, and $K_2P_2O_8$), a peroxy complex compound (e.g., $K_2[Ti(O_2)C_2O_4].3H_2O$, $4K_2SO_4.Ti(O_2)OH.SO_4.2H_2O$, and $Na_3[VO(O_2)(C_2H_4)_2.6H_2O]$), permanganate (e.g., $KMnO_4$), an oxyacid salt such as chromate (e.g., $K_2Cr_2O_7$), a halogen element such as iodine and bromine, perhalogenate (e.g., potassium periodate), a salt of a high-valence metal (e.g., potassium hexacyanoferrate(II)), and thiosulfonate.

Examples of an organic oxidizer are quinones such as p-quinone, an organic peroxide such as peracetic acid and perbenzoic acid, and a compound for releasing active halogen (e.g., N-bromosuccinimide, chloramine T, and chloramine B).

Preferable oxidizers of the present invention are inorganic oxidizers such as ozone, hydrogen peroxide and its adduct, a halogen element, and thiosulfonate, and organic oxidizers such as quinones. It is preferable to use the reduction sensitization described above and the oxidizer for silver together. In this case, the reduction sensitization can be performed after the oxidizer is used or vice versa, or the oxidizer can be used simultaneously with the reduction sensitization. These methods can be applied to both the grain formation step and the chemical sensitization step.

An appropriate amount of calcium is preferably contained in the silver halide emulsion of the present invention. Thereby, graininess is made better, image quality is improved and preservation property is also made better. The range of the fore-mentioned appropriate amount is 400 to 2500 ppm, and more preferably 500 to 2000 ppm. When the content of calcium is higher than the value, inorganic salts which calcium salt or gelatin or the like kept preliminarily are precipitated, and it is not preferable because it becomes the cause of trouble at manufacturing lightsensitive material. Herein, the content of calcium is represented by mass converted to calcium atom with respect to all of compounds containing calcium, and represented by a concentration per unit mass of the emulsion.

Now, other preferred embodiment of the silver halide emulsion of the present invention will be described below. The adjustment of calcium content in the silver halide tabular grain emulsion of the present invention is preferably carried out by adding calcium salt before chemical sensitization. Gelatin usually used at production of the emulsion contains already calcium by 100 to 4000 ppm in a form of solid gelatin, and it may be adjusted by further adding calcium salt. According to requirement, after carrying out desalting (removal of calcium) from gelatin according to known methods such as a washing method, an ion-exchange method or the like, the content can be also adjusted by calcium salt. As the calcium salt, calcium nitrate and calcium chloride are preferable, and calcium nitrate is most preferable. The quantitative method of calcium can be determined by ICP emission spectral analysis method. The addition of calcium salt can be carried out at an arbitrary timing of the production steps of silver halide emulsion, but it is preferable to add before the formation of the epitaxial protrusion portion. Further, it is more preferable to add additionally after desalting step.

Various compounds can be contained in the photographic emulsion used in the present invention in order to prevent fog in the step of manufacturing a lightsensitive material, during preservation, or during photographic processing, or to stabilize photographic performance. Namely, various compounds which were known as an antifoggant or a stabilizer, such as thiazoles (e.g., benzothiazolium salt); nitroimidazoles; nitrobenzimidazoles; chlorobenzimidazoles; bromobenzimidazoles; mercaptothiazoles; mercaptobenzothiazoles; mercaptobenzimidazoles; mercaptothisdiazoles; aminotriazoles; benzotriazoles; nitrobenzotriazoles; mercaptotetrazoles (particularly 1-phenyl-5-mercaptotetrazole); mercaptopyrimidines; mercaptotriazines; a thioketo compound such as oxadolinethione; azaindenes, for example, triazaindenes, tetrazaindenes (particularly hydroxy-substituted(1,3,3a,7)tetrazaindenes), and pentazaindenes can be added. For example, compounds described in U.S. Pat. Nos. 3,954,474 and 3,982,947, and JP-B-52-28660 can be used. Antifoggants and stabilizers can be added at any of several different timings such as before, during and after grain formation, during washing with water, during dispersion after washing, before, during and after chemical sensitization, and before coating, in accordance with the intended application. The antifoggants and stabilizers can be added during preparation of an emulsion to achieve their original fog preventing effect and stabilizing effect, and in addition, can be used for various purposes of controlling crystal habit, decreasing a grain size, decreasing the solubility of grains, controlling chemical sensitization, controlling the arrangement of dyes, and the like.

Among these, as a particularly useful compound, a mercaptotetrazole compound having a water-soluble group described in JP-A-4-16838 is mentioned. Further, the mercaptotetrazole compound can be used in combination with the compound represented by general formula (I).

It is advantageous to use gelatin as the protective colloid used for preparing the emulsion of the present invention, and as the binder of other hydrophilic colloid layer. However, hydrophilic colloids other than that can be also used. For example, a gelatin derivative, a graft polymer of gelatin with other polymer; proteins such as albumin, casein, and the like; cellulose derivatives such as hydroxyethyl cellulose, carboxymethyl cellulose, cellulose sulfates and the like; glucose derivatives such as sodium alginate, dextrin derivatives and the like; and many synthetic hydrophilic polymer substances such as homopolymers and copolymers such as a poly(vinyl alcohol), a partially-acetal of poly(vinyl alcohol), a poly(N-vinyl pyrrolidone), a poly(acrylic acid), a poly(methacrylic acid), a poly(acryl amide), a polyimidazole, a poly(vinyl pyrazole) and the like can be used.

As the gelatin, an acid-processed gelatin, and an enzyme-processed gelatin described in Bull. Soc. Sci. Photo. Japan, No. 16, P. 30 (1966) in addition to lime-processed gelatin may be used, and the hydrolyzed product and enzyme-decomposed product of gelatin can be also used.

It is preferable that the emulsion of the present invention is washed with water for desalting, and converted to a protective colloid dispersion solution using a newly prepared dispersion. The temperature of washing can be selected in accordance with purposes, and a range of 5° C. to 50° C. is preferably selected. The pH at washing can be selected in accordance with purposes, and a range of 2 to 10 is preferably selected. A range of 3 to 8 is more preferable. The pAg at washing can be selected in accordance with purposes, and a range of 5 to 10 is preferably selected. The method of washing can be used by selecting from a noodle washing method, a dialysis method using a semi-permeable membrane, a centrifugal separation method, a coagulation sedimentation method, and an ion-exchange method. The coagulation sedimentation method can be selected from a method of using a sulfate, a method of using an organic solvent, a method of using a water-soluble polymer, a method of using a gelatin derivative and the like.

The silver halide photographic emulsion of the present invention can be applied to an arbitrary silver halide photosensitive material, and it is preferable that the emulsion can be applied to a lightsensitive layer of the silver halide photosensitive material. In addition, it is preferable that the silver halide photosensitive material of the present invention is a silver halide color photosensitive material comprising at least one blue-sensitive emulsion layer containing yellow colored couplers, at least one green-sensitive emulsion layer containing magenta colored couplers and at least one red-sensitive emulsion layer containing cyan colored couplers. Further, it is more preferable that the silver halide photosensitive material of the present invention is a silver halide color reversal photosensitive material comprising at least one blue-sensitive emulsion layer containing yellow colored couplers, at least one green-sensitive emulsion layer containing magenta colored couplers and at least one red-sensitive emulsion layer containing cyan colored couplers.

The silver halide emulsion of the present invention can preferably be applied to the following silver halide color photosensitive material. Although the silver halide color photosensitive material of the present invention may comprise a support and, superimposed thereon, at least one blue-sensitive silver halide emulsion layer containing yellow colored couplers, at least one green-sensitive silver halide emulsion layer containing magenta colored couplers and at least one red-sensitive silver halide emulsion layer containing cyan colored couplers, it is preferable that each of these color-sensitive layer units comprises two or more of photosensitive emulsion layers having different speed. With respect to the layer arrangement of these color-sensitive emulsion layers or color-sensitive units, it is preferred that from the side close to the support, red-sensitive silver halide emulsion layer (or red-sensitive unit), green-sensitive silver halide emulsion layer (or green-sensitive unit) and blue-sensitive silver halide emulsion layer (or blue-sensitive unit) be provided in this order. In the case of color-sensitive units, it is preferable that each of the units has a three-layer unit arrangement including three lightsensitive emulsion layers which consist of a low-speed layer, a medium-speed layer and a high-speed layer. These are described in, for example, JP-B-49-15495 and JP-A-59-202464.

When the silver halide emulsion of the present invention is applied to a silver halide color photosensitive material having a color-sensitive unit in which two or more of photosensitive emulsion layers having different speed are combined, the aspect in which the emulsion of the present invention is contained in an emulsion layer having the lowest speed and not contained in the highest speed layer is preferable. Further, when the color-sensitive unit is three layer unit composition consisting of a low-speed layer, a medium-speed layer and a high-speede layer, the aspect in which the emulsion of the present invention is contained in the low-speed layer and medium-speed layer and not contained in the high-speed layer is preferable.

As one preferred embodiment of the present invention, there can be mentioned a lightsensitive material comprising a support and, superimposed thereon by coating in the given order, a subbing layer/an antihalation layer/a first interlayer/a red-sensitive emulsion layer unit (consisting of three layers, namely, a low-speed red-sensitive layer/a medium-speed red-sensitive layer/a high-speed red-sensitive layer arranged in this order from the side close to the support)/a second interlayer/a green-sensitive emulsion layer unit (consisting of three layers, namely, a low-speed green-sensitive layer/a medium-speed green-sensitive layer/a high-speed green-sensitive layer arranged in this order from the side close to the support)/a third interlayer/a yellow-filter layer/a blue-sensitive emulsion layer unit (consisting of two layers, namely, a low-speed blue-sensitive layer/a high-speed blue-sensitive layer, or consisting of three layers, namely, a low-speed blue-sensitive layer/a medium-speed blue-sensitive layer/a high-speed blue-sensitive layer arranged in this order from the side close to the support)/a first protective layer/a second protective layer/a third protective layer.

Each of the first, second and third interlayers may consist of a single layer or a plurality of layers. These interlayers may contain not only, for example, couplers and DIR compounds as described in JP-A's 61-43748, 59-113438, 59-113440, 61-20037 and 61-20038, but also customarily employed color mixing preventive agents.

Further, the protective layer is preferably the three layer composition of the first protective layer to the third protective layer. When the protective layer is 2 layers or 3 layers, the second protective layer contains preferably silver halide fine grains with an average equivalent-sphere diameter of 0.10 μm or less and the silver halide is preferably silver bromide or silver iodobromide.

The silver halide color photosensitive material to which the emulsion of the present invention is applied may have a photosensitive emulsion layer other than those mentioned here. In particular, it is preferable from the viewpoint of color reproducibility that duplicate layer effect is provided in a red sensitive emulsion layer in which a photosensitive emulsion layer spectrally sensitized at a cyan light zone is provided. The layer to which such duplicate layer effect is provided may be blue sensitive, green sensitive and red sensitive. Principal layers such as BL, GL and RL which are described in the respective specifications and publications of U.S. Pat. Nos. 4,663,271, 4,705,744 and 4,707,436, JP-A-62-160448 and JP-A-63-89850 and a donor layer having the duplicate layer effect with different spectral sensitivity distribution can be also arranged adjacently or closely.

The silver halide emulsion other than the silver halide emulsion of the present invention will now be described. The preferable silver halide contained in the photographic emulsion layer of the photosensitive material of the present invention is silver iodobromide, silver iodochloride, or silver bromochloroiodide containing about 30 mol % or less of silver iodide. A particularly preferable silver halide is silver iodobromide or silver bromochloroiodide containing about 1 mol % to about 10 mol % of silver iodide.

Silver halide grains contained in a photographic emulsion can have regular crystals such as cubic, octahedral, or tetradecahedral crystals, regular crystals such as spherical or tabular crystals, crystals having crystal defects such as twin planes, or composite shapes thereof. The grain diameter of silver halide may be fine grains having a grain size of about 0.2 μm or less, or large grains having a projected area diameter of about 10 μm, and the emulsion can be either a polydisperse or monodisperse.

The silver halide photographic emulsion which can be used in the present invention can be prepared by methods described in, for example, Research Disclosure (RD) No. 17643 (December 1978), pp. 22 and 23, "I. Emulsion preparation and types" RD No. 18716 (November 1979), p. 648, RD No. 30710 (November 1989), pp. 863–865, and P. Glafkides, "Chemie et Phisique Photographique", Paul Montel, (1967), G. F. Daffin, "Photographic Emulsion Chemistry" Focal Press, (1966), and V. L. Zelikman et al., "Making and Coating Photographic Emulsion", Focal Press, (1964). Monodisperse emulsions described in U.S. Pat. Nos. 3,574,628 and 3,655,394, and GB No. 1,413,748 are also preferable.

A crystal structure can be uniform, can have different halogen compositions in the interior and the surface layer thereof, or can be a layered structure. Alternatively, silver halide have different compositions can be bonded by epitaxial junction, or a compound except for a silver halide such as silver rhodanide or lead oxide can be bonded. Further, a mixture of grains having various types of crystal shapes can also be used.

The above-mentioned emulsion can be any of a surface latent image type emulsion which mainly forms a latent image on the surface of a grain, an internal latent image type emulsion which forms a latent image in the interior of the grain, and another type of emulsion which has latent images on the surface and in the interior of the grain. However, the emulsion must be a negative type emulsion. The internal latent image type emulsion can be a core/shell internal latent image type emulsion described in JP-A-63-264740. A method of preparing the core/shell internal latent image type emulsion is described in JP-A-59-133542. Although the thickness of a shell of the emulsion depends on development conditions and the like, it is preferably 3 to 40 nm and preferably 5 to 20 nm in particular.

It is also possible to preferably use surface fogged silver halide grains described in U.S. Pat. No. 4,082,553, internally fogged silver halide grains described in U.S. Pat. No. 4,626,498, and JP-A-59-214852, colloidal silver, in sensitive silver halide emulsion layer and/or essentially non-sensitive hydrophilic colloid layer.

The internally fogged or surface fogged silver halide grains means a silver halide grain which can be developed uniformly (non-imagewise) regardless of whether the location is a non-exposed portion or an exposed portion of the lightsensitive material. A method of preparing the internally fogged or surface fogged silver halide grains is described in U.S. Pat. No. 4,626,498 and JP-A-59-214852.

A silver halide which forms the core of an internally fogged core/shell type silver halide grain can have the same halogen composition or can have a different halogen composition. As the internally fogged or surface fogged silver halide, any of silver chloride, silver chlorobromide, silver bromoiodide, and silver bromochloroiodide can be used. The average grain size of these fogged silver halide grains is not specifically limited, but preferably 0.01 to 0.75 μm and preferably 0.05 to 6 μm in particular. Further, the grain shape is not specifically limited, and can be a regular grain shape. Further, although the emulsion can be a polydisperse emulsion, it is preferably a monodisperse emulsion (in which at least 95% in weight or number of grains of silver halide grains have grain sizes falling within the range of ±40% of the average grain size).

In a lightsensitive material of the present invention, it is possible to mix, in a single layer, two or more types of emulsions different in at least one of characteristics of a lightsensitive silver halide emulsion, for example, a grain size, grain size distribution, halogen composition, grain shape, and sensitivity. In the production process of the photosensitive material of the present invention, a photographic useful substance is usually added to a photographic coating liquid, namely, those added to a hydrophilic colloid liquid.

With respect to the silver halide photographic emulsion of the present invention, and various techniques and inorganic and organic materials which can be used for the silver halide photosensitive material using thereof, those described in "Research Disclosure" No. 308119 (1989) can be usually used.

In addition, techniques and inorganic and organic materials usable in color photographic light-sensitive materials to which silver halide photographic emulsions of the present invention can be applied are described in portions of EP436, 938A2 and patents cited below, the disclosures of which are herein incorporated by reference.

| Items | Corresponding portions |
|---|---|
| 1) Layer configurations | page 146, line 34 to page 147, line 25 |
| 2) Silver halide emulsions usable together | page 147, line 26 to page 148 line 12 |
| 3) Yellow couplers usable together | page 137, line 35 to page 146, line 33, and page 149, lines 21 to 23 |
| 4) Magenta couplers usable together | page 149, lines 24 to 28; EP421, 453A1, page 3, line 5 to page 25, line 55 |
| 5) Cyan couplers usable together | page 149, lines 29 to 33; EP432, 804A2, page 3, line 28 to page 40, line 2 |
| 6) Polymer couplers | page 149, lines 34 to 38; EP435, 334A2, page 113, line 39 to page 123, line 37 |
| 7) Colored couplers | page 53, line 42 to page 137, line 34, and page 149, lines 39 to 45 |
| 8) Functional couplers usable together | page 7, line 1 to page 53, line 41, and page 149, line 46 to page 150, line 3; EP435, 334A2, page 3, line 1 to page 29, line 50 |
| 9) Antiseptic and | page 150, lines 25 to 28 mildewproofing agents |
| 10) Formalin scavengers | page 149, lines 15 to 17 |
| 11) Other additives usable together | page 153, lines 38 to 47; EP421, 453A1, page 75, line 21 to page 84, line 56, and page 27, line 40 to page 37, line 40 |
| 12) Dispersion methods | page 150, lines 4 to 24 |
| 13) Supports | page 150, lines 32 to 34 |
| 14) Film thickness · film physical properties | page 150, lines 35 to 49 |
| 15) Color development step | page 150, line 50 to page 151, line 47 |
| 16) Desilvering step | page 151, line 48 to page 152, line 53 |
| 17) Automatic processor | page 152, line 54 to page 153, line 2 |
| 18) Washing · stabilizing | page 153, lines 3 to 37 |

When the emulsion of the present invention is applied to the silver halide color photosensitive material, as usable image forming couplers, there can be mentioned the following examples.

Yellow Couplers:

couplers represented by formulae (I) and (II) in EP No. 502,424A; couplers represented by formulae (1) and (2) in EP No. 513,496A (e.g., Y-28 on page 18); a coupler represented by formula (I) in claim 1 of EP No. 568,037A; a coupler represented by general formula (I) in column 1, lines 45 to 55, in U.S. Pat. No. 5,066,576; a coupler represented by general formula (I) in paragraph 0008 of JP-A-4-274425; couplers described in claim 1 on page 40 in EP No. 498, 381A1 (e.g., D-35); couplers represented by formula (Y) on page 4 in EP No. 447,969A1 (e.g., Y-1 and Y-54); couplers represented by formulae (II) to (IV) in column 7, lines 36 to 58, in U.S. Pat. No. 4,476,219; a coupler represented by general formula (I) in JP-A-2002-318442; couplers represented by general formulae (I) to (IV) in JP-A-2003-50449; a coupler represented by formula (I) in EP No. 1,246,006A2; etc.

Magenta Couplers:

couplers listed in JP-A-3-39737 (e.g., L-57, L-68 and L-77); couplers listed in EP No. 456,257A (e.g., A-4-63, A-4-73 and A-4-75); couplers listed in EP No. 486,965A (e.g., M-4, M-6 and M-7); couplers listed in EP No. 571, 959A (e.g., M-45); couplers listed in JP-A-5-204106 (e.g, M-1); couplers listed in JP-A-4-362631 (e.g., M-22); couplers represented by general formula (MC-1) in JP-A-11-119393 (e.g., CA-4, CA-7, CA-12, CA-15, CA-16 and CA-18); couplers represented by formulae (M-I) and (M-II) in U.S. Pat. No. 6,492,100B2; a coupler represented by formula (I) in U.S. Pat. No. 6,468,729B2; etc.

Cyan Couplers:

couplers listed in JP-A-4-204843 (e.g., CX-1, 3, 4, 5, 11, 12, 14 and 15); couplers listed in JP-A-4-43345 (e.g., C-7, 10, 34, 35, (I-1) and (I-17)); couplers represented by general formulae (Ia) and (Ib) in claim 1 of JP-A-6-67385; couplers represented by general formula (PC-1) in JP-A-11-119393 (e.g., CB-1, CB-4, CB-5, CB-9, CB-34, CB-44, CB-49 and CB-51); couplers represented by general formula (NC-1) in JP-A-11-119393 (e.g., CC-1 and CC-17); a coupler represented general formula (I) in JP-A-2002-162717; etc.

The silver halide color photosensitive material to which the silver halide photographic emulsion of the present invention can be applied is effective for a film with lens as described in, e.g., JP-B-2-32615 and Jpn. Utility Model Appln. KOKOKU Publication No. 3-39784.

A transparent magnetic recording layer can be used in the silver halide photosensitive material to which the silver halide photographic emulsion of the present invention can be applied. The transparent magnetic recording layer usable in the present invention is formed by coating the surface of a support with an aqueous or organic solvent-based coating solution which is prepared by dispersing magnetic grains in a binder. As the magnetic grains used in the present invention, it is possible to use, e.g., ferromagnetic iron oxide such as $\gamma Fe_2O_3$, Co-deposited $\gamma Fe_2O_3$, Co-deposited magnetite, Co-containing magnetite, ferromagnetic chromium dioxide, a ferromagnetic metal, a ferromagnetic alloy, Ba ferrite of a hexagonal system, Sr ferrite, Pb ferrite, and Ca ferrite. Co-deposited ferromagnetic iron oxide such as Co-deposited $\gamma Fe_2O_3$ is preferred. The grain can take the shape of any of, e.g., a needle, rice grain, sphere, cube, and plate. The specific area is preferably 20 $m^2/g$ or more, and more preferably, 30 $m^2/g$ or more as $S_{BET}$. The saturation magnetization ($\sigma s$) of the ferromagnetic substance is preferably $3.0\times10^4$ to $3.0\times10^5$ A/m, and most preferably, $4.0\times10^4$ to $2.5\times10^5$ A/m. A surface treatment can be performed for the ferromagnetic grains by using silica and/or alumina or an organic material. Also, the surface of the ferromagnetic grain can be treated with a silane coupling agent or a titanium coupling agent as described in JP-A-6-161032, the disclosure of which is incorporated herein by reference. A ferromagnetic grain whose surface is coated with an inorganic or organic substance described in JP-A-4-259911 or JP-A-5-81652, the disclosures of which are incorporated herein by reference, can also be used.

As a binder used in the magnetic grains, it is possible to use a thermoplastic resin, thermosetting resin, radiation-curing resin, reactive resin, acidic, alkaline, or biodegradable polymer, natural polymer (e.g., a cellulose derivative and sugar derivative), and their mixtures. These examples are described in JP-A-4-219569, the disclosure of which is incorporated herein by reference. The Tg of the resin is preferably −40° C. to 300° C., and its weight average molecular weight is preferably 2,000 to 1,000,000. Examples are a vinyl-based copolymer, cellulose derivatives such as cellulosediacetate, cellulosetriacetate, celluloseacetatepropionate, celluloseacetatebutylate, and cellulosetripropionate, acrylic resin, and polyvinylacetal resin. Gelatin is also preferred. Cellulosedi(tri)acetate is particularly preferred. This binder can be hardened by the addition of an epoxy-, aziridine-, or isocyanate-based crosslinking agent. Examples of the isocyanate-based crosslinking agent are isocyanates such as tolylenediisocyanate, 4,4'-diphenylmethanediisocyanate, hexamethylenediisocyanate, and xylylenediisocyanate, reaction products of these isocyanates and polyalcohol (e.g., a reaction product of 3 mols of tolylenediisocyanate and 1 mol of trimethylolpropane), and polyisocyanate produced by condensation of any of these isocyanates. These examples are described in JP-A-6-59357, the disclosure of which is incorporated herein by reference.

As a method of dispersing the magnetic substance in the binder, as described in JP-A-6-35092, the disclosure of which is incorporated herein by reference, a kneader, pin type mill, and annular mill are preferably used singly or together. Dispersants described in JP-A-5-088283, the disclosure of which is incorporated herein by reference, and other known dispersants can be used. The thickness of the magnetic recording layer is preferably 0.1 to 10 μm, more preferably 0.2 to 5 μm, and further more preferably, 0.3 to 3 μm. The mass ratio of the magnetic grains to the binder is preferably 0.5:100 to 60:100, and more preferably, 1:100 to 30:100. The coating amount of the magnetic grains is preferably 0.005 to 3 $g/m^2$, more preferably 0.01 to 2 $g/m^2$, and further more preferably, 0.02 to 0.5 $g/m^2$. The magnetic recording layer used in the present invention can be formed in the whole area of, or into the shape of stripes on, the back surface of a photographic support by coating or printing. As a method of coating the magnetic recording layer, it is possible to use any of an air doctor, blade, air knife, squeegee, impregnation, reverse roll, transfer roll, gravure, kiss, cast, spray, dip, bar, and extrusion. A coating solution described in JP-A-5-341436, the disclosure of which is incorporated herein by reference is preferred.

The magnetic recording layer can be given a lubricating property improving function, curling adjusting function, antistatic function, adhesion preventing function, and head polishing function. Alternatively, another functional layer can be formed and these functions can be given to that layer. A polishing agent in which at least one type of grains are aspherical inorganic grains having a Mohs hardness of 5 or more is preferred. The composition of this aspherical inorganic grain is preferably an oxide such as aluminum oxide, chromium oxide, silicon dioxide, titanium dioxide, and silicon carbide, a carbide such as silicon carbide and titanium carbide, or a fine powder of diamond. The surfaces of the grains constituting these polishing agents can be treated with a silane coupling agent or titanium coupling agent. These grains can be added to the magnetic recording layer or overcoated (as, e.g., a protective layer or lubricant layer) on the magnetic recording layer. A binder used together with the grains can be any of those described above and is preferably the same binder as in the magnetic recording layer. Light-sensitive materials having the magnetic recording layer are described in U.S. Pat. Nos. 5,336,589, US 5,250,404, US 5,229,259, US 5,215,874, and EP 466,130, the disclosures of which are incorporated herein by reference.

A polyester support used in the silver halide color photosensitive material to which the silver halide photographic emulsion of the present invention will now be described below. Details of the polyester support and light-sensitive materials, processing, cartridges, and examples (to be described later) are described in Journal of Technical Disclosure No. 94-6023 (JIII; 1994, March 15), the disclosure of which is incorporated herein by reference. Polyester used in the present invention is formed by using diol and aromatic dicarboxylic acid as essential components. Examples of the aromatic dicarboxylic acid are 2,6-, 1,5-, 1,4-, and 2,7-naphthalenedicarboxylic acids, terephthalic acid, isophthalic acid, and phthalic acid. Examples of the diol are diethyleneglycol, triethyleneglycol, cyclohexanedimethanol, bisphenol A, and bisphenol. Examples of the polymer are homopolymers such as polyethyleneterephthalate, polyethylenenaphthalate, and polycyclohexanedimethanolterephthalate. Polyester containing 50 to 100 mol % of 2,6-naphthalenedicarboxylic acid is particularly preferred. Polyethylene-2,6-naphthalate is most preferred among other polymers. The average molecular weight ranges between about 5,000 and 200,000. The Tg of the polyester of the present invention is 50° C. or higher, preferably 90° C. or higher.

To give the polyester support a resistance to curling, the polyester support is heat-treated at a temperature of preferably 40° C. to less than Tg, and more preferably, Tg−20° C. to less than Tg. The heat treatment can be performed at a fixed temperature within this range or can be performed together with cooling. The heat treatment time is preferably 0.1 to 1500 hr, and more preferably, 0.5 to 200 hr. The heat treatment can be performed for a roll-like support or while a support is conveyed in the form of a web. The surface shape can also be improved by roughening the surface (e.g., coating the surface with conductive inorganic fine grains such as $SnO_2$ or $Sb_2O_5$). It is desirable to knurl and slightly raise the end portion, thereby preventing the cut portion of the core from being photographed. These heat treatments can be performed in any stage after support film formation, after surface treatment, after back layer coating (e.g., an antistatic agent or lubricating agent), and after undercoating. A favorable timing is after the antistatic agent is coated. An ultraviolet absorbent can be incorporated into this polyester. Also, to prevent light piping, dyes or pigments such as Diaresin manufactured by Mitsubishi Kasei Corp. or Kayaset manufactured by NIPPON KAYAKU CO. LTD. commercially available for polyester can be incorporated.

In the present invention, it is preferable to perform a surface treatment in order to adhere the support and the light-sensitive material constituting layers. Examples of the surface treatment are surface activation treatments such as a chemical treatment, mechanical treatment, corona discharge treatment, flame treatment, ultraviolet treatment, high-frequency treatment, glow discharge treatment, active plasma treatment, laser treatment, mixed acid treatment, and ozone oxidation treatment. Among other surface treatments, the ultraviolet radiation treatment, flame treatment, corona treatment, and glow treatment are preferred.

An undercoat layer can include a single layer or two or more layers. Examples of an undercoat layer binder are copolymers formed by using, as a starting material, a monomer selected from vinyl chloride, vinylidene chloride, butadiene, methacrylic acid, acrylic acid, itaconic acid, and maleic anhydride. Other examples are polyethyleneimine, an epoxy resin, grafted gelatin, nitrocellulose, and gelatin. Resorcin and p-chlorophenol are examples of a compound which swells a support. Examples of a gelatin hardener added to the undercoat layer are chromium salt (e.g., chromium alum), aldehydes (e.g., formaldehyde and glutaraldehyde), isocyanates, an active halogen compound (e.g., 2,4-dichloro-6-hydroxy-s-triazine), an epichlorohydrin resin, and an active vinylsulfone compound. $SiO_2$, $TiO_2$, inorganic fine grains, or polymethylmethacrylate copolymer fine grains (0.01 to 10 μm) can also be contained as a matting agent.

In the present invention, an antistatic agent is preferably used. Examples of this antistatic agent are carboxylic acid, carboxylate, a macromolecule containing sulfonate, cationic macromolecule, and ionic surfactant compound. As the antistatic agent, it is most preferable to use fine grains of at least one crystalline metal oxide selected from ZnO, $TiO_2$, $SnO_2$, $Al_2O_3$, $In_2O_3$, $SiO_2$, MgO, BaO, $MoO_3$, and $V_2O_5$, and having a volume resistivity of preferably $10^7$ Ω·cm or less, and more preferably, $10^5$ Ω·cm or less and a grain size of 0.001 to 1.0 μm, fine grains of composite oxides (e.g., Sb, P, B, In, S, Si, and C) of these metal oxides, fine grains of sol metal oxides, or fine grains of composite oxides of these sol metal oxides. The content in a light-sensitive material is preferably 5 to 500 mg/$m^2$, and particularly preferably, 10 to 350 mg/$m^2$. The ratio of a conductive crystalline oxide or its composite oxide to the binder is preferably 1/300 to 100/1, and more preferably, 1/100 to 100/5.

A light-sensitive material of the present invention preferably has a slip property. Slip agent-containing layers are preferably formed on the surfaces of both a light-sensitive layer and back layer. A preferable slip property is 0.01 to 0.25 as a coefficient of kinetic friction. This represents a value obtained when a stainless steel sphere 5 mm in diameter is conveyed at a speed of 60 cm/min (25° C. 60% RH). In this evaluation, a value of nearly the same level is obtained when the surface of a light-sensitive layer is used as a sample to be measured.

Examples of a slip agent usable in the present invention are polyorganocyloxane, higher fatty acid amide, higher fatty acid metal salt, and ester of higher fatty acid and higher alcohol. As the polyorganocyloxane, it is possible to use, e.g., polydimethylcyloxane, polydiethylcyloxane, polystyrylmethylcyloxane, or polymethylphenylcyloxane. A layer to which the slip agent is added is preferably the outermost emulsion layer or back layer. Polydimethylcyloxane or ester having a long-chain alkyl group is particularly preferred.

A light-sensitive material of the present invention preferably contains a matting agent. This matting agent can be added to either the emulsion surface or back surface and is most preferably added to the outermost emulsion layer. The matting agent can be either soluble or insoluble in processing solutions, and the use of both types of matting agents is preferred. Favorable examples are polymethylmethacrylate grains, poly(methylmethacrylate/methacrylic acid=9/1 or 5/5 (molar ratio)) grains, and polystyrene grains. The grain size is preferably 0.8 to 10 μm, and a narrow grain size distribution is favored. It is preferable that 90% or more of all grains have grain sizes 0.9 to 1.1 times the average grain size. To increase the matting property, it is preferable to simultaneously add fine grains with a grain size of 0.8 μm or smaller. Examples are polymethylmethacrylate grains (0.2 μm), poly(methylmethacrylate/methacrylic acid=9/1 (molar ratio, 0.3 μm) grains, polystyrene grains (0.25 μm), and colloidal silica grains (0.03 μm).

A film cartridge used in the present invention will be described below. The principal material of the cartridge used in the present invention can be a metal or synthetic plastic.

Preferable plastic materials are polystyrene, polyethylene, polypropylene, and polyphenylether. The cartridge of the present invention can also contain various antistatic agents. For this purpose, carbon black, metal oxide grains, nonion-, anion-, cation-, and betaine-based surfactants, or a polymer can be preferably used. These cartridges subjected to the antistatic treatment are described in JP-A-1-312537 and JP-A-1-312538, the disclosures of which are incorporated herein by reference. It is particularly preferable that the resistance be $10^{12}$Ω or less at 25° C. and 25% RH. Commonly, plastic cartridges are manufactured by using plastic into which carbon black or a pigment is incorporated in order to give a light-shielding property. The cartridge size can be a presently available 135 size. To miniaturize cameras, it is effective to decrease the diameter of a 25-mm cartridge of 135 size to 22 mm or less. The volume of a cartridge case is 30 $cm^3$ or less, preferably 25 $cm^3$ or less. The weight of plastic used in the cartridge and the cartridge case is preferably 5 to 15 g.

Furthermore, a cartridge which feeds a film by rotating a spool can be used in the present invention. It is also possible to use a structure in which a film leader is housed in a cartridge main body and fed through a port of the cartridge to the outside by rotating a spool shaft in the film feed direction. These structures are disclosed in U.S. Pat. Nos. 4,834,306 and US 5,226,613, the disclosures of which are incorporated herein by reference. Photographic films used in the present invention can be so-called raw films before being developed or developed photographic films. Also, raw and developed photographic films can be accommodated in the same new cartridge or in different cartridges.

The photosensitive material of the present invention can adopt any arrangement without limiting the layer number and layer order of the silver halide emulsion layer and non photosensitive layer. The color-sensitive emulsion layer unit of the photosensitive material of the present invention consists preferably of 2 layers or more of separate layers with different sensitivity and consists preferably of 3 layers or more of separate layers in particular. When the total silver amount of the color-sensitive layer whose unit consists of 3 layers or more of separate layers is 100%, it is preferable that the high sensitive layer is 15 to 45%, the middle sensitive layer is 20 to 50% and the low sensitive layer is 20 to 50%. It is preferable that the silver amount coated of the high sensitive layer is less than the silver amount coated of the middle and low sensitive layers. When the color-sensitive emulsion layer unit consists of a plural number of separate layers with different sensitivity, it is desirable that the content rate of silver iodide is heightened for the separate layers with lower sensitivity. When the color-sensitive emulsion layer unit consists of 3 separate layers, it is preferable in particular that the content rate of silver iodide in the photosensitive separate layer with highest sensitivity is lower by 1.0 mol % to 5 mol % than the content rate of silver iodide in the photosensitive separate layer with the lowest sensitivity.

Non photosensitive layers such as various intermediary layers may be provided at the middle layer, upper layer and lower layer of the color-sensitive emulsion layer unit. The non photosensitive layer contains couplers and DIR compounds described, for example, in the specifications of JP-A-61-43748, JP-A-59-113438, JP-A-59-113440, JP-A-61-20037, JP-A-61-20038 and U.S. Pat. No. 5,378,590, and may contain a color mix preventive as usually used. As described above, various layer compositions and arrangements can be selected in accordance with the purposes of respective photosensitive materials.

The silver coating amount of a light-sensitive material of the present invention is preferably 6.0 g/m$^2$ or less, preferably 5.0 g/m$^2$ or less, and most preferably 4.5 g/m$^2$ or less.

Examples of the present invention will be described below. However, the present invention is not limited to these examples.

EXAMPLE 1

<Preparation of Comparative Emulsion Em-104>

Emulsion Em-104 was prepared by carrying out the following step operation.

(1) Step of Forming Host Grains (1-1) Step of Forming Nuclei 1000 mL of an aqueous solution containing 0.8 g of potassium bromide and 3 g of low molecular weight oxidation treated gelatin with an average molecular weight of 10000 to 20000 was kept at 35° C. and stirred. 30 mL of an aqueous solution containing 3 g of silver nitrate, 40 mL of an aqueous solution containing 2.2 g of potassium bromide and 50 mL of an aqueous solution containing 1.1 g of low molecular weight oxidation treated gelatin with an average molecular weight of 10000 to 20000 were simultaneously added for 45 seconds by a triple jet method.

(1-2) Ripening Step

A potassium bromide aqueous solution was added thereto and silver potential was set at −30 mV and then temperature was raised to 68° C. Then, 26 g of succinated gelatin was added.

(1-3) First Growth Step 650 mL of an aqueous solution containing 108 g of silver nitrate and 650 mL of an aqueous solution containing 74 g of potassium bromide and 3.2 g of potassium iodide were added for 51 minutes by a double jet method. At this time, silver potential was kept at 0 mV against a saturated calomel electrode. After completion of the addition, potassium bromide was added to set the silver potential at −35 mV and the temperature of a reaction container was lowered to 40° C.

(1-4) Second Growth Step 130 mL of an aqueous solution containing 20 g of silver nitrate and 130 mL of an aqueous solution containing 11.7 g of potassium bromide and 4.1 g of potassium iodide were added for 18 minutes by a double jet method at a constant flow rate. At this time, silver potential was kept at 15 mV against a saturated calomel electrode.

(2) Epitaxial Deposition Step

The following step operation was carried out in succession to the step of forming host grains to carry out epitaxial deposition.

15 G of alkali treated gelatin was added, 0.4 g of potassium iodide was added and 0.2 mol of calcium ion was added. Then, spectral sensitization dyes S-1 and S-2 and a spectral sensitization dye S-13 which was described in JP-A-2003-15245 was added at a molar ratio of 37:56:7 and a ratio of 96% of a saturated coating amount. Then, $4.0\times10^{-5}$ mol of potassium hexacyanoruthenate (II) was added based on 1 mole of the silver amount of host grains.

Then, a silver nitrate aqueous solution and a sodium bromide aqueous solution were added at a constant flow rate for 10 minutes by a double jet process to carry out epitaxial deposition. At this time, silver potential was kept at +100 mV against a saturated calomel electrode. The silver amount used for the epitaxial deposition was an amount of 5% against the host grains.

(3) Desalting and Dispersion Step

Desalting was carried out by a known flocculation method at 35° C., gelatin was added and pH and pAg were respectively adjusted at 5.9 and 8.2 at 50° C.

(4) Chemical Sensitization Step

After $5\times10^{-5}$ mol of a fog preventive F-6 was added, emulsion was kept at 50° C. and chloroauric acid, sodium thiosulfate and N,N-dimethylseleno urea were added to carry out chemical sensitization. $5\times10^{-4}$ Mol of a fog preventive F-1 was added to terminate the chemical sensitization and the mixture was stored in a refrigerator.

The emulsion Em-104 obtained was emulsion in which tabular grains having an average equivalent-sphere diameter of 0.71 μm, the variation coefficient of an equivalent-circular diameter of 25%, an average thickness of 0.084 μm and an average aspect ratio of 8.5 in which a (111) plane is a principal plane are the host grains, and silver halide grains in which the protrusion portions were mainly formed on the apexes of the host tabular grains occupied 90% of the total projected area. Further, 12% was a proportion in which the silver halide grains which were composed of the host tabular grains having an aspect ratio of 12 or more and the protrusion portions occupy the total projected area. The emulsion was silver iodobromide emulsion in which average silver iodide content rate of 8% (based on the silver amount of host grains) of the outer shell of the host grains was 20 mol % and the average silver iodide content rate of all grains was 5.5 mol %. The halogen composition of the protrusion portions was the content rate of silver iodide: the content rate of silver bromide: the content rate of silver chloride=2.6:97.4:0 (molar ratio).

<Preparation of Comparative Emulsion Em-105>

Em-105 was prepared in like manner as Em-104 except that (1-3) First growth step was changed to the following step operation. The first growth step of Em-105 is as described below.

(1-3) First Growth Step 650 mL of an aqueous solution containing 108 g of silver nitrate and 650 mL of an aqueous solution containing 74 g of potassium bromide and 3.2 g of potassium iodide were added for 51 minutes by a double jet method. At this time, silver potential was kept at −25 mV against a saturated calomel electrode. After completion of the addition, potassium bromide was added to set the silver potential at −35 mV and the temperature of a reaction container was lowered to 40° C.

The emulsion Em-105 obtained was emulsion in which tabular grains having an average equivalent-circular diameter of 0.81 μm, the variation coefficient of an equivalent-circular diameter of 27%, an average thickness of 0.065 μm and an average aspect ratio of 12.4 in which a (111) plane is a principal plane are the host grains, and silver halide grains in which the protrusion portions were mainly formed on the apexes of the host tabular grains occupied 91% of the total projected area. Further, 77% was a proportion in which the silver halide grains which were composed of the host tabular grains having an aspect ratio of 12 or more and the protrusion portions occupy the total projected area. The emulsion was silver iodobromide emulsion in which average silver iodide content rate of 8%, based on the silver amount of the host grain, of the outer shell of the host grain was 20 mol % and the average silver iodide content rate of all grains was 5.5 mol %. The halogen composition of the protrusion portions was the content rate of silver iodide: the content rate of silver bromide: the content rate of silver chloride=2.5: 97.5:0 (molar ratio).

<Preparation of Comparative Emulsion Em-106>

Em-106 was prepared in like manner as Em-104 except that (1-3) First growth step was changed to the following step operation. The first growth step of Em-106 is as described below.

(1-3) First Growth Step

Ultra fine grain emulsion was prepared by an external stirring device described in JP-A-10-43570, using 650 mL of an aqueous solution containing 108 g of silver nitrate and 650 mL of an aqueous solution containing 74 g of potassium bromide, 3.2 g of potassium iodide and 100 g of low molecular weight oxidation treated gelatin with an average molecular weight of 20000, the ultra fine grain emulsion was continuously added in a reaction container to dissolve the ultra fine grains and host grains were grown for 51 minutes. At this time, silver potential was kept at 0 mV against a saturated calomel electrode by separately adding a potassium bromide aqueous solution. After completion of the addition, potassium bromide was added to set the silver potential at −35 mV and the temperature of the reaction container was lowered to 40° C.

The emulsion Em-106 obtained was emulsion in which tabular grains having an average equivalent-circular diameter of 0.92 μm, the variation coefficient of an equivalent-circular diameter of 26%, an average thickness of 0.051 μm and an average aspect ratio of 18 in which a (111) plane is a principal plane are the host grains, and silver halide grains in which the protrusion portions were mainly formed on the apexes of the host tabular grains occupied 93% of the total projected area. Further, 91% was a proportion in which the silver halide grains which were composed of the host tabular grains having an aspect ratio of 12 or more and the protrusion portions occupy the total projected area. The emulsion was silver iodobromide emulsion in which average silver iodide content rate of 8%, based on the silver amount of the host grain, of the outer shell of the host grain was 20 mol % and the average silver iodide content rate of all grains was 5.5 mol %. The halogen composition of the protrusion portions was the content rate of silver iodide: the content rate of silver bromide: the content rate of silver chloride=2.4: 97.6:0 (molar ratio).

<Preparation of Comparative Emulsion Em-107>

Em-107 was prepared in like manner as Em-104 except that (1-4) Second growth step was changed to the following step operation. The second growth step of Em-107 is as described below.

(1-4) Second Growth Step 130 mL of an aqueous solution containing 20 g of silver nitrate and 130 mL of an aqueous solution containing 13.1 g of potassium bromide and 2.1 g of potassium iodide were added for 18 minutes by a double jet method at a constant flow rate. At this time, silver potential was kept at 15 mV against a saturated calomel electrode.

The emulsion Em-107 obtained was emulsion in which tabular grains having an average equivalent-circular diameter of 0.71 μm, the variation coefficient of an equivalent-circular diameter of 25%, an average thickness of 0.084 μm and an average aspect ratio of 8.7 in which a (111) plane is a principal plane are the host grains, and silver halide grains in which the protrusion portions were mainly formed on the apexes of the host tabular grains occupied 91% of the total projected area. Further, 10% was a proportion in which the silver halide grains which were composed of the host tabular grains having an aspect ratio of 12 or more and the protrusion portions occupy the total projected area. The emulsion was silver iodobromide emulsion in which average silver iodide content rate of 8%, based on the silver amount of the host grain, of the outer shell of the host grain was 10.3 mol % and the average silver iodide content rate of all grains was 4.0 mol %. The halogen composition of the protrusion portions was the content rate of silver iodide: the content rate of silver bromide: the content rate of silver chloride=2.2: 97.8:0 (molar ratio).

<Preparation of Comparative Emulsion Em-108>

Em-108 was prepared in like manner as Em-105 except that (1-4) Second growth step was changed to the following step operation. The second growth step of Em-108 is as described below.

(1-4) Second Growth Step 130 mL of an aqueous solution containing 20 g of silver nitrate and 130 mL of an aqueous solution containing 13.1 g of potassium bromide and 2.1 g of potassium iodide were added for 18 minutes by a double jet method at a constant flow rate. At this time, silver potential was kept at 15 mV against a saturated calomel electrode.

The emulsion Em-108 obtained was emulsion in which tabular grains having an average equivalent-circular diameter of 0.81 μm, the variation coefficient of an equivalent-circular diameter of 27%, an average thickness of 0.065 μm and an average aspect ratio of 12.4 in which a (111) plane is a principal plane are the host grains, and silver halide grains in which the protrusion portions were mainly formed on the apexes of the host tabular grains occupied 90% of the total projected area. Further, 79% was a proportion in which the silver halide grains which were composed of the host tabular grains having an aspect ratio of 12 or more and the protrusion portions occupy the total projected area. The emulsion was silver iodobromide emulsion in which average silver iodide content rate of 8%, based on the silver amount of the host grain, of the outer shell of the host grain was 10.3 mol % and the average silver iodide content rate of all grains was 4.0 mol %. The halogen composition of the protrusion portions was the content rate of silver iodide: the content rate of silver bromide: the content rate of silver chloride=2.2: 97.8:0 (molar ratio).

<Preparation of Comparative Emulsion Em-109>

Em-109 was prepared in like manner as Em-106 except that (1-4) Second growth step was changed to the following step operation. The second growth step of Em-109 is as described below.

(1-4) Second Growth Step 130 mL of an aqueous solution containing 20 g of silver nitrate and 130 mL of an aqueous solution containing 13.1 g of potassium bromide and 2.1 g of potassium iodide were added for 18 minutes by a double jet method at a constant flow rate. At this time, silver potential was kept at 15 mV against a saturated calomel electrode.

The emulsion Em-109 obtained was emulsion in which tabular grains having an average equivalent-circular diameter of 0.92 μm, the variation coefficient of an equivalent-circular diameter of 26%, an average thickness of 0.051 μm and an average aspect ratio of 18.1 in which a (111) plane is a principal plane are the host grains, and silver halide grains in which the protrusion portions were mainly formed on the apexes of the host tabular grains occupied 93% of the total projected area. Further, 91% was a proportion in which the silver halide grains which were composed of the host tabular grains having an aspect ratio of 12 or more and the protrusion portions occupy the total projected area. The emulsion was silver iodobromide emulsion in which average silver iodide content rate of 8%, based on the silver amount of the host grain, of the outer shell of the host grain was 10.3 mol % and the average silver iodide content rate of all grains was 4.0 mol %. The halogen composition of the protrusion portions was the content rate of silver iodide: the content rate of silver bromide: the content rate of silver chloride=2.3: 97.7:0 (molar ratio).

<Preparation of Comparative Emulsion Em-110>

Em-110 was prepared in like manner as Em-104 except that (1-4) Second growth step was changed to the following step operation. The second growth step of Em-110 is as described below.

(1-4) Second Growth Step 130 mL of an aqueous solution containing 20 g of silver nitrate and 130 mL of an aqueous solution containing 13.6 g of potassium bromide and 1.4 g of potassium iodide were added for 18 minutes by a double jet method at a constant flow rate. At this time, silver potential was kept at 15 mV against a saturated calomel electrode.

The emulsion Em-110 obtained was emulsion in which tabular grains having an average equivalent-circular diameter of 0.73 μm, the variation coefficient of an equivalent-circular diameter of 25%, an average thickness of 0.081 μm and an average aspect ratio of 9 in which a (111) plane is a principal plane are the host grains, and silver halide grains in which the protrusion portions were mainly formed on the apexes of the host tabular grains occupied 91% of the total projected area. Further, 11% was a proportion in which the silver halide grains which were composed of the host tabular grains having an aspect ratio of 12 or more and the protrusion portions occupy the total projected area. The emulsion was silver iodobromide emulsion in which average silver iodide content rate of 8%, based on the silver amount of the host grain, of the outer shell of the host grain was 7 mol % and the average silver iodide content rate of all grains was 3.4 mol %. The halogen composition of the protrusion portions was the content rate of silver iodide: the content rate of silver bromide: the content rate of silver chloride=2.0: 98.0:0 (molar ratio).

<Preparation of Comparative Emulsion Em-111>

Em-111 was prepared in like manner as Em-105 except that (1-4) Second growth step was changed to the following step operation. The second growth step of Em-111 is as described below.

(1-4) Second Growth Step 130 mL of an aqueous solution containing 20 g of silver nitrate and 130 mL of an aqueous solution containing 13.6 g of potassium bromide and 1.4 g of potassium iodide were added for 18 minutes by a double jet method at a constant flow rate. At this time, silver potential was kept at 15 mV against a saturated calomel electrode.

The emulsion Em-108 obtained was emulsion in which tabular grains having an average equivalent-circular diameter of 0.81 μm, the variation coefficient of an equivalent-circular diameter of 27%, an average thickness of 0.065 μm and an average aspect ratio of 12.3 in which a (111) plane is a principal plane are the host grains, and silver halide grains in which the protrusion portions were mainly formed on the apexes of the host tabular grains occupied 92% of the total projected area. Further, 75% was a proportion in which the silver halide grains which were composed of the host tabular grains having an aspect ratio of 12 or more and the protrusion portions occupy the total projected area. The emulsion was silver iodobromide emulsion in which average silver iodide content rate of 8%, based on the silver amount of the host grain, of the outer shell of the host grain was 7 mol % and the average silver iodide content rate of all grains was 3.4 mol %. The halogen composition of the protrusion portions was the content rate of silver iodide: the content rate of silver bromide: the content rate of silver chloride=2.1: 97.9:0 (molar ratio).

<Preparation of Comparative Emulsion Em-112>

Em-112 was prepared in like manner as Em-106 except that (1-4) Second growth step was changed to the following step operation. The second growth step of Em-112 is as described below.

(1-4) Second Growth Step 130 mL of an aqueous solution containing 20 g of silver nitrate and 130 mL of an aqueous solution containing 13.6 g of potassium bromide and 1.4 g of potassium iodide were added for 18 minutes by a double jet method at a constant flow rate. At this time, silver potential was kept at 15 mV against a saturated calomel electrode.

The emulsion Em-112 obtained was emulsion in which tabular grains having an average equivalent-circular diameter of 0.92 μm, the variation coefficient of an equivalent-circular diameter of 26%, an average thickness of 0.051 μm and an average aspect ratio of 17.9 in which a (111) plane is a principal plane are the host grains, and silver halide grains in which the protrusion portions were mainly formed on the apexes of the host tabular grains occupied 93% of the total projected area. Further, 90% was a proportion in which the silver halide grains which were composed of the host tabular grains having an aspect ratio of 12 or more and the protrusion portions occupy the total projected area. The emulsion was silver iodobromide emulsion in which average silver iodide content rate of 8%, based on the silver amount of the host grain, of the outer shell of the host grain was 7 mol % and the average silver iodide content rate of all grains was 3.4 mol %. The halogen composition of the protrusion portions was the content rate of silver iodide: the content rate of silver bromide: the content rate of silver chloride=2.2: 97.8:0 (molar ratio).

<Preparation of Comparative Emulsions Em-113 to 119 and the Present Invention Emulsions Em-120 to 121>

Each of emulsions Em-113 to 121 was prepared by adding the following step operation at (2) Step of depositing epitaxial in the respective preparation steps of Em-104 to 112 and not changing preparation steps other than the step operation. Provided that the step operation added in the epitaxial deposition step is as described below. Namely, $2.1\times10^{-3}$ mol of potassium thiocyanate was added based on 1 mole of the silver amount of host grains at a stage before the addition of a silver nitrate aqueous solution and a sodium bromide aqueous solution which were provided for formation of epitaxial protrusion portions was started, after the addition of potassium hexacyanoruthenate (II).

With respect to the emulsions Em-113 to 121 obtained, the average equivalent-circular diameter of respective host grains, the variation coefficient of an equivalent-circular diameter, an average thickness, an average aspect ratio, a proportion in which the silver halide grains which the protrusion portions were mainly formed on the apexes of host grains occupy against the total projected area, an average silver iodide content rate of 8% (against the silver amount of host grains) of the outer shell of the host grains, the average silver iodide content rate of all grains and the halogen composition of the protrusion portions were respectively the same values as Em-104 to 112. Namely, these values were not changed by adding the step operation of adding potassium thiocyanate, at the epitaxial precipitation step.

Further, Em-113 thus obtained is the same emulsion as Em-G2 which was described in Example 9 of JP-A-2003-15245. Further, Em-115 is the same emulsion as Em-G3 which was described in Example 9 of the publication and Em-119 is the same emulsion as Em-G1 which was described in Example 9 of the publication.

<Preparation of Comparative Emulsions Em-101 to 103>

Each of emulsions Em-101 to 103 was prepared in line manner as the preparation of Em-110 to 112 other than those indicated below. Namely, the protrusion portions were removed by eliminating the step of adding a silver nitrate aqueous solution and a sodium bromide aqueous solution which were provided for formation of the epitaxial protrusion portions, in (2) the epitaxial deposition step among respective preparation steps.

<Preparation of Samples 101 to 121>

Each of Em-101 to 121 was dissolved at 40° C., a compound indicated in the under-description was added and the mixture was coated together with a protective layer on a triacetyl cellulose film support which had an under-coat layer, by a simultaneous extrusion process. The coated article was left alone at conditions of 40° C. and a relative humidity of 70% for 16 hours to obtain samples 101 to 121.

| | |
|---|---|
| (1) Emulsion layer | |
| Emulsion in terms of Ag | $7.7 \times 10^{-3}$ mol/m$^2$ |
| Coupler C-1 | $1.2 \times 10^{-3}$ mol/m$^2$ |
| Gelatin | 2.3 g/m$^2$ |
| (2) Protective layer | |
| Gelatin hardener | 0.08 g/m$^2$ |
| Gelatin | 1.8 g/m$^2$ |

<Exposure and Development Processing>

Samples 101 to 121 were exposed through continuous wedge for 1/100 sec, and subjected to the following color reversal development processing. With respect to evaluation, after running processing was carried out until replenishment amount becomes 4 times the tank volume at a ratio 1:1 of an unexposed one to a completely exposed one of Sample 119, the processing for evaluation was carried out.

| Processing Step | Time | Temperature | Tank volume | Replenishment rate |
|---|---|---|---|---|
| 1st development | 4 min | 38° C. | 12 L | 2,200 mL/m$^2$ |
| 1st washing | 2 min | 38° C. | 4 L | 7,500 mL/m$^2$ |
| Reversal | 2 min | 38° C. | 4 L | 1,100 mL/m$^2$ |
| Color development | 6 min | 38° C. | 12 L | 2,200 mL/m$^2$ |
| Pre-bleaching | 2 min | 38° C. | 4 L | 1,100 mL/m$^2$ |
| Bleaching | 6 min | 38° C. | 12 L | 220 mL/m$^2$ |
| Fixing | 4 min | 38° C. | 8 L | 1,100 mL/m$^2$ |
| 2nd washing | 4 min | 40° C. | 8 L | 7,500 mL/m$^2$ |
| Final rinsing | 1 min | 25° C. | 2 L | 1,100 mL/m$^2$ |

The compositions of the processing solutions were as follows.

| <1st developer> | <Tank solution> | <Replenisher> |
|---|---|---|
| Nitrilo-N,N,N-trimethylene phosphonic acid•pentasodium salt | 1.5 g | 1.5 g |
| Diethylenetriamine pentaacetic acid•pentasodium salt | 2.0 g | 2.0 g |
| Sodium sulfite | 30 g | 30 g |
| Hydroquinone•potassium monosulfonate | 20 g | 20 g |
| Potassium carbonate | 15 g | 20 g |
| Potassium bicarbonate | 12 g | 15 g |
| 1-phenyl-4-methyl-4-hydroxymethyl-3-pyrazolidone | 1.5 g | 2.0 g |
| Potassium bromide | 2.5 g | 1.4 g |
| Potassium thiocyanate | 1.2 g | 1.2 g |
| Potassium iodide | 2.0 mg | — |
| Diethyleneglycol | 13 g | 15 g |
| Water to make | 1,000 mL | 1,000 mL |
| pH | 9.65 | 9.65 |

The pH was adjusted by sulfuric acid or potassium hydroxide.

| <Reversal solution> | <Tank solution> | <Replenisher> |
|---|---|---|
| Nitrilo-N,N,N-trimethylene phosphonic acid•pentasodium salt | 3.0 g | the same as tank solution |
| Stannous chloride•dihydrate | 1.0 g | |
| Sodium hydroxide | 8 g | |
| Glacial acetic acid | 15 mL | |
| Water to make | 1,000 mL | |
| pH | 6.00 | |

The pH was adjusted by acetic acid or sodium hydroxide.

| <Color developer> | <Tank solution> | <Replenisher> |
|---|---|---|
| Nitrilo-N,N,N-trimethylene phosphonic acid•pentasodium salt | 2.0 g | 2.0 g |
| Sodium sulfite | 7.0 g | 7.0 g |
| Trisodium phosphate•dodecahydrate | 25 g | 25 g |
| Potassium bromide | 1.0 g | — |
| Potassium iodide | 50 mg | — |
| Sodium hydroxide | 10.0 g | 10.0 g |
| Citrazinic acid | 0.5 g | 0.5 g |

-continued

| <Color developer> | <Tank solution> | <Replenisher> |
|---|---|---|
| N-ethyl-N-(β-methanesulfon amidoethyl)-3-methyl-4 aminoaniline•3/2 sulfuric acid•monohydrate | 9.0 g | 9.0 g |
| 3,6-dithiaoctane-1,8-diol | 0.6 g | 0.7 g |
| Water to make | 1,000 mL | 1,000 mL |
| pH | 11.85 | 12.00 |

The pH was adjusted by sulfuric acid or potassium hydroxide.

| <Pre-bleaching solution> | <Tank solution> | <Replenisher> |
|---|---|---|
| Ethylenediaminetetraacetic acid•disodium salt• dihydrate | 8.0 g | 8.0 g |
| Sodium sulfite | 6.0 g | 8.0 g |
| 1-thioglycerol | 0.4 g | 0.4 g |
| Formaldehyde sodium bisulfite adduct | 25 g | 25 g |
| Water to make | 1,000 mL | 1,000 mL |
| pH | 6.30 | 6.10 |

The pH was adjusted by acetic acid or sodium hydroxide.

| <Bleaching solution> | <Tank solution> | <Replenisher> |
|---|---|---|
| Ethylenediaminetetraacetic acid•disodium salt• dihydrate | 2.0 g | 4.0 g |
| Ethylenediaminetetraacetic acid•Fe(III)•ammonium• dihydrate | 120 g | 240 g |
| Potassium bromide | 100 g | 200 g |
| Ammonium nitrate | 10 g | 20 g |
| Water to make | 1,000 mL | 1,000 mL |
| pH | 5.70 | 5.50 |

The pH was adjusted by nitric acid or sodium hydroxide.

| <Fixing solution> | <Tank solution> | <Replenisher> |
|---|---|---|
| Ammonium thiosulfate | 80 g | the same as tank solution |
| Sodium sulfite | 5.0 g | |
| Sodium bisulfite | 5.0 g | |
| Water to make | 1,000 mL | |
| pH | 6.60 | |

The pH was adjusted by acetic acid or ammonia water.

| <Stabilizer> | <Tank solution> | <Replenisher> |
|---|---|---|
| 1,2-benzoisothiazoline-3-one | 0.02 g | 0.03 g |
| Polyoxyethylene-p-monononyl phenylether (average polymerization degree = 10) | 0.3 g | 0.3 g |
| Polymaleic acid (weight-average molecular weight = 2,000) | 0.1 g | 0.15 g |
| Water to make | 1,000 mL | 1,000 mL |
| pH | 7.0 | 7.0 |

<Evaluation of Sensitivity and Latent Image Storability>

After the above-mentioned development processing was carried out, densitometric measurement was carried out with a red filter to evaluate sensitivity. The sensitivity adopted the reciprocal number of exposure quantity which imparted density equal to ½ of the sum of the maximum density and the minimum density and was represented by a relative value when the sensitivity of Em-119 was referred to as 100. Further, the latent image storability was evaluated by carrying out similar sensitivity evaluation when the samples were stored under conditions of a temperature of 50° C. and a relative humidity of 55% for 7 days from exposure to the performance of development processing, in the sensitivity evaluation step.

The result obtained as above is collectively shown in Table 1 together with the characteristics of various emulsions.

TABLE 1

| Sample No. | Emulsion | | Average aspect ratio of host grain | Ratio of silver halide grains* to the total projected area (%) | Av. silver iodide content rate of all grains (mol %) | Av. silver iodide content rate of outer shell of host grains (mol %) | Epitaxial protrusion portion | Pseudo-halide in epitaxial protrusion | Sensitivity | Sensitivity after storage under condition of 50° C. and 55% RH for 7 days |
|---|---|---|---|---|---|---|---|---|---|---|
| 101 | Em-101 | Comp. | 9 | — | 3.4 | 7 | Absence | — | 32 | 29 |
| 102 | Em-102 | Comp. | 12.4 | — | 3.4 | 7 | Absence | — | 34 | 31 |
| 103 | Em-103 | Comp. | 18 | — | 3.4 | 7 | Absence | — | 35 | 32 |
| 104 | Em-104 | Comp. | 8.5 | 12 | 5.5 | 20 | Presence | Absence | 112 | 56 |
| 105 | Em-105 | Comp. | 12.4 | 77 | 5.5 | 20 | Presence | Absence | 119 | 60 |
| 106 | Em-106 | Comp. | 18 | 91 | 5.5 | 20 | Presence | Absence | 128 | 63 |
| 107 | Em-107 | Comp. | 8.7 | 10 | 4 | 10.3 | Presence | Absence | 92 | 55 |
| 108 | Em-108 | Comp. | 12.4 | 79 | 4 | 10.3 | Presence | Absence | 98 | 57 |
| 109 | Em-109 | Comp. | 18.1 | 91 | 4 | 10.3 | Presence | Absence | 106 | 62 |
| 110 | Em-110 | Comp. | 9 | 11 | 3.4 | 7 | Presence | Absence | 85 | 64 |
| 111 | Em-111 | Comp. | 12.3 | 75 | 3.4 | 7 | Presence | Absence | 90 | 69 |
| 112 | Em-112 | Comp. | 17.9 | 90 | 3.4 | 7 | Presence | Absence | 99 | 74 |
| 113 | Em-113 | Comp. | 8.5 | 12 | 5.5 | 20 | Presence | Presence | 135 | 68 |
| 114 | Em-114 | Comp. | 12.4 | 77 | 5.5 | 20 | Presence | Presence | 142 | 72 |
| 115 | Em-115 | Comp. | 18 | 91 | 5.5 | 20 | Presence | Presence | 158 | 71 |

TABLE 1-continued

| Sample No. | Emulsion | | Average aspect ratio of host grain | Ratio of silver halide grains* to the total projected area (%) | Av. silver iodide content rate of all grains (mol %) | Av. silver iodide content rate of outer shell of host grains (mol %) | Epitaxial protrusion portion | Pseudo-halide in epitaxial protrusion | Sensitivity | Sensitivity after storage under condition of 50° C. and 55% RH for 7 days |
|---|---|---|---|---|---|---|---|---|---|---|
| 116 | Em-116 | Comp. | 8.7 | 10 | 4 | 10.3 | Presence | Presence | 110 | 73 |
| 117 | Em-117 | Inv. | 12.4 | 79 | 4 | 10.3 | Presence | Presence | 117 | 100 |
| 118 | Em-118 | Inv. | 18.1 | 91 | 4 | 10.3 | Presence | Presence | 121 | 108 |
| 119 | Em-119 | Comp. | 9 | 11 | 3.4 | 7 | Presence | Presence | 100 | 75 |
| 120 | Em-120 | Inv. | 12.3 | 75 | 3.4 | 7 | Presence | Presence | 109 | 100 |
| 121 | Em-121 | Inv. | 17.9 | 90 | 3.4 | 7 | Presence | Presence | 116 | 108 |

*Silver halide grain is composed of a host grain with an aspect ratio of 12 or more and a protrusion portion.

As grasped from Table 1, it is grasped that the high sensitivity and latent image storability are compatible first in the composition of the present invention. Namely, when the average silver iodide content rate of the outer shell of the host grains is relatively lowered in comparison with the average silver iodide content rate of all grains, it seems that the latent image storability tends to be stabilized (the samples 104 to 112), but its reaching level is quite inadequate yet. Further, at that time, with respect to sensitivity, although higher sensitivity than those (the samples 101 to 103) having no epitaxial protrusion portions is kept, drawback of slightly lowering sensitivity is accompanied. Surprising result was obtained that the average aspect ratio of host grains is 12 or more and "the high sensitivity and latent image storability are compatible first in the composition (the samples 117, 118, 120 and 121) that the average silver iodide content rate (% by mol) of the outer shell of the host grains≦the average silver iodide content rate (% by mol) of all grains+12" and the pseudo-halide is contained in the epitaxial protrusion portions. Further, it is also grasped that the higher the aspect ratio of host grains is (the samples 118 and 121), the more remarkable the effect is.

EXAMPLE 2

<Preparation of Emulsion Em-201 of the Present Invention>

Emulsion Em-201 was prepared by carrying out the following step operation.

(1) Step of Forming Host Grains (1-1) Step of Forming Nuclei 1230 mL of an aqueous solution containing 0.3 g of potassium bromide and 2 g of low molecular weight oxidation treated gelatin with an average molecular weight of 10000 to 20000 was kept at 35° C. and stirred. 25 mL of an aqueous solution containing 2.6 g of silver nitrate, 30 mL of an aqueous solution containing 1.9 g of potassium bromide and 30 mL of an aqueous solution containing 0.3 g of low molecular weight oxidation treated gelatin with an average molecular weight of 10000 to 20000 were simultaneously added for 40 seconds by a triple jet method.

(1-2) Ripening Step

A potassium bromide aqueous solution was added thereto and silver potential was set at −20 mV and then temperature was raised to 68° C. Then, 18 g of succinated gelatin was added.

(1-3) First Growth Step 50 mL of an aqueous solution containing 4.7 g of silver nitrate and 50 mL of an aqueous solution containing 3.3 g of potassium bromide were added for 16 minutes by a double jet method with increasing flow. At this time, silver potential was kept at −10 mV.

(1-4) Second Growth Step

Ultra fine grain emulsion was prepared by an external stirring device described in JP-A-10-43570, using 480 mL of an aqueous solution containing 76.8 g of silver nitrate and 455 mL of an aqueous solution containing 48.5 g of potassium bromide, 3.7 g of potassium iodide and 45 g of low molecular weight oxidation treated gelatin with an average molecular weight of 20000, the ultra fine grain emulsion was continuously added in a reaction container to dissolve the ultra fine grains and host grains were grown for 54 minutes. At this time, silver potential was kept at 20 mV against a saturated calomel electrode by separately adding a potassium bromide aqueous solution.

(1-5) Third Growth Step 80 mL of an aqueous solution containing 13.0 g of silver nitrate and 90 mL of an aqueous solution containing 9.0 g of potassium bromide and 1.1 g of potassium iodide were added for 8 minutes by a double jet method. At this time, silver potential was kept at 15 mV against a saturated calomel electrode.

(1-6) Fourth Growth Step

After $4.0\times10^{-5}$ mol of the compound I-1 was added based on 1 mole of the silver amount of host grains, 20 mL of an aqueous solution containing 0.2 g of potassium iodide was added over 30 seconds by a single jet process.

(2) Epitaxial Deposition Step

The following step operation was carried out in succession to the step of forming host grains to carry out epitaxial deposition. 0.15 Mol of calcium ion was added. Then, after a spectral sensitization dye S-1 was added and 0.15 mol of calcium ion was added, temperature was lowered to 40° C. and a spectral sensitization dye S-3 was added. The molar ratio of the addition amount of the spectral sensitization dye S-1 to that of S-3 is 88:12 and the sum of both was a rate of 81% of a saturated coating amount. Then, $6.0\times10^{-6}$ mol of potassium hexacyanoferrate (II) was added based on 1 mole of the silver amount of host grains and then, $1.9\times10^{-3}$ mol of potassium thiocyanate was added based on 1 mole of the silver amount of host grains.

Then, 145 mL of an aqueous solution containing 13.7 g of silver nitrate and 145 mL of an aqueous solution containing 9.0 g of potassium bromide and 0.8 g of potassium iodide were added at a constant flow rate for 60 minutes by a double jet process to carry out epitaxial deposition. At this time, silver potential was kept at +120 mV against a saturated calomel electrode. The silver amount used for the epitaxial deposition was an amount of 14% against the host grains. Then, $6.5\times10^{-5}$ mol of the compound II-1 was added based on 1 mole of the silver amount of host grains and there was added 19 g of gelatin which contains by 30% a component having a molecular weight of 280000 or more when it is measured in accordance with a PAGI method.

Compound II-1

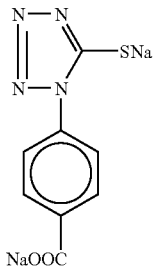

(3) Desalting and Dispersion Step

Desalting was carried out by a known flocculation method at 35° C., gelatin which contains by 30% a component having a molecular weight of 280000 or more when it is measured in accordance with a PAGI method was added, the compound II-2 was added and then, pH and pAg were respectively adjusted at 5.9 and 7.8 at 50° C.

Compound II-2

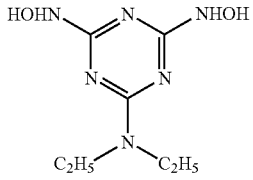

(4) Chemical Sensitization Step

The emulsion was kept at 50° C. and $2.2\times10^{-5}$ mol of chloroauric acid based on 1 mole of the silver amount of the whole grains, $3.7\times10^{-5}$ mol of sodium thiosulfate based on 1 mole of the silver amount of the whole grains and $4.9\times10^{-6}$ mol of N,N-dimethylseleno urea based on 1 mole of the silver amount of the whole grains were added to optimally carry out chemical sensitization. $2.0\times10^{-4}$ Mol of the compound II-1 based on 1 mole of the silver amount of the whole grains was added to terminate the chemical sensitization and the mixture was stored in a refrigerator after adjusting pAg at 8.7.

The emulsion Em-201 obtained was emulsion in which tabular grains having an average equivalent-circular diameter of 0.86 μm, the variation coefficient of an equivalent-circular diameter of 21%, an average thickness of 0.057 μm and an average aspect ratio of 15.1 in which a (111) plane is a principal plane are the host grains, and silver halide grains in which the protrusion portions were mainly formed on the apexes of the host tabular grains occupied 93% of the total projected area. Further, 84% was a proportion in which the silver halide grains which were composed of the host tabular grains having an aspect ratio of 12 or more and the protrusion portions occupy the total projected area. The emulsion was silver iodobromide emulsion in which average silver iodide content rate of 8%, based on the silver amount of the host grain, of the outer shell of the host grain was 9.5 mol % and the average silver iodide content rate of all grains was 5.4 mol %. The halogen composition of the protrusion portions was the content rate of silver iodide: the content rate of silver bromide: the content rate of silver chloride=5.9:94.1:0 (molar ratio).

<Preparation of Emulsion Em-202 of the Present Invention>

Em-202 was prepared in like manner as Em-201 except that (2) Epitaxial deposition step operation. The epitaxial deposition step of Em-202 is as described below.

(2) Epitaxial Deposition Step

The following step operation was carried out in succession to the step of forming host grains to carry out epitaxial deposition. 0.15 Mol of calcium ion was added. Then, a spectral sensitization dye S-1 was added, 0.15 mol of calcium ion was added, and a spectral sensitization dye S-3 was added. The molar ratio of the addition amount of the spectral sensitization dye S-1 to that of S-3 is 88:12 and the sum of both was a rate of 81% of a saturated coating amount. Then, $6.0\times10^{-6}$ mol of potassium hexacyanoferrate (II) was added based on 1 mole of the silver amount of host grains and then, $1.9\times10^{-3}$ mol of potassium thiocyanate was added based on 1 mole of the silver amount of host grains.

Then, 145 mL of an aqueous solution containing 13.7 g of silver nitrate and 145 mL of an aqueous solution containing 9.5 g of potassium bromide were added at a constant flow rate for 60 minutes by a double jet process to carry out epitaxial deposition. At this time, silver potential was kept at +120 mV against a saturated calomel electrode. The silver amount used for the epitaxial deposition was an amount of 14% against the host grains. Then, $6.5\times10^{-5}$ mol of the compound II-1 was added based on 1 mole of the silver amount of host grains and there was added 19 g of gelatin which contains by 30% a component having a molecular weight of 280000 or more when it is measured in accordance with a PAGI method.

The emulsion Em-202 obtained was emulsion in which tabular grains having an average equivalent-circular diameter of 0.86 μm, the variation coefficient of an equivalent-circular diameter of 21%, an average thickness of 0.057 μm and an average aspect ratio of 15.1 in which a (111) plane is a principal plane are the host grains, and silver halide grains in which the protrusion portions were mainly formed on the apexes of the host tabular grains occupied 93% of the total projected area. Further, 85% was a proportion in which the silver halide grains which were composed of the host tabular grains having an aspect ratio of 12 or more and the protrusion portions occupy the total projected area. The emulsion was silver iodobromide emulsion in which average silver iodide content rate of 8%, based on the silver amount of the host grain, of the outer shell of the host grain was 9.5 mol % and the average silver iodide content rate of all grains was 4.6 mol %. The halogen composition of the protrusion portions was the content rate of silver iodide: the content rate of silver bromide: the content rate of silver chloride=2.0:98.0:0 (molar ratio).

<Preparation of Emulsion Em-203 of the Present Invention>

Em-203 was prepared in like manner as Em-202 except that (2) Epitaxial deposition step operation. The epitaxial deposition step of Em-203 is as described below.

(2) Epitaxial Deposition Step

The following step operation was carried out in succession to the step of forming host grains to carry out epitaxial deposition. 0.15 Mol of calcium ion was added. Then, a spectral sensitization dye S-1 was added, 0.15 mol of calcium ion was added, and a spectral sensitization dye S-3 was added. The molar ratio of the addition amount of the spectral sensitization dye S-1 to that of S-3 is 88:12 and the sum of both was a rate of 81% of a saturated coating amount. Then, $6.0\times10^{-6}$ mol of potassium hexacyanoferrate (II) was added based on 1 mole of the silver amount of host grains and then, $1.9\times10^{-3}$ mol of potassium thiocyanate was added based on 1 mole of the silver amount of host grains and then, $2.0\times10^{-7}$ mol of potassium hexachloroiridium ferrate (IV) was added based on 1 mole of the silver amount of host grains Then, 145 mL of an aqueous solution containing 13.7 g of silver nitrate and 145 mL of an aqueous solution containing 9.5 g of potassium bromide were added at a constant flow rate for 60 minutes by a double jet process to carry out epitaxial deposition. At this time, silver potential was kept at +120 mV against a saturated calomel electrode. The silver amount used for the epitaxial deposition was an amount of 14% against the host grains. Then, $6.5\times10^{-5}$ mol of the compound II-1 was added based on 1 mole of the silver amount of host grains and there was added 19 g of gelatin which contains by 30% a component having a molecular weight of 280000 or more when it is measured in accordance with a PAGI method.

<Preparation of Emulsion Em-204 of the Present Invention>

Em-204 was prepared in like manner as Em-202 except that (4) Chemical sensitization step. The chemical sensitization step of Em-204 is as described below.

(4) Chemical Sensitization Step

The emulsion was kept at 50° C. and $1.9\times10^{-5}$ mol of compound AUS1-1 based on 1 mole of the silver amount of the whole grains, $1.8\times10^{-5}$ mol of sodium thiosulfate based on 1 mole of the silver amount of the whole grains and $4.9\times10^{-6}$ mol of N,N-dimethylseleno urea based on 1 mole of the silver amount of the whole grains were added to optimally carry out chemical sensitization. $2.0\times10^{-4}$ Mol of the compound II-1 based on 1 mole of the silver amount of the whole grains was added to terminate the chemical sensitization and the mixture was stored in a refrigerator after adjusting pAg at 8.7.

With respect to the emulsions Em-203 to 204 thus obtained, the average equivalent-circular diameter of respective host grains, the variation coefficient of an equivalent-circular diameter, an average thickness, an average aspect ratio, a proportion in which the silver halide grains which the protrusion portions were mainly formed on the apexes of host grains occupy against the total projected area, an average silver iodide content rate of 8% (against the silver amount of host grains) of the outer shell of the host grains, the average silver iodide content rate of all grains and the halogen composition of the protrusion portions were respectively the same values as Em-202.

<Preparation of Samples 201 to 204 and Evaluation of Sensitivity and Latent Image Storability>

Emulsions Em-201 to 204 were coated on the support by a similar method as Example 1 to obtain each of samples 201 to 204. Development and processing similar as Example 1 was carried out for the samples 201 to 204 and the sensitivity and latent image storability were evaluated. The sensitivity was represented by a relative value when the sensitivity of the sample 201 was referred to as 100.

The result obtained as above is collectively shown in Table 2.

TABLE 2

| Sample No. | Emulsion | | Av. silver iodide content rate in epitaxial protrusion portion (mol %) | Av. silver iodide content rate of all grains (mol %) | Iridium compound in epitaxial protrusion portion | Chemical sensitization using AUS1-1A | Sensitivity | Sensitivity after storage under condition of 50° C. and 55% RH for 7 days |
|---|---|---|---|---|---|---|---|---|
| 201 | Em-201 | Inv. | 5.9 | 5.4 | Absence | Not performed | 100 | 91 |
| 202 | Em-202 | Inv. | 2.0 | 4.6 | Absence | Not performed | 114 | 105 |
| 203 | Em-203 | Inv. | 2.0 | 4.6 | Presence | Not performed | 113 | 108 |
| 204 | Em-204 | Inv. | 2.0 | 4.6 | Presence | Performed | 114 | 110 |

It is grasped that the effect of the present invention is more remarkably expressed when the silver iodide content rate of the epitaxial protrusion portions of the emulsion of the present invention is lower than the average silver iodide content rate of all grains, when the protrusion portions contain an iridium compound, and when chemical sensitization is carried out using a compound releasing $AuS^-$ ion (AUS1-1).

EXAMPLE 3

A multilayered color photosensitive material was prepared by the following method.

(Preparation of Sample 301)

(i) Preparation of Cellulose Triacetate Film

Cellulose triacetate was dissolved (13% by mass) in dichloromethane/methanol=92/8 (mass ratio) by a usual solution flow extension method, the plasticizers of triphenyl phosphate and biphenyldiphenyl phosphate were added thereto so that mass ratio is 2:1 and the total is 14% based on cellulose triacetate, and the cellulose triacetate film was prepared by a band method from the solution. The thickness of the support after drying was 97 μm.

(ii) Content of Undercoat Layer

The undercoat below was carried out on both faces of the above-mentioned cellulose triacetate. The Figure represents mass contained in 1.0 L of the undercoat liquid.

| | |
|---|---|
| Gelatin | 10.0 g |
| Salicylic acid | 0.5 g |
| Glycerin | 4.0 g |
| Acetone | 700 mL |
| Methanol | 200 mL |
| Dichloromethane | 80 mL |
| Formaldehyde | 0.1 mg |
| Total (by addition with water) | 1.0 L |

(iii) Coating of Back Layer

The undercoat layer of one surface of the support was coated with back layers described below.

| | |
|---|---|
| 1st layer Binder: acid-processed gelatin (isoelectric point 9.0) | 1.00 g |
| Polymer latex: P-2 (average grain size 0.1 μm) | 0.13 g |
| Polymer latex: P-3 (average grain size 0.2 μm) | 0.23 g |
| Ultraviolet absorbent U-1 | 0.030 g |
| Ultraviolet absorbent U-2 | 0.010 g |
| Ultraviolet absorbent U-3 | 0.010 g |
| Ultraviolet absorbent U-4 | 0.020 g |
| High-boiling organic solvent Oil-2 | 0.030 g |
| Surfactant W-2 | 0.010 g |
| Surfactant W-4 | 3.0 mg |
| Surfactant W-5 | 0.6 mg |
| 2nd layer Binder: acid-processed gelatin (isoelectric point 9.0) | 3.10 g |
| Polymer latex: P-2 (average grain size 0.2 μm) | 0.11 g |
| Ultraviolet absorbent U-1 | 0.030 g |
| Ultraviolet absorbent U-3 | 0.010 g |
| Ultraviolet absorbent U-4 | 0.020 g |
| High-boiling organic solvent Oil-2 | 0.030 g |
| Surfactant W-2 | 0.010 g |
| Surfactant W-4 | 3.0 mg |
| Surfactant W-5 | 0.6 mg |
| Dye D-2 | 0.10 g |
| Dye D-10 | 0.12 g |
| Dye D-11 | 0.02 g |
| Potassium sulfate | 0.25 g |
| Calcium chloride | 0.5 mg |
| Sodium hydroxide | 0.03 g |
| 3rd layer Binder: acid-processed gelatin (isoelectric point 9.0) | 3.30 g |
| Surfactant W-2 | 0.020 g |
| Potassium sulfate | 0.30 g |
| Sodium hydroxide | 0.03 g |
| 4th layer Binder: lime-processed gelatin | 1.15 g |
| 1:9 copolymer of methacrylic acid and methylmethacrylate (average grain size 2.0 μm) | 0.040 g |
| 6:4 copolymer of methacrylic acid and methylmethacrylate (average grain size 2.0 μm) | 0.030 g |
| Surfactant W-2 | 0.060 g |
| Surfactant W-1 | 7.0 mg |
| Hardener H-1 | 0.23 g |

(4) Coating of Photosensitive Emulsion Layer

<Preparation of Emulsion A> (Preparation of Emulsion with Average Equivalent-sphere Diameter of 0.3 μm Having Dislocation Line)

1) Formation of Grain

A silver nitrate aqueous solution (containing 20.48 g of silver nitrate in 100 mL) was added to be stirred keeping at 40° C. by a double jet method in 1.6 L of an aqueous solution at 30° C. containing 4.3 g of potassium bromide and 2.5 g of low molecular weight gelatin with an average molecular weight (M) of 20000 while stirring. While stirring 40 mL of an aqueous solution containing 3 g of silver nitrate and a potassium iodide aqueous solution (containing 14.3 g of potassium bromide and 2.7 g of potassium iodide in 100 mL), 41 mL was simultaneously added at 105 mL/min respectively. After a gelatin aqueous solution (containing 35.6 of inactive gelatin and 284 mL of water) was added, temperature was raised to 58° C. and a silver nitrate aqueous solution (containing 2.4 g of silver nitrate) was added for 30 seconds to be ripened for 5 minutes.

Successively, a silver nitrate aqueous solution (A) containing 47 g of silver nitrate and a potassium bromide aqueous solution were added for 20 minutes. At that time, pAg was kept at 8.7.

After temperature was lowered to 40° C., a reducing sensitizing agent-1 and an iridium salt-1 were added. A silver nitrate (6.9 g) aqueous solution and a potassium iodide (6.5 g) aqueous solution (C) were added with double jet and successively, a silver nitrate aqueous solution containing 166 g of silver nitrate (B) and a potassium bromide aqueous solution were added while keeping pAg at 9.2. A rhodium salt-1 was added during the addition. Then, the mixture was cooled to 35° C. and rinsed with water by a usual flocculation method, 77 g of gelatin was added and pH and pAg were adjusted to 6.2 and 8.8 respectively. The emulsion obtained was tabular grains having an average equivalent-circular diameter of 0.18 μm, the variation coefficient of an equivalent-circular diameter of 10%, an average aspect ratio of 2.3 and an average silver iodide content rate of 3.5 mol %.

(2) Spectral Sensitization and Chemical Sensitization

The temperature of the above-mentioned emulsion was raised to 62° C., $7.15\times10^{-4}$ mol of a sensitization dye S-2 which is described later, $6\times10^{-4}$ mol of S-3, $1.2\times10^{-4}$ mol of S-8 and $2.2\times10^{-4}$ mol of S-13 were added and after 10 minutes later, $2.6\times10^{-5}$ mol/molAg of sodium thiosulfate, $1.1\times10^{-5}$ mol/molAg of N,N-dimethylselenourea, $3.0\times10^{-3}$ mol/molAg of potassium thiocyanate and $8.6\times10^{-6}$ mol/molAg of chloroauric acid. The amounts of the sensitization dye and the chemical sensitization agent and the time of chemical ripening were set so that the sensitivity at exposure for 1/100 second is highest. After completion of the chemical ripening, $5\times10^{-4}$ mol/molAg of tetrazaindene (hereinafter, referred to as TAI) was added as a stabilizer. Further, $0.5\times10^{-4}$ mol of a sensitization dye S-1 was added. The emulsion thus obtained was referred to as A.

<Preparation of Emulsions B to V>

Emulsions B to V were prepared by the similar method as the preparation of the emulsion A except that conditions shown in Tables 3 to 5 were additionally added and modified to prepare emulsions.

TABLE 3

| Emulsion | Characteristics | Structure of Silver halide emulsion: Silver iodobromide emulsion used in Sample 101 — Host grain: Av. ESD*1 (μm) | COV*1 (%) | Av. AgI content (mol %) | Silver bromide content rate (mol %) | Protrusion portion: Silver bromide content rate (mol %) | Silver amount | Struct. of halide comp. of silver halide grain | Other characteristics*2 (1) | (2) | (3) | (4) | (5) | (6) |
|---|---|---|---|---|---|---|---|---|---|---|---|---|---|---|
| A | Monodispersed (111) tabular grains/Av. aspect ratio 2.5 | 0.18 | 10 | 3.5 | 96.5 | — | — | Triple struct. | ○ | ○ | ○ | ○ | — | — |
| B | Monodispersed (111) tabular grains/Av. aspect ratio 3.0 | 0.20 | 10 | 2.5 | 97.5 | — | — | Quadruple struct. | — | — | ○ | | ○ | — |
| C | Monodispersed (111) tabular grains/Av. aspect ratio 4.5 | 0.32 | 11 | 3.8 | 96.2 | — | — | Triple struct. | — | ○ | — | ○ | ○ | — |
| D | Monodispersed (111) tabular grains/Av. aspect ratio 6.0 | 0.32 | 21 | 4.8 | 95.2 | — | — | Triple struct. | — | ○ | — | ○ | ○ | — |
| E | Monodispersed (111) tabular grains/Av. aspect ratio 3.0 | 0.48 | 12 | 2.0 | 98.0 | — | — | Quadruple struct. | — | ○ | — | — | — | — |
| F | Monodispersed (111) tabular grains/Av. aspect ratio 8.0 | 0.65 | 12 | 1.6 | 98.4 | — | — | Triple struct. | — | ○ | — | — | ○ | — |
| G | Monodispersed (111) tabular grains/Av. aspect ratio 2.5 | 0.14 | 9 | 3.5 | 96.5 | — | — | Quadruple struct. | ○ | — | ○ | ○ | — | — |
| H | Monodispersed (111) tabular grains/Av. aspect ratio 2.8 | 0.22 | 12 | 1.9 | 98.1 | — | — | Quadruple struct. | — | ○ | — | — | ○ | — |
| I | Monodispersed (111) tabular grains/Av. aspect ratio 4.0 | 0.35 | 12 | 3.5 | 96.5 | — | — | Quintuple struct. | ○ | ○ | — | ○ | ○ | — |
| J | Monodispersed (111) tabular grains/Av. aspect ratio 7.0 | 0.40 | 21 | 2.0 | 98.0 | — | — | Quadruple struct. | — | ○ | — | ○ | ○ | — |
| K | Monodispersed (111) tabular grains/Av. aspect ratio 8.5 | 0.65 | 13 | 1.7 | 98.3 | — | — | Triple struct. | ○ | ○ | — | — | ○ | — |

TABLE 4

| Emulsion | Characteristics | Structure of Silver halide emulsion: Silver iodobromide emulsion used in Sample 101 — Host grain: Av. ESD*1 (μm) | COV*1 (%) | Av. AgI content (mol %) | Silver bromide content rate (mol %) | Protrusion portion: Silver bromide content rate (mol %) | Silver amount | Struct. of halide comp. of silver halide grain | Other characteristics*2 (1) | (2) | (3) | (4) | (5) | (6) |
|---|---|---|---|---|---|---|---|---|---|---|---|---|---|---|
| L | Monodispersed (111) tabular grains/Av. aspect ratio 2.8 | 0.30 | 9 | 7.5 | 92.5 | — | — | Triple struct. | — | — | ○ | — | ○ | — |
| M | Monodispersed (111) tabular grains/Av. aspect ratio 2.8 | 0.30 | 9 | 7.5 | 92.5 | — | — | Triple struct. | — | ○ | ○ | ○ | — | — |
| N | Monodispersed (111) tabular grains/Av. aspect ratio 3.0 | 0.35 | 13 | 2.1 | 97.9 | — | — | Quintuple struct. | ○ | ○ | — | — | — | — |
| O | Monodispersed (111) tabular grains/Av. aspect ratio 5.0 | 0.45 | 9 | 2.5 | 97.5 | — | — | Quadruple struct. | — | ○ | — | ○ | ○ | — |
| P | Monodispersed (111) tabular grains/Av. aspect ratio 9.0 | 0.70 | 21 | 2.8 | 97.2 | — | — | Triple struct. | ○ | ○ | — | — | ○ | — |
| Q | Monodispersed (111) tabular grains/Av. aspect ratio 9.0 | 0.85 | 8 | 1.0 | 99.0 | — | — | Quadruple struct. | ○ | ○ | — | — | ○ | — |

TABLE 5

| Emulsion | Characteristics | Av. ESD* (μm) | COV* (%) | Av. AgI content (mol %) | Silver bromide content rate (mol %) | Silver bromide content rate (mol %) | Silver amount | Struct. of halide comp. of silver halide grain | (1) | (2) | (3) | (4) | (5) | (6) |
|---|---|---|---|---|---|---|---|---|---|---|---|---|---|---|
| | Structure of Silver halide emulsion | | | | | | | | | | | | | |
| | Silver iodobromide emulsion used in Sample 103 | | | | | | | | | | | | | |
| | | Host grain | | | | Protrusion portion | | | Other characteristics* | | | | | |
| R | Monodispersed (111) tabular grains/Av. aspect ratio 5.0 | 0.4 | 15 | 8.0 | 92.0 | — | — | Quadruple struct. | ○ | ○ | — | — | ○ | — |
| S | Monodispersed (111) tabular grains/Av. aspect ratio 4.0 | 0.7 | 13 | 12.5 | 87.5 | — | — | Quadruple struct. | — | ○ | — | — | ○ | — |
| T | Monodispersed (111) tabular grains/Av. aspect ratio 4.0 | 0.45 | 13 | 10.5 | 89.5 | — | — | Quadruple struct. | ○ | ○ | — | — | ○ | — |
| U | Monodispersed (111) tabular grains/Av. aspect ratio 3.0 | 0.5 | 15 | 12.0 | 88.0 | — | — | Quadruple struct. | — | ○ | — | — | ○ | — |
| V | Monodispersed (111) tabular grains/Av. aspect ratio 3.0 | 0.7 | 12 | 12.0 | 88.0 | — | — | Quadruple struct. | — | ○ | — | — | ○ | — |

*1) Av.ESD: Average equivalent-sphere diameter; COV: Coefficient of variation
*2) Other characteristics
The mark "○" means each of the conditions set forth below is satisfied.
(1) A reduction sensitizer was added during grain formation;
(2) A selenium sensitizer was used as an after-ripening agent
(3) A rhodium salt was added during grain formation.
(4) A shell was provided subsequent to after-ripening by using silver nitrate in an amount of 10%, in terms of silver molar ratio, of the emulsion grains at that time, together with the equimolar amount of potassium bromide
(5) The presence of dislocation lines in an average number of ten or more per grain was observed by a transmission electron microscope.
(6) Grains in which the protrusion portions are formed on the apexes of the tabular grains occupy 70% or more of the total projected area.
Note, also, that chemically-modified gelatin whose amino groups were partially converted to phthalic acid amide, was added to emulsions B, C, E, H, J, N, Q, R, S and T.

<Spectral Sensitization>

The spectral sensitization dyes of respective emulsions were used at an amount at which the emulsion A is equal to the total molar number of coating per grain surface area.

TABLE 6

| Emulsion | Spectral sensitizing dye added | Addition timing of the spectral sensitizing dye |
|---|---|---|
| A | S-1 | Subsequent to after-ripening |
| | S-2 | Before after-ripening |
| | S-3 | same as above |
| | S-8 | same as above |
| | S-13 | same as above |
| B | S-2 | Before after-ripening |
| | S-8 | same as above |
| | S-13 | same as above |
| | S-14 | same as above |
| C | S-2 | Before after-ripening |
| | S-8 | same as above |
| | S-13 | same as above |
| D | S-2 | Subsequent to after-ripening |
| | S-3 | Before after-ripening |
| | S-8 | same as above |
| | S-13 | same as above |
| E | S-1 | Before after-ripening |
| | S-2 | same as above |
| | S-8 | same as above |

TABLE 6-continued

| Emulsion | Spectral sensitizing dye added | Addition timing of the spectral sensitizing dye |
|---|---|---|
| | S-13 | Subsequent to after-ripening |
| F | S-2 | Before after-ripening |
| | S-3 | same as above |
| | S-8 | same as above |
| G | S-4 | Subsequent to after-ripening |
| | S-5 | same as above |
| | S-12 | same as above |
| H | S-4 | Before after-ripening |
| | S-5 | Subsequent to after-ripening |
| | S-9 | Before after-ripening |
| | S-14 | Subsequent to after-ripening |
| I | S-4 | Before after-ripening |
| | S-9 | same as above |
| | S-12 | same as above |
| J | S-4 | Before after-ripening |
| | S-5 | Subsequent to after-ripening |
| | S-12 | Before after-ripening |
| K | S-4 | Before after-ripening |
| | S-9 | same as above |
| | S-12 | same as above |

TABLE 6-continued

| Emulsion | Spectral sensitizing dye added | Addition timing of the spectral sensitizing dye |
|---|---|---|
| | S-14 | same as above |
| L, M | S-6 | Subsequent to after-ripening |
| | S-10 | same as above |
| | S-11 | same as above |
| N | S-6 | Subsequent to after-ripening |
| | S-7 | same as above |
| | S-10 | same as above |
| | S-11 | same as above |
| O | S-10 | Subsequent to after-ripening |
| | S-11 | same as above |
| P | S-6 | Subsequent to after-ripening |
| | S-7 | same as above |
| | S-10 | Before after-ripening |
| | S-11 | same as above |
| Q | S-6 | Before after-ripening |
| | S-7 | same as above |
| | S-10 | same as above |
| | S-11 | same as above |
| R | S-15 | Subsequent to after-ripening |
| | S-4 | same as above |
| S | S-15 | Subsequent to after-ripening |
| | S-4 | same as above |
| | S-10 | Before after-ripening |
| T | S-6 | Before after-ripening |
| | S-10 | same as above |
| U | S-2 | Before after-ripening |
| | S-8 | same as above |
| | S-13 | same as above |
| V | S-10 | Subsequent to after-ripening |
| | S-11 | same as above |

A photosensitive emulsion layer shown below was coated at the reverse side from a side where a back layer was coated to be referred to as the sample 301. The figure represents addition amount per $m^2$. Further, the effect of a compound added is not limited to uses described.

As gelatin shown below, those having a molecular weight (mass average Spectral sensitization) of 100000 to 200000 were used. The content of main metal ion was 2500 to 3000 ppm for calcium and 1 to 7 ppm for iron, 1500 to 3000 ppm for sodium. Further, gelatin in which a calcium content was 1000 ppm or less was used in combination.

Organic compounds contained in respective layers were prepared as emulsified dispersions (W-2 and W-3 were used as surfactants), photosensitive emulsions and yellow colloid silver were prepared as gelatin dispersions and these were mixed to prepare coating solutions which were adjusted so as to obtain addition amounts described and provided for coating. Cpd-H, O, P and Q and dyes D-1, 2, 3, 5, 6, 8, 9, 10, 11, H-1, P-3 and 4, and F-1 to 9 were dissolved in an appropriate water-miscible organic solvent such as water, methanol, dimethylformamide, ethanol, dimethylacetamide, and then added to the coating solutions of respective layers.

The gelatin concentration (mass of gelatin solid content/volume of coating solution) of respective layers thus prepared was a range of 2.5% to 15.0%, further, pH of respective coating solutions was a range of 5.0 to 8.5 and the value of pAg was a range of 7.0 to 9.5 in the coating solution of a layer containing silver halide emulsion when pH and temperature were respectively adjusted at 6.0 and 40° C.

After coating, they were dried in the multistage drying step which kept temperature at a range of 10° C. to 45° C., to obtain samples.

| | | | |
|---|---|---|---|
| **1st layer: Antihalation layer** | | | |
| Black colloidal silver | silver | 0.20 | g |
| Gelatin | | 2.20 | g |
| Compound Cpd-B | | 0.010 | g |
| Ultraviolet absorbent U-1 | | 0.050 | g |
| Ultraviolet absorbent U-3 | | 0.020 | g |
| Ultraviolet absorbent U-4 | | 0.020 | g |
| Ultraviolet absorbent U-5 | | 0.010 | g |
| Ultraviolet absorbent U-2 | | 0.070 | g |
| Compound Cpd-F | | 0.20 | g |
| Compound Cpd-R | | 0.020 | g |
| Compound Cpd-S | | 0.020 | g |
| High-boiling organic solvent Oil-2 | | 0.020 | g |
| High-boiling organic solvent Oil-6 | | 0.020 | g |
| High-boiling organic solvent Oil-8 | | 0.020 | g |
| Dye D-4 | | 1.0 | mg |
| Dye D-8 | | 1.0 | mg |
| Fine-crystal solid dispersion of dye E-1 | | 0.05 | g |
| **2nd layer: Interlayer** | | | |
| Gelatin | | 0.4 | g |
| Compound Cpd-F | | 0.050 | mg |
| High-boiling organic solvent Oil-6 | | 0.010 | g |
| **3rd layer: Interlayer** | | | |
| Gelatin | | 1.50 | g |
| Compound Cpd-M | | 0.10 | g |
| Compound Cpd-F | | 0.030 | g |
| Compound Cpd-D | | 0.010 | g |
| Compound Cpd-K | | 3.0 | mg |
| Ultraviolet absorbent U-6 | | 0.010 | g |
| High-boiling organic solvent Oil-6 | | 0.10 | g |
| High-boiling organic solvent Oil-3 | | 0.010 | g |
| High-boiling organic solvent Oil-4 | | 0.010 | g |
| **4th layer: Short-wave green sensitive interimage donating layer** | | | |
| Emulsion R | silver | 0.03 | g |
| Emulsion S | silver | 0.05 | g |
| Emulsion T | silver | 0.24 | g |
| Fine-grain silver iodide (av. equivalent-sphere diameter 0.05 μm) | silver | 0.005 | g |
| Gelatin | | 0.5 | g |
| Compound Cpd-M | | 0.030 | g |
| High-boiling organic solvent Oil-6 | | 0.030 | g |
| High-boiling organic solvent Oil-7 | | 5.0 | mg |
| Dye D-7 | | 4.0 | mg |
| **5th layer: Red sensitive interimage effect donating layer** | | | |
| Emulsion U | silver | 0.14 | g |
| Gelatin | | 0.25 | g |
| Compound Cpd-M | | 0.010 | g |
| High-boiling organic solvent Oil-6 | | 0.010 | g |
| High-boiling organic solvent Oil-7 | | 1.7 | mg |
| **6th layer: Interlayer** | | | |
| Gelatin | | 1.50 | g |
| Compound Cpd-M | | 0.10 | g |
| Compound Cpd-F | | 0.030 | g |
| Compound Cpd-D | | 0.010 | g |
| Compound Cpd-K | | 3.0 | mg |
| Ultraviolet absorbent U-6 | | 0.010 | g |
| High-boiling organic solvent Oil-6 | | 0.10 | g |
| High-boiling organic solvent Oil-3 | | 0.010 | g |
| High-boiling organic solvent Oil-4 | | 0.010 | g |

-continued

7th layer: Low-speed red-sensitive emulsion layer

| | | | |
|---|---|---|---|
| Emulsion A | silver | 0.05 | g |
| Emulsion B | silver | 0.05 | g |
| Emulsion Em-101 | silver | 0.50 | g |
| Yellow colloidal silver | silver | 0.1 | mg |
| Gelatin | | 0.60 | g |
| Coupler C-1 | | 0.11 | g |
| Coupler C-2 | | 7.0 | mg |
| Ultraviolet absorbent U-2 | | 3.0 | mg |
| Compound Cpd-D | | 1.0 | mg |
| Compound Cpd-J | | 2.0 | mg |
| High-boiling organic solvent Oil-5 | | 0.050 | g |
| High-boiling organic solvent Oil-10 | | 0.010 | g |

8th layer: Medeum-speed red-sensitive emulsion layer

| | | | |
|---|---|---|---|
| Emulsion C | silver | 0.12 | g |
| Emulsion D | silver | 0.12 | g |
| Internally fogged silver bromide emulsion (av. equivalent-sphere diameter 0.11 μm, cubic grain) | silver | 0.01 | g |
| Gelatin | | 0.60 | g |
| Coupler C-1 | | 0.16 | g |
| Coupler C-2 | | 7.0 | mg |
| Compound Cpd-D | | 1.5 | mg |
| High-boiling organic solvent Oil-5 | | 0.050 | g |
| High-boiling organic solvent Oil-10 | | 0.010 | g |
| Compound Cpd-T | | 2.0 | mg |

9th layer: High-speed red-sensitive emulsion layer

| | | | |
|---|---|---|---|
| Emulsion E | silver | 0.32 | g |
| Emulsion F | silver | 0.14 | g |
| Fine-grain silver iodobromide (silver iodide content rate 0.1 mol %, av. equivalent-sphere diameter 0.05 μm) | silver | 0.01 | g |
| Gelatin | | 1.50 | g |
| Coupler C-1 | | 0.75 | g |
| Coupler C-2 | | 0.025 | g |
| Coupler C-3 | | 0.020 | g |
| Ultraviolet absorbent U-1 | | 0.010 | g |
| High-boiling organic solvent Oil-5 | | 0.25 | g |
| High-boiling organic solvent Oil-9 | | 0.05 | g |
| High-boiling organic solvent Oil-10 | | 0.10 | g |
| Compound Cpd-D | | 5.0 | mg |
| Compound Cpd-L | | 1.0 | mg |
| Compound Cpd-T | | 0.020 | g |
| Additive P-1 | | 0.010 | g |
| Additive P-3 | | 0.030 | g |
| Additive P-4 | | 0.005 | g |

10th layer: Interlayer

| | | | |
|---|---|---|---|
| Gelatin | | 0.50 | g |
| Additive P-2 | | 0.10 | g |
| Dye D-5 | | 0.020 | g |
| Dye D-6 | | 0.005 | g |
| Dye D-9 | | 6.0 | mg |
| Compound Cpd-I | | 0.020 | g |
| Compound Cpd-O | | 3.0 | mg |
| Compound Cpd-P | | 5.0 | mg |
| High-boiling organic solvent Oil-6 | | 0.050 | g |

11th layer: Interlayer

| | | | |
|---|---|---|---|
| Yellow colloidal silver | silver | 3.0 | mg |
| Gelatin | | 1.00 | g |
| Additive P-2 | | 0.05 | g |
| Compound Cpd-A | | 0.050 | g |
| Compound Cpd-D | | 0.030 | g |
| Compound Cpd-M | | 0.10 | g |
| High-boiling organic solvent Oil-3 | | 0.010 | g |
| High-boiling organic solvent Oil-6 | | 0.10 | g |

12th layer: Low-speed green-sensitive emulsion layer

| | | | |
|---|---|---|---|
| Emulsion G | silver | 0.07 | g |
| Emulsion H | silver | 0.31 | g |
| Emulsion I | silver | 0.31 | g |
| Gelatin | | 1.00 | g |
| Coupler C-4 | | 0.013 | g |
| Coupler C-5 | | 0.080 | g |
| Coupler C-10 | | 0.020 | g |

-continued

| | | | |
|---|---|---|---|
| Compound Cpd-B | | 0.012 | g |
| Compound Cpd-G | | 3.0 | mg |
| Compound Cpd-K | | 2.4 | mg |
| High-boiling organic solvent Oil-2 | | 0.24 | g |
| High-boiling organic solvent Oil-5 | | 0.24 | g |
| Additive P-1 | | 5.0 | mg |

13th layer: Medium-speed green-sensitive emulsion layer

| | | | |
|---|---|---|---|
| Emulsion I | silver | 0.15 | g |
| Emulsion J | silver | 0.28 | g |
| Gelatin | | 0.70 | g |
| Coupler C-4 | | 0.20 | g |
| Coupler C-5 | | 0.10 | g |
| Coupler C-6 | | 0.010 | g |
| Coupler C-10 | | 0.010 | g |
| Compound Cpd-B | | 0.030 | g |
| Compound Cpd-U | | 9.0 | mg |
| High-boiling organic solvent Oil-2 | | 0.015 | g |
| High-boiling organic solvent Oil-5 | | 0.030 | g |
| Additive P-1 | | 0.010 | g |

14th layer: High-speed green-sensitive emulsion layer

| | | | |
|---|---|---|---|
| Emulsion K | silver | 0.30 | g |
| Internally fogged silver bromide emulsion (av. equivalent-sphere diameter 0.11 μm, cubic grain) | silver | 3.0 | mg |
| Gelatin | | 1.20 | g |
| Coupler C-4 | | 0.33 | g |
| Coupler C-5 | | 0.20 | g |
| Coupler C-7 | | 0.10 | g |
| Compound Cpd-B | | 0.030 | g |
| Compound Cpd-U | | 0.030 | g |
| Additive P-1 | | 0.010 | g |

15th layer: Yellow filter layer

| | | | |
|---|---|---|---|
| Yellow colloidal silver | silver | 2.0 | mg |
| Gelatin | | 1.0 | g |
| Compound Cpd-C | | 0.010 | g |
| Compound Cpd-M | | 0.020 | g |
| High-boiling organic solvent Oil-1 | | 0.020 | g |
| High-boiling organic solvent Oil-6 | | 0.020 | g |
| Fine-crystal solid dispersion of dye E-2 | | 0.25 | g |

16th layer: Blue sensitive interimage effect donating layer

| | | | |
|---|---|---|---|
| Emulsion V | silver | 0.20 | g |
| Gelatin | | 0.40 | g |
| High-boiling organic solvent Oil-6 | | 0.010 | g |
| High-boiling organic solvent Oil-7 | | 1.7 | mg |

17th layer: Low-speed blue-sensitive emulsion layer

| | | | |
|---|---|---|---|
| Emulsion L | silver | 0.07 | g |
| Emulsion M | silver | 0.05 | g |
| Emulsion N | silver | 0.09 | g |
| Gelatin | | 0.80 | g |
| Coupler C-8 | | 0.050 | g |
| Coupler C-9 | | 0.010 | g |
| Coupler C-10 | | 0.50 | g |
| Compound Cpd-B | | 0.020 | g |
| Compound Cpd-I | | 10.0 | mg |
| Compound Cpd-K | | 1.5 | mg |
| Ultraviolet absorbent U-5 | | 0.015 | g |
| Additive P-1 | | 0.020 | g |

18th layer: Medium-speed blue-sensitive emulsion layer

| | | | |
|---|---|---|---|
| Emulsion L | silver | 0.07 | g |
| Emulsion M | silver | 0.05 | g |
| Emulsion N | silver | 0.09 | g |
| Gelatin | | 0.80 | g |
| Coupler C-8 | | 0.050 | g |
| Coupler C-9 | | 0.010 | g |
| Coupler C-10 | | 0.50 | g |
| Compound Cpd-B | | 0.020 | g |
| Compound Cpd-I | | 10.0 | mg |
| Compound Cpd-K | | 1.5 | mg |
| Ultraviolet absorbent U-5 | | 0.015 | g |
| Additive P-1 | | 0.020 | g |

-continued

| 19th layer: High-speed blue-sensitive emulsion layer | | |
|---|---|---|
| Emulsion P | silver | 0.20 g |
| Emulsion Q | silver | 0.19 g |
| Gelatin | | 2.00 g |
| Coupler C-8 | | 0.10 g |
| Coupler C-10 | | 1.10 g |
| Coupler C-3 | | 0.010 g |
| High-boiling organic solvent Oil-5 | | 0.020 g |
| Compound Cpd-B | | 0.060 g |
| Compound Cpd-D | | 3.0 mg |
| Compound Cpd-E | | 0.020 g |
| Compound Cpd-F | | 0.020 g |
| Compound Cpd-N | | 5.0 mg |
| Ultraviolet absorbent U-5 | | 0.060 g |
| Additive P-1 | | 0.010 g |
| **20th layer: 1st protective layer** | | |
| Gelatin | | 0.70 g |
| Ultraviolet absorbent U-1 | | 0.020 g |
| Ultraviolet absorbent U-5 | | 0.030 g |
| Ultraviolet absorbent U-2 | | 0.10 g |
| Compound Cpd-B | | 0.030 g |
| Compound Cpd-O | | 5.0 mg |
| Compound Cpd-A | | 0.030 g |
| Compound Cpd-H | | 0.20 g |
| Dye D-1 | | 8.0 mg |
| Dye D-2 | | 0.010 g |
| Dye D-3 | | 0.010 g |
| High-boiling organic solvent Oil-3 | | 0.040 g |
| **21th layer: 2nd protective layer** | | |
| Colloidal silver | silver | 2.5 mg |

-continued

| | | |
|---|---|---|
| Fine-grain silver iodobromide emulsion (av. equivalent-sphere diameter 0.06 μm, av. silver iodide content 1 mol %) | silver | 0.10 g |
| Gelatin | | 0.80 g |
| Ultraviolet absorbent U-2 | | 0.030 g |
| Ultraviolet absorbent U-5 | | 0.030 g |
| High-boiling organic solvent Oil-3 | | 0.010 g |
| **22th layer: 3rd protective layer** | | |
| Gelatin | | 1.00 g |
| Polymethylmethacrylate (av. grain size 1.5 μm) | | 0.10 g |
| 6:4 copolymer of methylmethacrylate and methacrylic acid (av. grain size 1.5 μm) | | 0.15 g |
| Silicone oil SO-1 | | 0.20 g |
| Surfactant W-1 | | 0.020 g |
| Surfactant W-2 | | 0.040 g |

In addition to the above compositions, additives F-1 to F-10 were added to all emulsion layers. Also, a gelatin hardener H-1 and surfactants W-2, W-3 and W-4 for coating and emulsification were added to each layer. Furthermore, phenol, 1,2-benzisothiazoline-3-one, 2-phenoxyethanol, phenethylalcohol, and p-benzoic butylester were added as antiseptic and mildewproofing agents.

The coating thickness in dry state of the sample 301 prepared as above was 26.5 μm and swelling rate was 1.88-fold when it was swollen with distilled water at a temperature of 25° C.

C-1

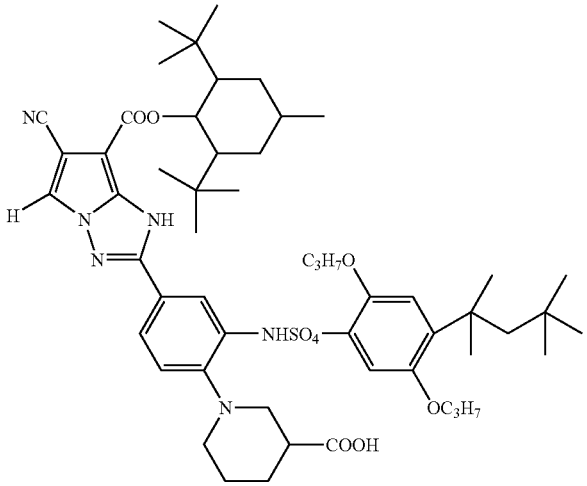

C-2

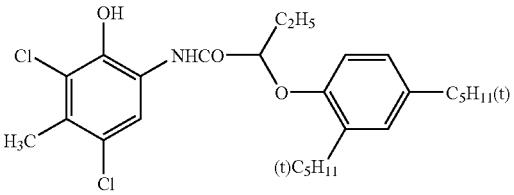

C-3

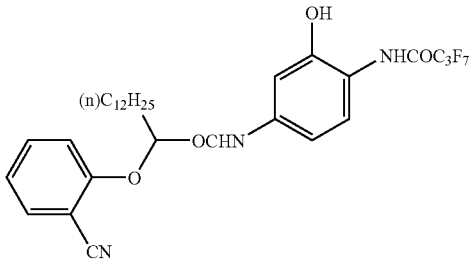

C-4

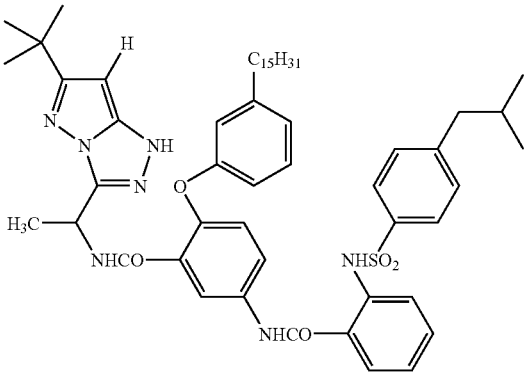

-continued
C-5
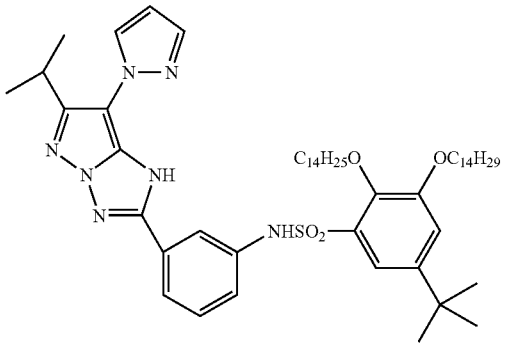
C-6
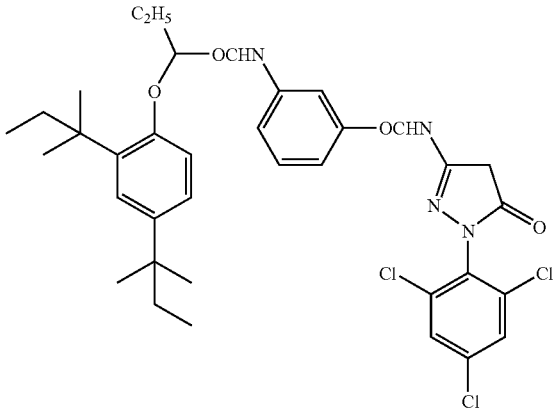
C-7
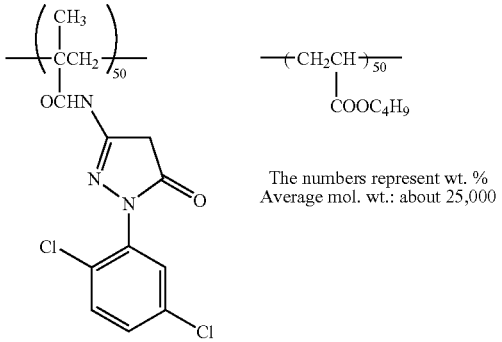
The numbers represent wt. %
Average mol. wt.: about 25,000
C-8
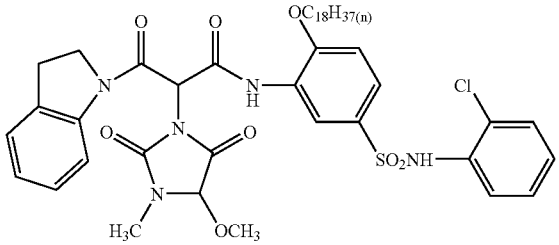
C-9
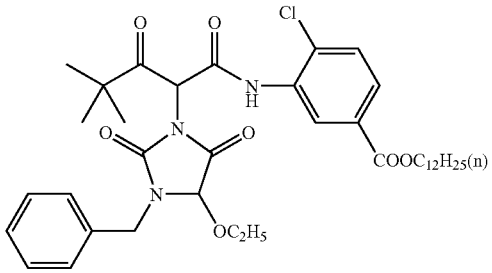
C-10
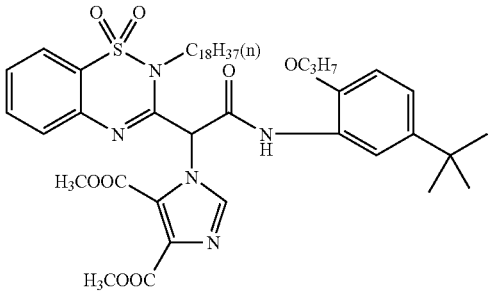
Oil-1
Tri(n-hexyl)phosphate
Oil-2
Tricresyl phosphate
Oil-3
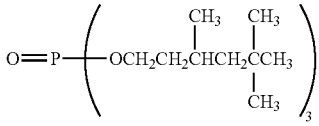
Oil-4
Tricyclohexyl phosphate
Oil-5
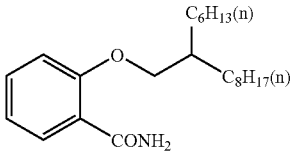
Oil-6
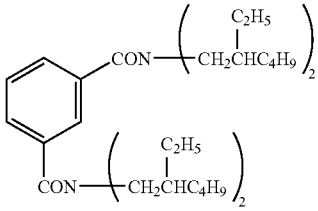

-continued
Oil-7
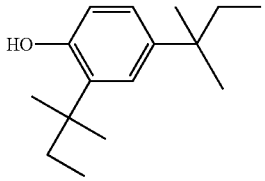
Oil-8
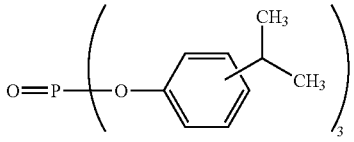
(A mixture of isomers)
Oil-9
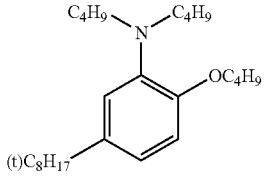
Oil-10
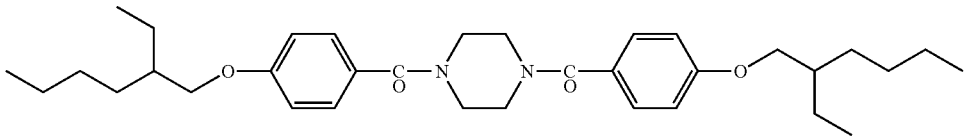
Cpd-A
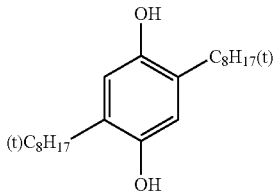
Cpd-B
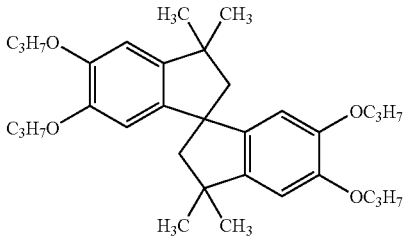
Cpd-C
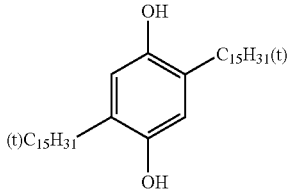
Cpd-D
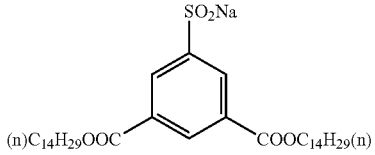
Cpd-E
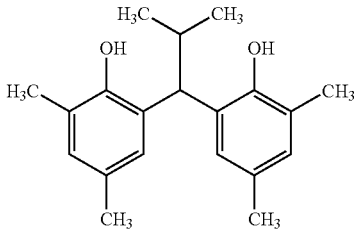
Cpd-F
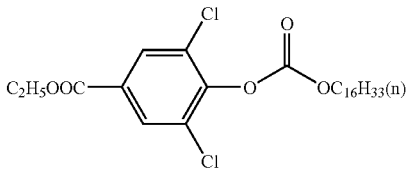
Cpd-G
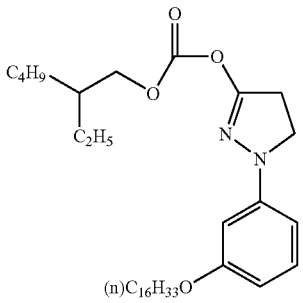
Cpd-H
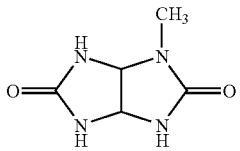

-continued
Cpd-I
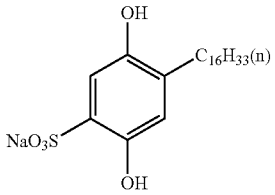
Cpd-J
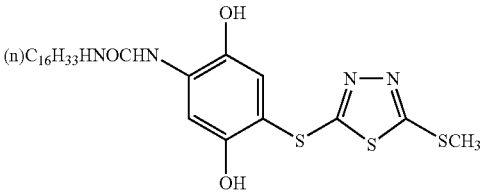
Cpd-K
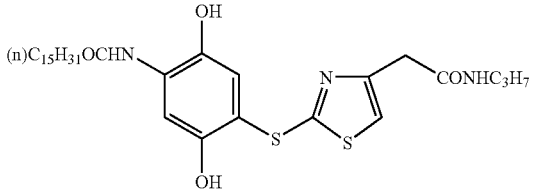
Cpd-L
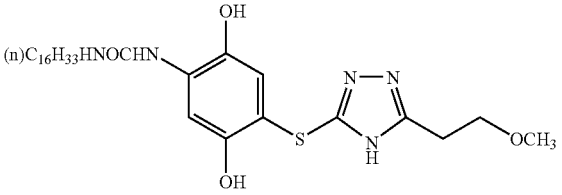
Cpd-M
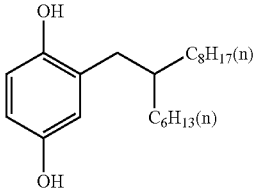
Cpd-N
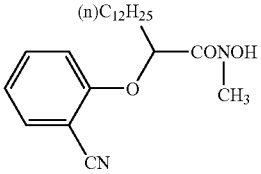
Cpd-O
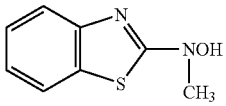
Cpd-P
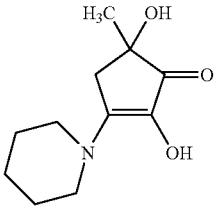
Cpd-Q
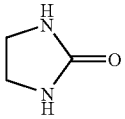
Cpd-R
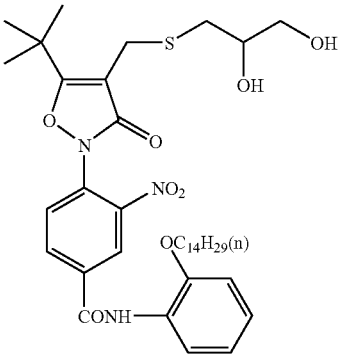
Cpd-S
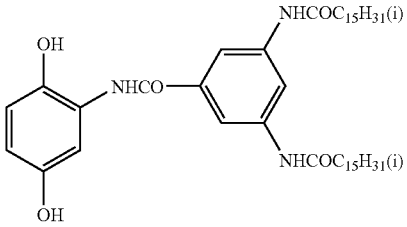
Cpd-T
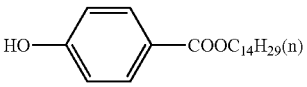

-continued
Cpd-U
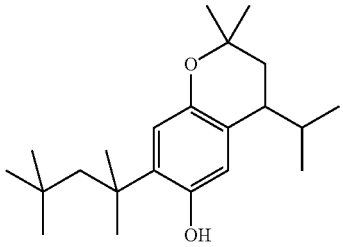
U-1
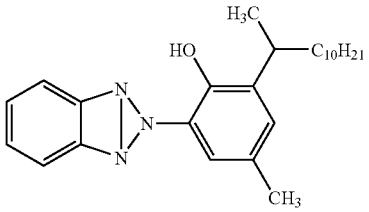
U-2
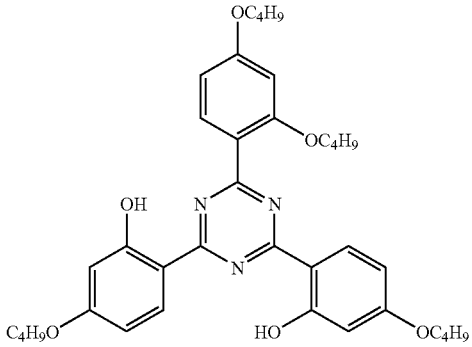
U-3
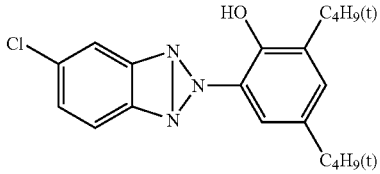
U-4
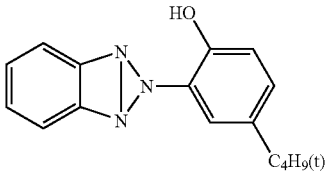
U-5
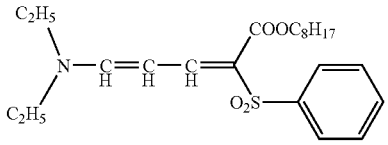
U-6
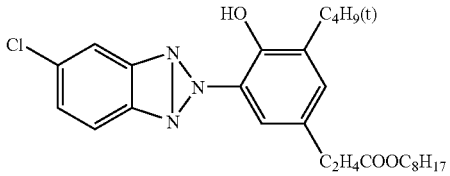
S-1
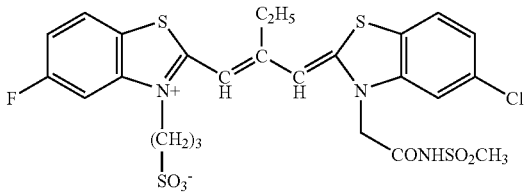
S-2
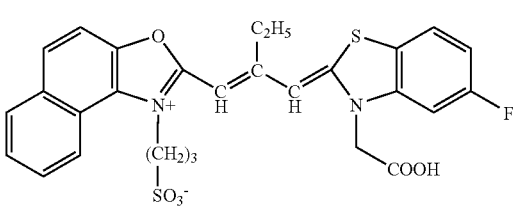
S-3
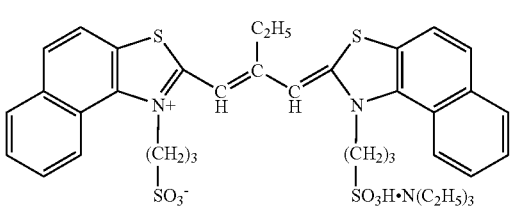
S-4
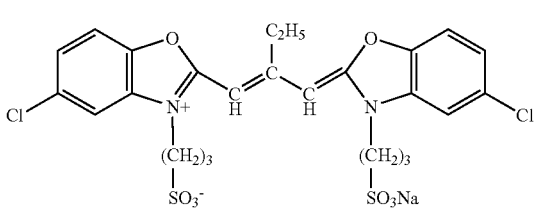
S-5
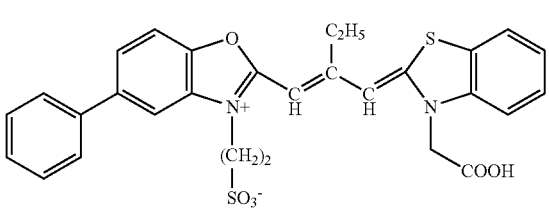

-continued
S-6
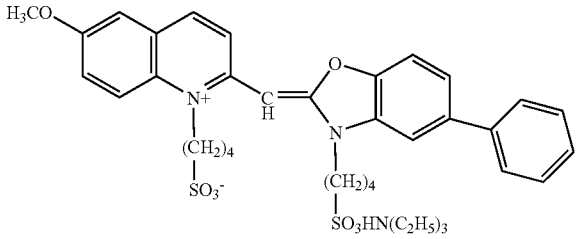
S-7
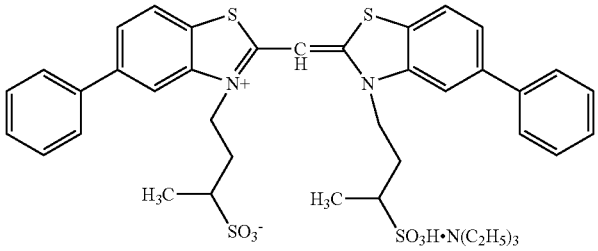
S-8
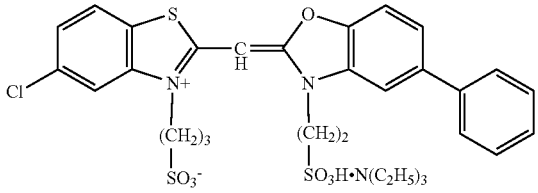
S-9
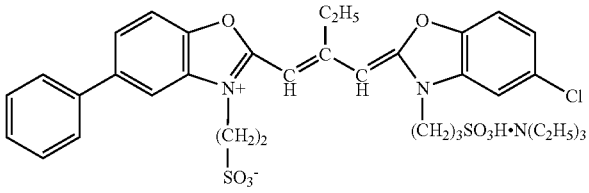
S-10
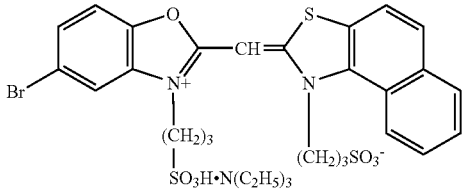
S-11
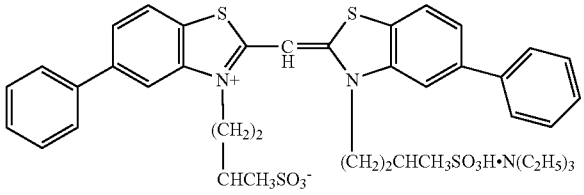
S-12
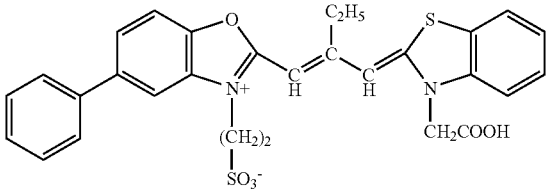
S-13
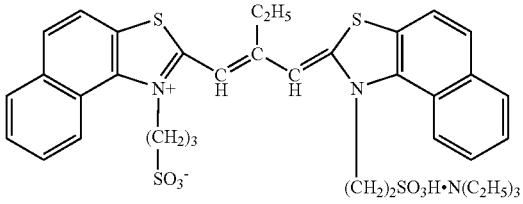
S-14
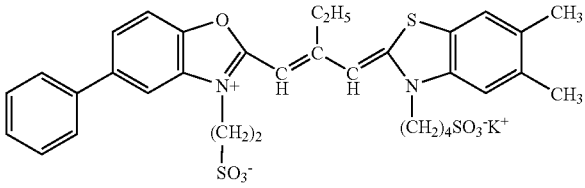
S-15
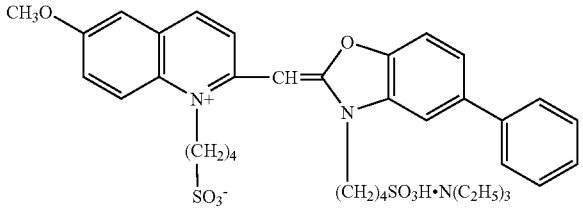
D-1
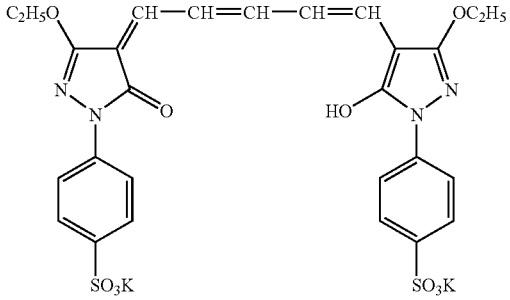
D-2
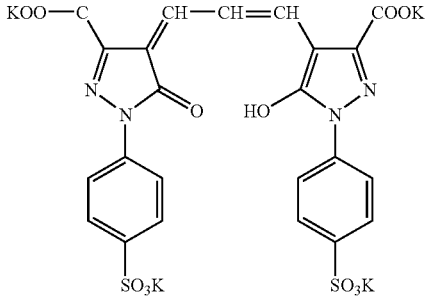

-continued
D-3
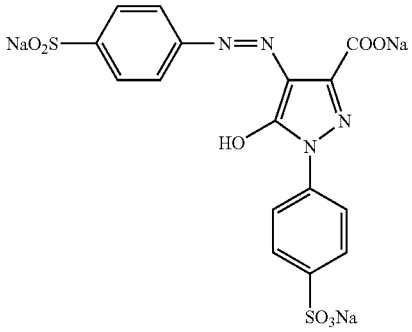
D-4
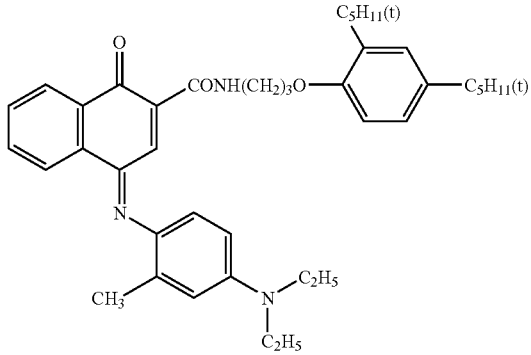
D-5
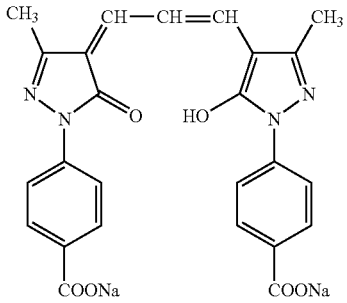
D-6
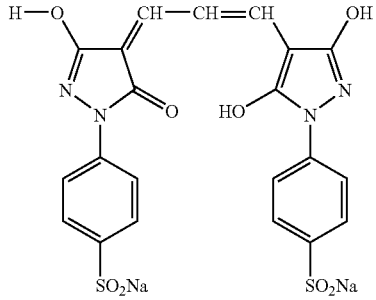
D-7
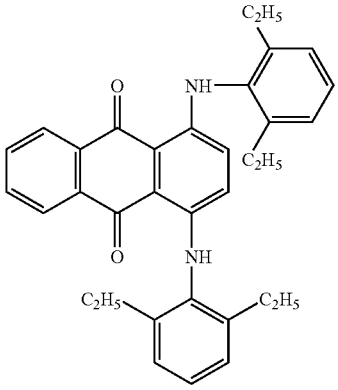
D-8
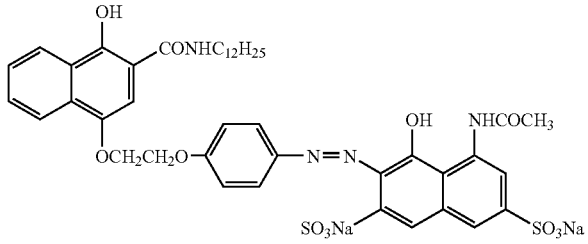
D-9
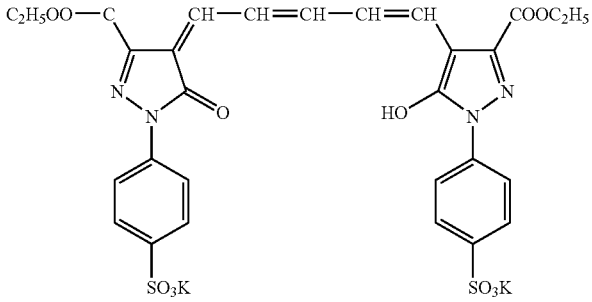
D-10
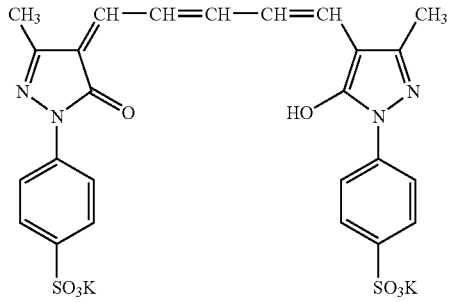
D-11
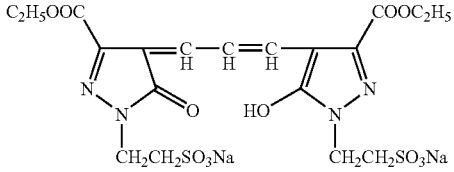

-continued
E-1
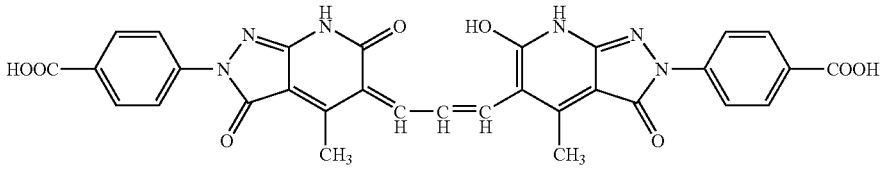
E-2
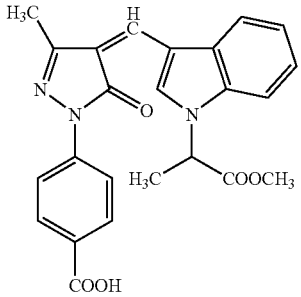
H-1
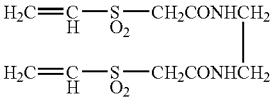
W-1
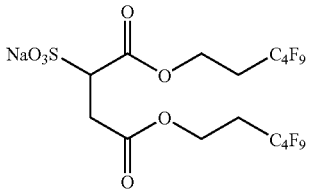
W-2
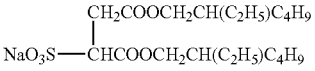
W-3
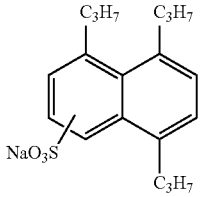
W-4
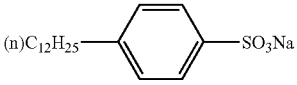
W-5
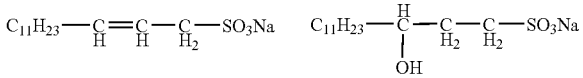
A mixture (60%:40%)
P-1
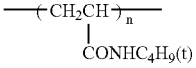
(n=100-1000)
P-2
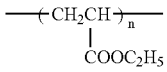
(n=100-1000)
P-3
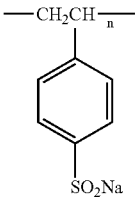
(n=100-1000)
P-4
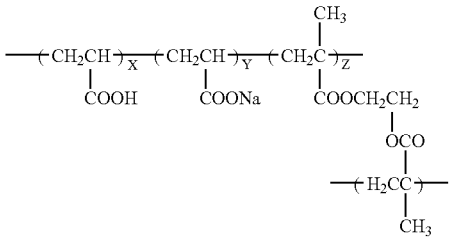
(X:Y:Z = 42.5:7.5:50)
F-1
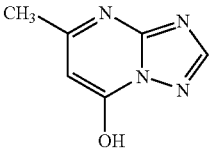

-continued

F-2

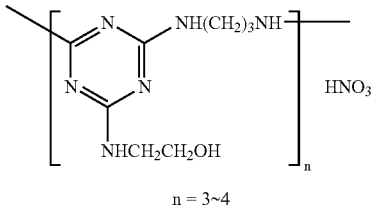

n = 3~4

F-3

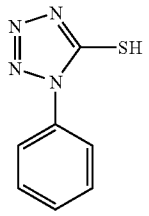

F-4

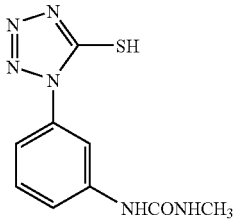

F-5

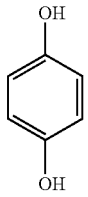

F-6

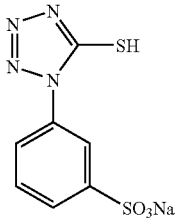

F-7

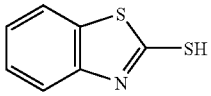

F-8

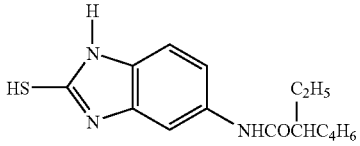

F-9

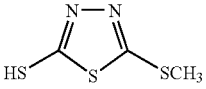

SO-1

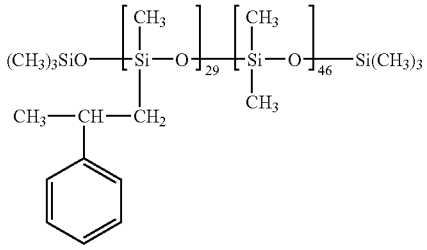

F-10

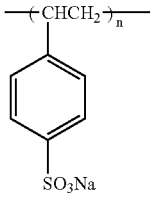

Reduction sensitizer-1

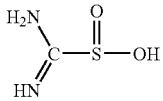

Rhodium salt-1

$K_3[RhCl_6]$

Iridium salt-1

$K_2IrCl_6$

Preparation of Organic Solid Dispersed Dye (Preparation of Fine Crystalline Solid Dispersion of dye E-1)

100 g of Pluronic F88 (an ethylene oxide-propylene oxide block copolymer) manufactured by BASF CORP. and water were added to a wet cake of the dye E-1 (the net weight of E-1 was 270 g), and the resultant material was stirred to make 4,000 g. Next, the Ultra Visco Mill (UVM-2) manufactured by Imex K.K. was filled with 1,700 mL of zirconia beads with an average grain size of 0.5 mm, and the slurry was milled through this UVM-2 at a peripheral speed of approximately 10 m/sec and a discharge rate of 0.5 L/min for 2 hr. The beads were filtered out, and water was added to dilute the material to a dye concentration of 3%. After that, the material was heated to 90° C. for 10 hr for stabilization. The average grain size of the obtained fine dye grains was 0.30 μm, and the grain size distribution (grain size standard deviation ×100/average grain size) was 20%.

(Preparation of Fine Crystalline Solid Dispersion of Dye E-2)

Water and 270 g of W-4 were added to 1,400 g of a wet cake of E-2 containing 30 weight % of water, and the resultant material was stirred to form a slurry having an E-2 concentration of 40 weight %. Next, the Ultra Visco Mill (UVM-2) manufactured by Imex K.K. was filled with 1,700 mL of zirconia beads with an average grain size of 0.5 mm, and the slurry was milled through this UVM-2 at a peripheral speed of approximately 10 m/sec and a discharge rate of 0.5 L/min for 8 hr, thereby obtaining a solid fine-grain dispersion of E-2. This dispersion was diluted to 20 weight % by ion exchange water to obtain a fine crystalline solid dispersion. The average grain size was 0.15 μm.

<Preparation of Samples 302 to 321>

Each of samples 302 to 321 was prepared by replacing the emulsion Em-101 of the seventh layer: low sensitivity red sensitive emulsion layer with emulsions Em-102 to 121 at an equal silver amount, in the preparation of the sample 301.

<Evaluation of Sensitivity and Latent Image Storability>

Exposure and development processing similar as Example 1 was carried out for the samples 301 to 321 and the sensitivity and latent image storability were evaluated. Provided that the time of the first development processing step was changed to 6 minutes.

The evaluation result with respect to the samples 301 to 321 was similar as the result of the samples 101 to 121 of Example 1. Namely, it could be confirmed that the effect of the emulsion of the present invention is also expressed in the multilayer color photosensitive material of the present Examples.

What is claimed is:

1. A silver halide photographic emulsion, wherein 70% or more of the total projected area of silver halide grains is occupied by silver halide grains satisfying the following requirements (a) to (d) and (f):

(a) said silver halide grains comprise a tabular silver halide host grain with an aspect ratio of 12 or more having two mutually parallel principal planes and a silver halide protrusion portion bonded by epitaxial junction on the surface of the host grain;

(b) a silver bromide content of the host grain and the protrusion portion both are 70 mol % or more;

(c) when an average silver iodide content of all grains is I mol %, the average silver iodide content of the region of 8%, based on the silver amount of the host grain, of the outer shell of the host grain is (I+12) mol % or less;

(d) the protrusion portion contains pseudo-halides; and (f) when the average silver iodide content of all grains is I mol %, the silver iodide content of the protrusion portion is I mol % or less.

2. The silver halide photographic emulsion according to claim 1, wherein 70% or more of the total projected area of silver halide grains is occupied by silver halide grains satisfying the following requirement (e) in addition to the above requirements (a) to (d) and (f):

(e) a silver chloride content of the host grain and the protrusion portion both are 1 mol % or less.

3. The silver halide photographic emulsion according to claim 1, wherein 70% or more of the total projected area of silver halide grains is occupied by silver halide grains satisfying the following requirement (g) in addition to the above requirements (a) to (d) and (f):

(g) the protrusion portion contains an iridium compound.

4. The silver halide photographic emulsion according to claim 2, wherein 70% or more of the total projected area of silver halide grains is occupied by silver halide grains satisfying the following requirement (g) in addition to the above requirements (a) to (f):

(g) the protrusion portion contains an iridium compound.

5. The silver halide photographic emulsion according to claim 1, containing calcium.

6. The silver halide photographic emulsion according to claim 1, chemically sensitized using a compound releasing AuCh— ion (wherein Ch represents S, Se or Te).

7. A silver halide photosensitive material comprising a photosensitive layer containing a silver halide photographic emulsion according to claim 1.

* * * * *